US006901892B2

(12) United States Patent
Mavinahally et al.

(10) Patent No.: US 6,901,892 B2
(45) Date of Patent: Jun. 7, 2005

(54) TWO STROKE ENGINE WITH ROTATABLY MODULATED GAS PASSAGE

(75) Inventors: Nagesh S. Mavinahally, 207 Brittany Park, Anderson, SC (US) 29621; Jay S. Veerathappa, Northridge, CA (US)

(73) Assignee: Nagesh S. Mavinahally, Anderson, SC (US)

( * ) Notice: Subject to any disclaimer, the term of this patent is extended or adjusted under 35 U.S.C. 154(b) by 0 days.

(21) Appl. No.: 10/446,393

(22) Filed: May 28, 2003

(65) Prior Publication Data

US 2004/0040522 A1 Mar. 4, 2004

Related U.S. Application Data

(60) Provisional application No. 60/400,916, filed on Aug. 3, 2002, and provisional application No. 60/400,968, filed on Aug. 3, 2002.

(51) Int. Cl.[7] ..... F02B 33/04
(52) U.S. Cl. ..... 123/73 V
(58) Field of Search ..... 123/73 V, 73 PP, 123/73 D, 73 DA, 73 S, 65 V, 73 A

(56) References Cited

U.S. PATENT DOCUMENTS

| | | | | |
|---|---|---|---|---|
| 666,264 A | * | 1/1901 | Denison | 123/73 D |
| 4,253,433 A | | 3/1981 | Blair | |
| 5,379,732 A | | 1/1995 | Mavinahally et al. | |
| 5,425,341 A | | 6/1995 | Connolly et al. | |
| 5,425,346 A | | 6/1995 | Mavinahally | |
| 6,101,991 A | * | 8/2000 | Glover | 123/73 PP |
| 6,112,708 A | | 9/2000 | Sawada et al. | |
| 6,240,886 B1 | | 6/2001 | Noguchi | |
| 6,273,037 B1 | | 8/2001 | Cobb, Jr. | |
| 6,289,856 B1 | | 9/2001 | Noguchi | |
| 6,293,235 B1 | | 9/2001 | Cobb, Jr. | |
| 6,408,805 B2 | | 6/2002 | Uenoyama et al. | |
| 6,491,004 B2 | | 12/2002 | Rosskamp et al. | |
| 6,491,006 B2 | | 12/2002 | Jonsson et al. | |
| 6,513,466 B2 | | 2/2003 | Bignion et al. | |

FOREIGN PATENT DOCUMENTS

WO WO 9212332 A1 * 7/1992 ..... F01L/7/12

* cited by examiner

*Primary Examiner*—Henry C. Yuen
*Assistant Examiner*—Hyder Ali
(74) *Attorney, Agent, or Firm*—Steven J. Rosen

(57) ABSTRACT

A two stroke internal combustion engine includes at least one gaseous communication passage between a crankcase chamber and a combustion chamber of the engine. A first rotary shut-off valve on a periphery of a rotatable circular disk is operatively disposed between the passage and the crankcase chamber and rotatably connected to a crankshaft of the engine. The valve includes at least one circumferentially extending pathway extending axially at least partially through the disk and is rotatably alignable with a crankcase port of the passage though the crankcase chamber. The circumferentially extending pathway extends circumferentially less than 180 degrees. Two particular embodiments of the pathways include rectangular cross-sectional slots and annular L-shaped pathways. The gaseous communication passage may be a transfer passage or a charge injection passage or both which are controlled two or more axially adjacent rotary shut-off valves on the periphery of the disk.

82 Claims, 47 Drawing Sheets

TWO STROKE ENGINE WITH ROTATABLY MODULATED GAS PASSAGE

This application claims the benefit of U.S. Provisional Application No. 60/400,916, filed on Aug. 3, 2002 and Provisional Application No. 60/400,968, filed on Aug. 3, 2002.

BACKGROUND OF THE INVENTION

FIELD OF THE INVENTION

The present invention relates to two stroke internal combustion engines and, particularly, to such engines with a rotatable disk valve in the engine for modulating gas passages.

A particular field of application of the invention is a two stroke internal combustion engine. One application of the invention is to a small high speed two stroke engine, such as utilized in hand-held power equipment such as leaf blowers, string trimmers, hedge trimmers, also in wheeled vehicle applications such as mopeds, motorcycles, scooters, and in small outboard boat engines. The small two stroke engine has many desirable characteristics, including simplicity of construction, low cost of manufacturing, high power-to-weight ratios, high speed operational capability and, in many parts of the world, ease of maintenance.

Inherent drawbacks of two stroke engines are high emission levels and poor fuel economy due to short-circuit loss of fuel and air charge during the scavenging process. One drawback of the simple two stroke engine is a loss of a portion of the fresh unburned fuel charge from the cylinder during the scavenging process. In the two stroke engine, the homogeneous charge enters the cylinder through transfer ports during the scavenging process, when the exhaust port is also open. As such, some of the charge escapes through the exhaust port leading to high levels of hydrocarbons (HC) in the tailpipe. This leads to the poor fuel economy and high emission of unburned hydrocarbon, thus, rendering the simple two stroke engine difficult to comply with increasingly stringent governmental pollution restrictions. This drawback can be relieved by separating the scavenging of the cylinder, with fresh air, from the charging of the cylinder, with fuel. This separation can be achieved by injecting the liquid fuel into the cylinder or, more preferably, by injecting the fuel charge by utilizing a pressurized air or lean charge source, separate from the fresh air scavenge, to spray the fuel into the cylinder.

Several concepts and technologies have been proposed or tried to circumvent the short-circuit loss of fresh charge. Among these techniques are direct or indirect fuel injection, stratified scavenging, air head, air assisted fuel injection, and compressed wave injection. Most of these technologies are either complex, expensive or have limitations as to the benefits throughout the operating range of an engine. The fuel injection technology is not economical for small engines but air head scavenging and stratified scavenging are promising.

An air assisted fuel injection system using compressed wave injection is disclosed in U.S. Pat. No. 6,273,037. The compressed wave injection system engine uses the piston to control the charge induction and, thus, the opening and closing time of induction is symmetrical about the TDC. Also, the charge depends on the wave dynamics for injection. This may lead to an optimum performance only at a certain operating range of speed and load.

U.S. Pat. No. 4,253,433, March 1981, by G. P. Blair, discloses a stratified scavenging system in which the retention of charge in the injection tube during induction depends on the length of the tube and has no timing system to start and end induction and injection of the charge. As such, the system may perform best in a narrow range of engine speed and load.

It is desirable to have a two stroke engine with flexibility to vary the injection passage volume and timing during operation of the engine. It is also desirable to have a two stroke engine with ability to optimize engine variables for a variety and range of engine operating condition from idle through full load and speed. It is also desirable to have a two stroke engine with a charge induction and injection timing in a stratified scavenging system that can be varied continuously and, in real time and, the volume of the charge inducted that can also be changed. The design is also applicable to inlet timing, in a rotary valve system, where charge inlet and closing timing can be varied. Also, the same system can be used to vary the transfer port timing. Further, the system can be used to vary the transfer or boost port timing and passage volume. It is also desirable to have fixed unsymmetrical timing for charge induction and injection, and/or for scavenging process.

SUMMARY OF THE INVENTION

A two stroke internal combustion engine includes at least one gaseous communication passage between a crankcase chamber and a combustion chamber of the engine and a rotatable circular disk rotatably connected to a crankshaft of the engine. At least one rotary shut-off valve is located in a radially outermost section of the circular disk bordered by a periphery of the circular disk and operatively disposed between the passage and the crankcase chamber for opening and closing gaseous communication between the passage and the crankcase chamber. One embodiment of the rotary shut-off valve includes at least one circumferentially extending pathway that extends axially at least partially through the disk. The pathway is rotatably disposed between the passage and the crankcase chamber for opening and closing gaseous communication between the passage and the crankcase chamber. In the exemplary embodiment, the pathway extends circumferentially less than 180 degrees. One embodiment of the pathway is a circumferentially extending annular slot that extends axially at least partially through the periphery of the circular disk. The disk may be disposed within the crankcase chamber and also may be a crank web of the engine.

Some embodiments of the rotary shut-off valve include at least two circumferentially spaced apart and circumferentially extending pathways extending axially at least partially through the disk. The pathways extend circumferentially less than 180 degrees and the pathways are rotatably disposed between the passage and the crankcase chamber for opening and closing gaseous communication between the passage and the crankcase chamber.

Other embodiments of the engine include an angularly adjustable ring having an annular channel disposed between the circumferentially extending pathway and the passage and a ring port through the ring leading to the annular channel. More particular embodiments of the engine include a rotary shut-off valve with at least two circumferentially spaced apart and circumferentially extending pathways extending axially at least partially through the disk and extending circumferentially less than 180 degrees. The pathways are rotatably disposed between the passage and the crankcase chamber for opening and closing gaseous communication between the passage and the crankcase chamber.

A fixed lip extending into the annular channel may be incorporated to vary the volume of channel by rotating the ring and the channel.

One embodiment of the pathway is a circumferentially extending annular rectangular cross-sectional slot that extends axially at least partially through the periphery of the circular disk. Another embodiment of the pathway is an annular L-shaped pathway having a radially inwardly extending annular slot intersecting an axially extending annular slot. The radially inwardly extending annular slot includes a radially outwardly facing radial inlet in the periphery. The axially extending annular slot includes an axially facing axial outlet located radially inwardly of the periphery.

Other embodiments of the engine include an angularly adjustable ring concentrically disposed around the periphery of the circular disk, an annular ring channel extending circumferentially partway through the angularly adjustable ring and disposed between the crankcase chamber and the passage, and a ring port in the adjustable ring that is rotatably open to the radially inwardly extending annular slot through the radially outwardly facing radial inlet.

Another embodiment of the engine includes the circumferentially extending annular rectangular cross-sectional slot axially adjacent to the L-shaped pathway, both of which extend axially at least partially through the periphery of the circular disk. Axially adjacent first and second angularly adjustable rings concentrically surrounding the circular disk and first and second annular ring channels extending circumferentially partway through the first and second angularly adjustable rings, respectively. The first annular ring channel is disposed between the crankcase chamber and the one gaseous communication passage and the second annular ring channel is disposed between the crankcase chamber and a second gaseous communication passage. The first and second annular ring channels include first and second ring ports, respectively, with the first ring port being rotatably open to the radially inwardly extending annular slot through the radially outwardly facing radial inlet in the periphery and the second ring port being rotatably open to the annular rectangular cross-sectional slot.

A more particular embodiment of the two stroke internal combustion engine includes a carburetor including first and second barrels in gaseous flow communication with a charge injection port and a main inlet port, respectively. The charge injection port and the main inlet port lead into a combustion chamber of a cylinder bore of the engine. A first flow passage extends between the first barrel and the charge injection port. An injection passage extends between the first flow passage and the crankcase chamber. At least one rotary shut-off valve located in a radially outermost section of the circular disk bordered by a periphery of the circular disk is operatively disposed between the injection passage and the crankcase chamber for opening and closing gaseous communication between the injection passage and the crankcase chamber. At least one transfer passage connects in gaseous communication the crankcase chamber and the combustion chamber in the cylinder bore of the engine.

Another more particular embodiment of the two stroke internal combustion engine includes a cylinder block housing a cylinder bore and a piston disposed within the cylinder bore connected by means of a connecting rod to a crank throw on a circular crank web of a crankshaft. The crankshaft is journaled for rotation about a crankshaft axis within a crankcase chamber of a crankcase affixed to a lower end of the cylinder block. A combustion chamber is defined within the cylinder bore above the piston and at least one transfer passage connects in gaseous communication to the crankcase chamber and the combustion chamber in the cylinder bore of the engine. First and second piston ports are disposed in a skirt of the piston and connected in gaseous communication by an air channel. The first piston port is translatably alignable with an air inlet port disposed through the cylinder block to the cylinder bore. The second piston port is translatably alignable with a transfer port leading to the transfer passage. A rotatable circular disk is rotatably connected to a crankshaft of the engine and at least one rotary shut-off valve located in a radially outermost section of the circular disk bordered by a periphery of the circular disk and operatively disposed between the transfer passage and the crankcase chamber for opening and closing gaseous communication between the transfer passage and the crankcase chamber.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
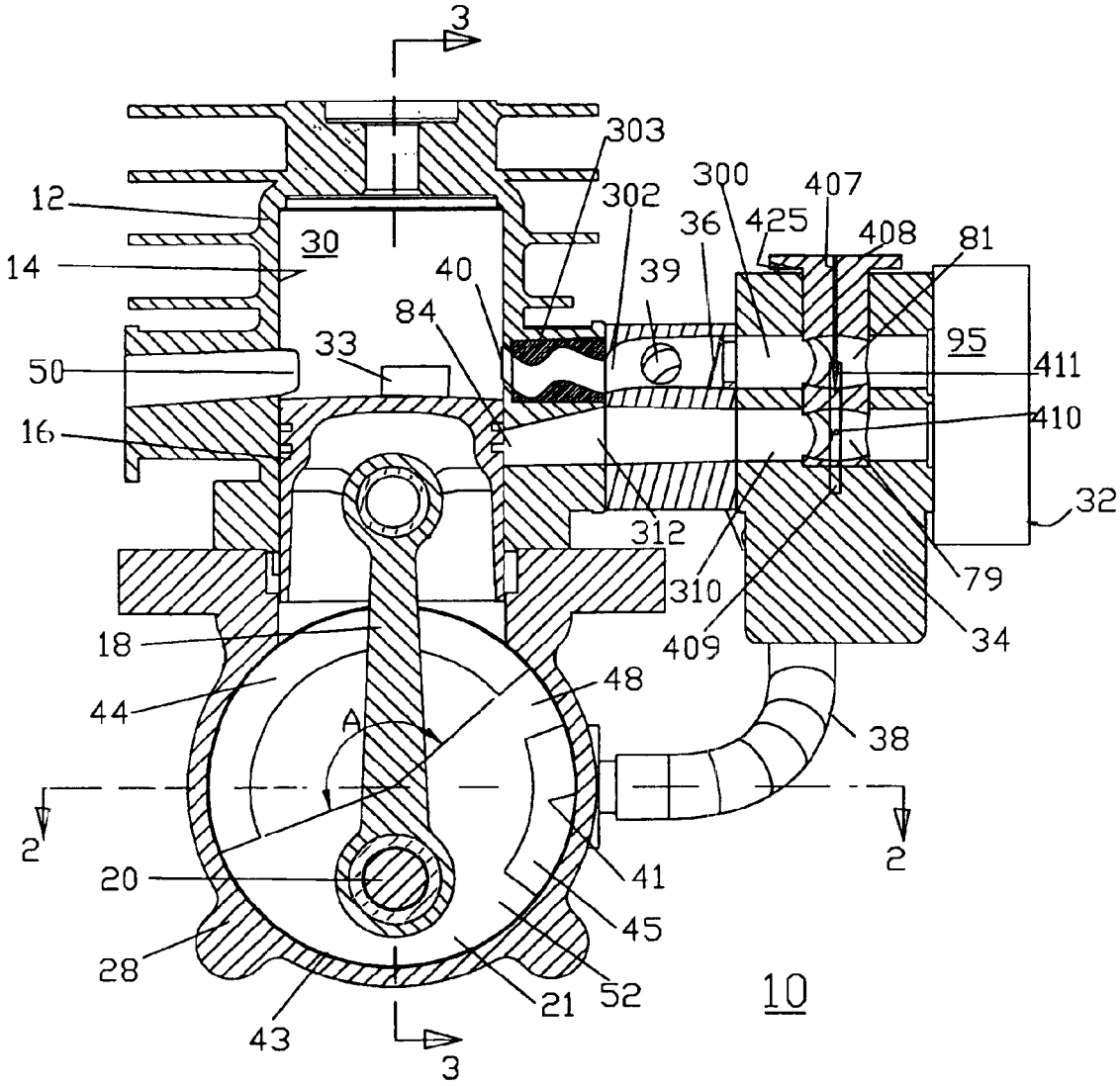
FIG. 1 is a longitudinal sectional view illustration of an exemplary embodiment of a two stroke engine with a stratified scavenging system controlled by a rotatable disk and having a fixed volume injection tube.

Illustrated in FIGS. 1–4 is an exemplary two stroke engine 10 having a cylinder block 12 that houses a cylinder bore 14. A piston 16 reciprocates within the cylinder bore 14 and is connected by means of a connecting rod 18 to a crank throw 20 on a circular crank web 21 of a crankshaft 22. The crankshaft 22 is journaled for rotation about a crankshaft axis 19 within a crankcase chamber 26 of a crankcase 28 that is affixed to the lower end of the cylinder block 12 in a suitable manner. A combustion chamber 30 is defined as a region within the cylinder bore 14 above the piston 16. The engine includes a two-way scavenging system including two transfer passages 11 between the crankcase chamber 26 and the combustion chamber 30. The transfer passages 11 are used for scavenging and allowing a fresh fuel/air charge to be drawn from the crankcase chamber 26 into the combustion chamber 30 through a transfer port 33 in the cylinder block 12 at the completion of a power stroke.

A rich fuel/air mixture is inducted into the combustion chamber 30 of the cylinder bore 14 by a charge induction system 32 which includes a carburetor 34, a one-way non-return valve 36, an injection tube 38, and a charge injection port 40 extending through the cylinder block 12 into the cylinder bore 14 to point below the combustion chamber 30. The injection tube 38 provides an injection passage 39 for gaseous communication between the combustion chamber 30 and the crankcase chamber 26. The charge injection port 40 is used for injection of the rich charge contained in the injection tube 38 which occurs only during an injection portion of a scavenging process that is during the descending of piston or early compression process. An injection insert 303 having a curved passage is disposed between the injection passage 39 and the charge injection port 40. The curved passage is aimed upward into the combustion chamber 30 to direct the charge toward the top of the combustion chamber away from the exhaust port 50 thus keeping the flow of charge closer to the cylinder wall 14 opposite to the exhaust port 50. The injector insert may be made of two pieces for ease of manufacturing.

The injection passage 39 leads to and is in fluid communication with a crankcase port 41 in the crankcase 28 which is open to a rotary shut-off valve 48. The timing of the induction of the fuel/air mixture and injection of fuel is controlled by the rotary shut-off valve 48 mounted on the circular disk which, in this embodiment, is a crank web 21 that is rotatably connected to the crankshaft 22. Circumferentially extending first and second axial gas pathways, illustrated as rectangular cross-sectional annular slots 44 and 45, extend axially at least partially through a radially outermost section 52 of the circular disk or crank web 21 bordered by a periphery 43 of the circular disk or crank web 21 and are alignable with a crankcase port 41 open to the passage or injection tube 38.

Figure 2:
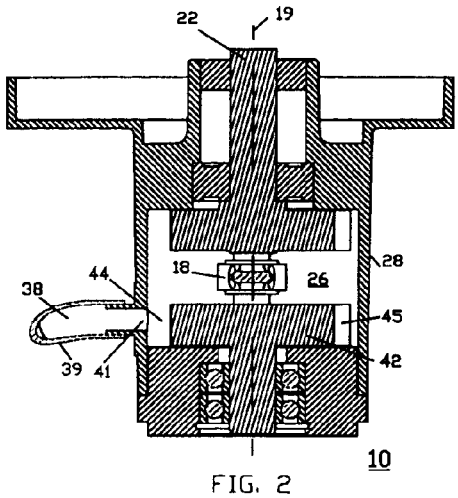
FIG. 2 is a sectional view illustration of the engine through 2—2 in FIG. 1.
Figure 2A:
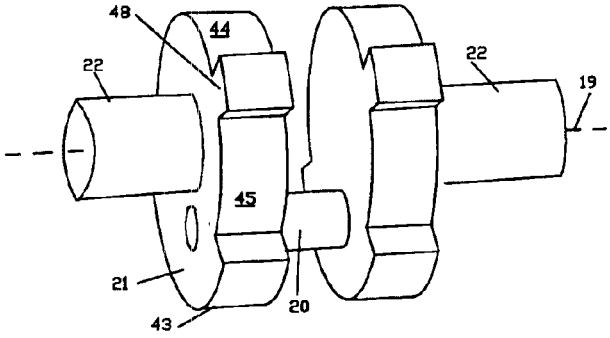
FIG. 2A is a perspective view illustration of a crank web with rotary shut-off valves in the engine illustrated in FIG. 1.

The annular slots 44 and 45 of the engine 10 engine illustrated in FIG. 2 extend radially outwardly through the periphery of the disk and axially at least partially through the radially outermost section 52 of the circular disk in the engine illustrated in FIG. 2. The circumferentially extending first and second axial gas pathways, the annular slots 44 and 45, are generally arcuate about the crankshaft axis 19 having vertex angles A less than 180 degrees with a vertex at the axis. The circumferentially extending axial gas pathways may also be annular slots that are located radially inwardly of the periphery of the disk and exend axially completely through the the circular disk in the engine.

The start of injection occurs when the crankcase port 41 is opened by the slots 44 and 45 in the crank web 21. Induction of rich charge into the injection tube 38 occurs during ascending of piston when the crankcase port 41 is opened again by the slot 44 in the crank web. The rich charge is regulated by a barrel regulating valve 81 in a first barrel 300 of the carburetor 34 illustrated in FIGS. 1 and 4. A first flow passage 302 extends between the first barrel 300 and the charge injection port 40. The injection tube 38 and the injection passage 39 connects to the first flow passage 302 between the barrel regulating valve 81 in a first barrel 300 and the charge injection port 40 and provides gaseous communication between the combustion chamber 30 and the crankcase chamber 26. The crank web 21 closes off the crankcase port 41 and the injection passage 39 in the injection tube 38 until the crankcase port 41 is circumferentially aligned with the first or second slots 44 and 45 thus allowing gaseous communication between the crankcase chamber 26 and the injection passage 39. The circumferentially extending first and second axial gas pathways such as the annular slots 44 and 45 provide a valve flowpath between the crankcase port 41 and the crankcase chamber 26.

Figure 4:
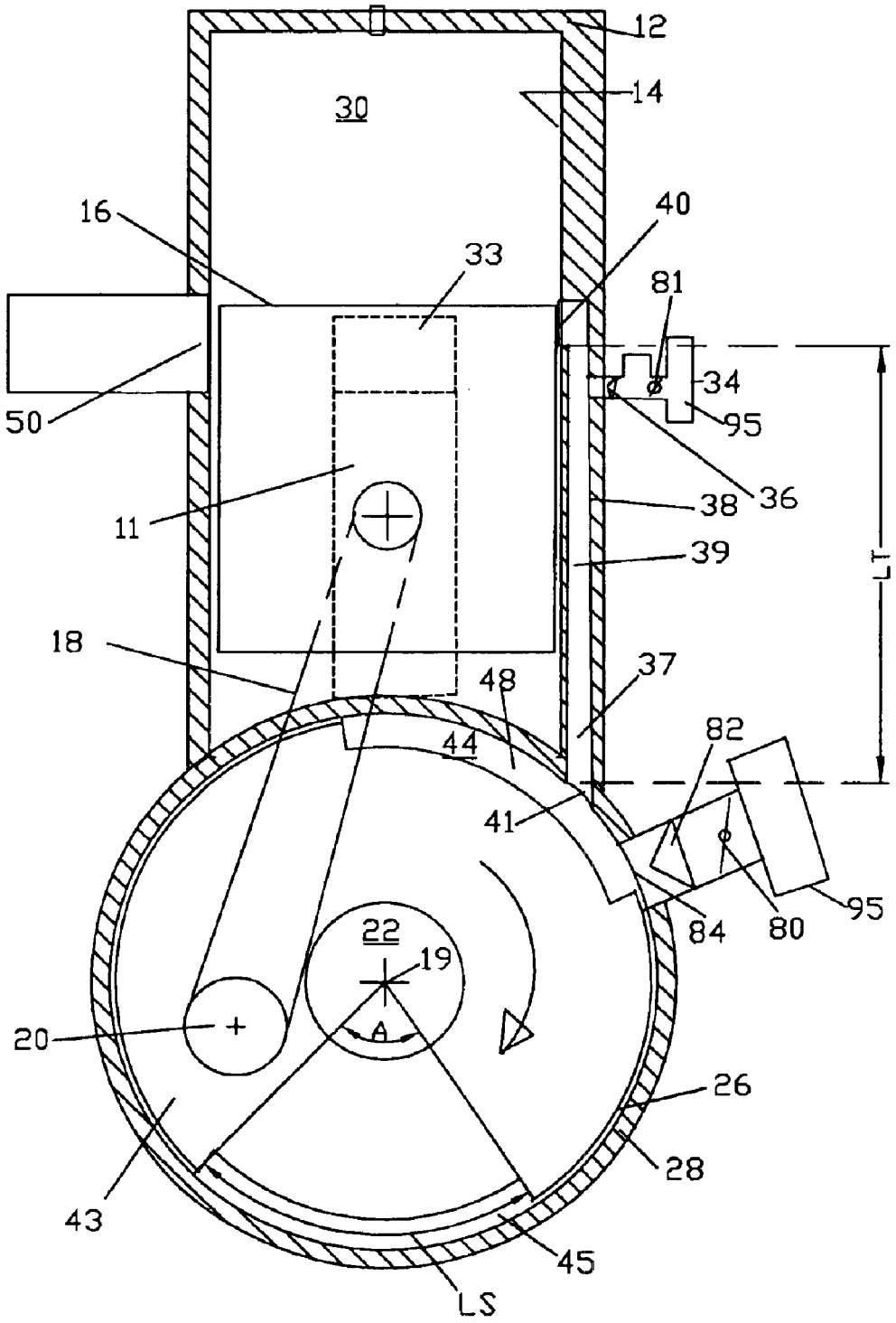
FIG. 4 is a longitudinal sectional side view illustration of an exemplary embodiment of a two stroke engine with a stratified scavenging system controlled by a rotatable disk and having a fixed volume injection tube with a reed valve controlled inlet system engine illustrated in FIG. 2.
Figure 51:
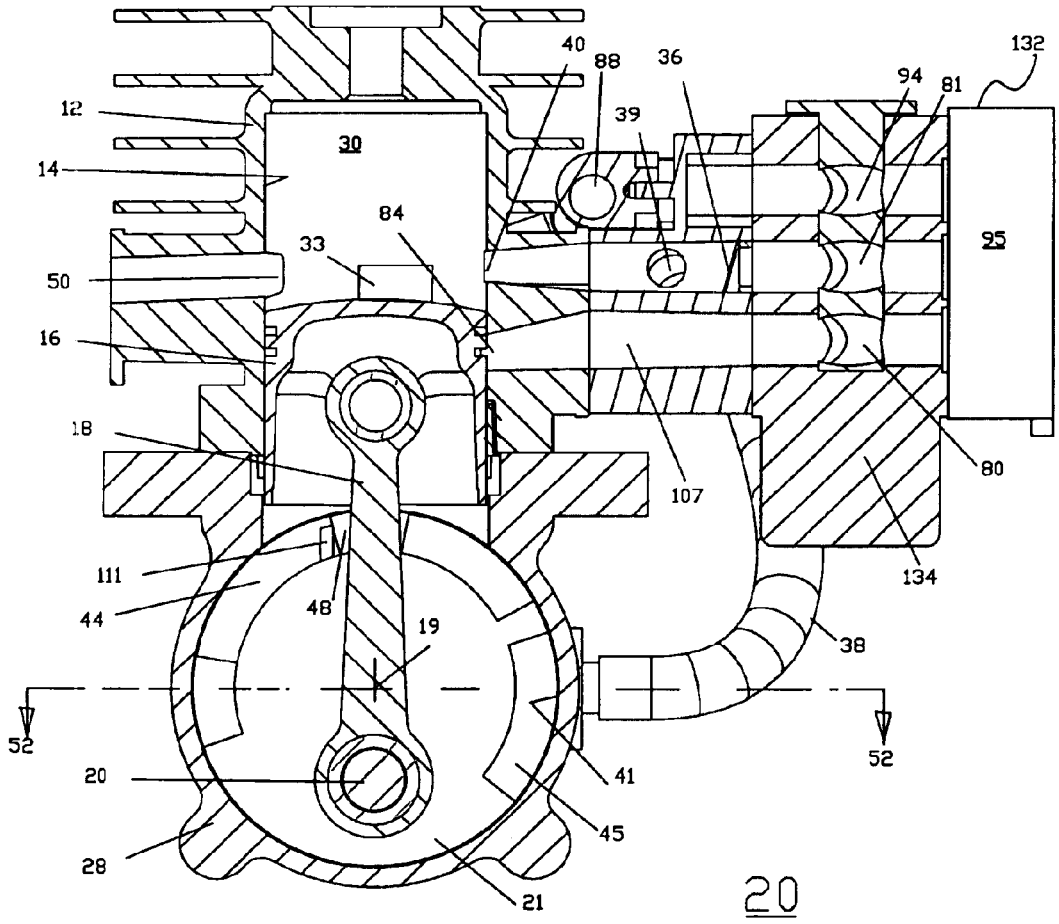
FIG. 51 is the vertical side view illustration of the engine through 51—51 in FIG. 50.

A main inlet port 84 in the cylinder block 12 through to the cylinder bore 14 allows a lean charge to flow directly into the crankcase chamber 26 below the charge injection port 40. The lean charge flow flows though and is controlled by a lean charge barrel regulating valve 79 in a second barrel 310 of the carburetor 34, as illustrated in FIG. 1 when the piston is ascending. A second flow passage 312 extends between the second barrel 310 and the main inlet port 84. A butterfly valve 80 may be used to regulate flow though the main inlet port 84 as illustrated in FIG. 4. The main inlet port 84 is closed during scavenging process by the piston or a reed valve 36 as the case may be. Note that reed valves are one-way valves. In FIGS. 1 and 51 the reed valve 36 is illustrated in the open position when charge port 40 is open as during the charge injection process. The reed valve 36 should be closed during injection process and it is shown open for clarity and illustrative purposes only.

The first and second slots 44 and 45 are cut through the crank web 21 though other types of disks attached to the crankshaft 22 may be used. The first and second slots 44 and 45 are cut-away sections of the crank web 21. The first and second slots 44 and 45 open and close fluid communication between the injection tube 38 and the crankcase chamber 26 as the crank web 21 rotates with the crankshaft 22, thus, providing the valving function of the rotary shut-off valve 48. Opening and closing each of the first and second slots 44 and 45 between the injection tube 38 and the crankcase chamber 26 induces a fuel/air mixture charge through one of the slots into the injection passage 39 on one cycle of the engine, or a first half rotation of the crank web 21. The fuel/air mixture is discharged through the injection tube 38 into the combustion chamber 30 during the next cycle of the engine 10.

Timing of the opening and closing of the slots 44 and 45 and, thus, the rotary shut-off valve 48 is asymmetric. By not having the second slot 45, the injection tube 38 will be closed by the crank web at the crankcase end of the injection tube 38. In that case, the injection of charge is achieved by the compressed air assisted injection principle as described in U.S. Pat. No. 6,273,037. However, the advantage with this embodiment is that the crank web offers unsymmetrical timing for start and end of charge induction into the injection tube 38.

Figure 5A:
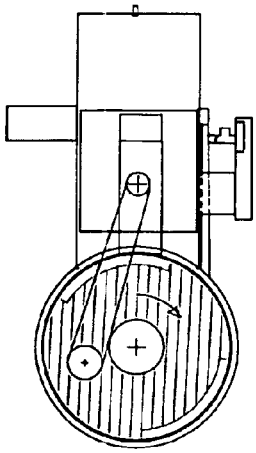
FIGS. 5A–5G are sectional view illustrations of a sequence of cycle events for the stratified scavenging system illustrated in FIG. 1.
Figure 5B:
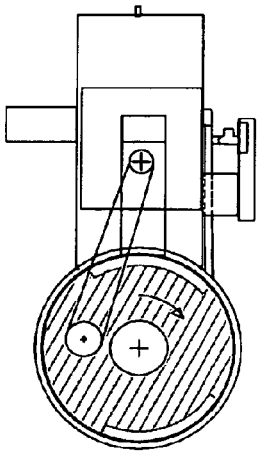
Figure 5C:
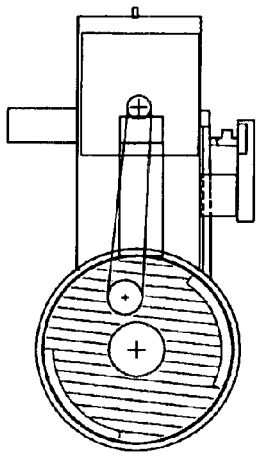
Figure 5D:
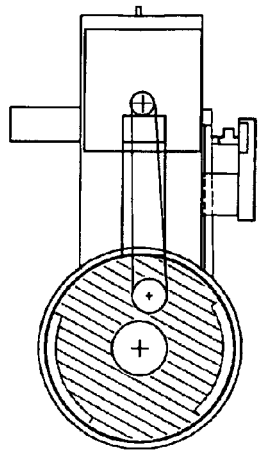

The engine's operation is illustrated in FIGS. 5A–5G. As the piston moves upward toward top dead center (TDC), illustrated in FIG. 5A, the transfer port 33, the charge injection port 40, and exhaust port 50 are closed by the piston 16. During the upward stroke, crankcase pressure in the crankcase chamber 26 drops below ambient pressure creating a pressure difference between ambient and crankcase chamber. Illustrated in FIG. 5B is continued rotation of the crank web 21 aligning one of the slots in the periphery of the crank web 21 with the crankcase port 41 allowing the fuel and air charge to flow into the injection tube 38 through the carburetor 34 and the one-way non-return valve 36 (illustrated as a reed valve) and a regulating fuel/air mixture valve 81. The charge continues to flow until the crank web closes the port as illustrated in FIGS. 5C and 5D. As the piston continues to ascend at about 40 to 50 degrees before the piston reaches top dead center, the main inlet port 84 is opened by the piston (illustrated in FIG. 5C.). The lean charge is then inducted into the crankcase chamber 26 through a regulating valve 79 leading to the main inlet port 84. The induction of lean charge through the main inlet port 84 may start slightly before the end of induction of rich charge into the injection tube 38, that is slightly before the crankcase port 41 is closed by the crank web 21.

Referring back to FIG. 4, a circumferentially extending slot length LS (an arc) of the slots in the crank web determines the crank angle duration and amount of charge that is inducted into the injection tube 38. A tube length LT of the injection tube 38 is set so that no charge will flow into the crankcase during wide open throttle conditions. Alternatively, the volume and timing may be determined such that only a fraction of the full charge, an amount sufficient to lubricate the crankcase, is allowed to enter the crankcase, in which case only air may enter the crankcase chamber through the through the main inlet port 84.

Figure 3:
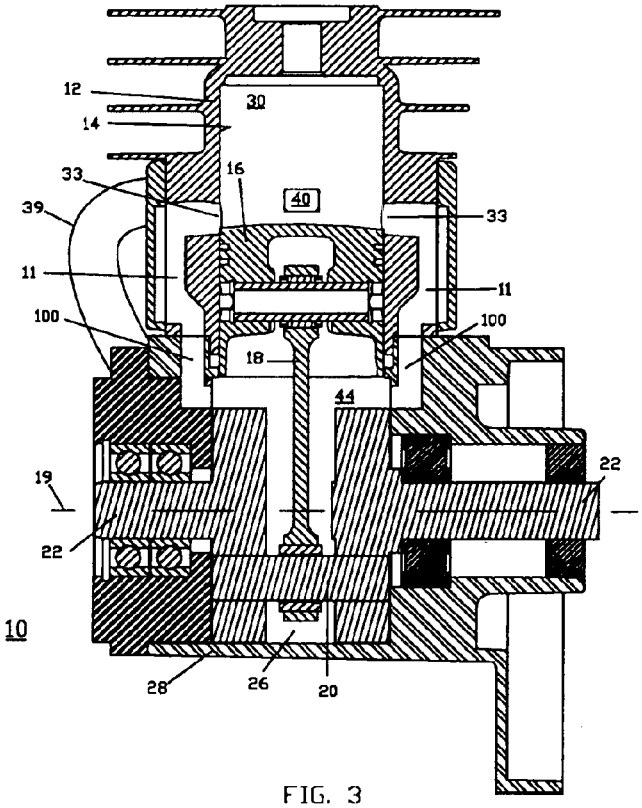
FIG. 3 is a longitudinal sectional view illustration of the engine through 3—3 in FIG. 1.
Figure 22:
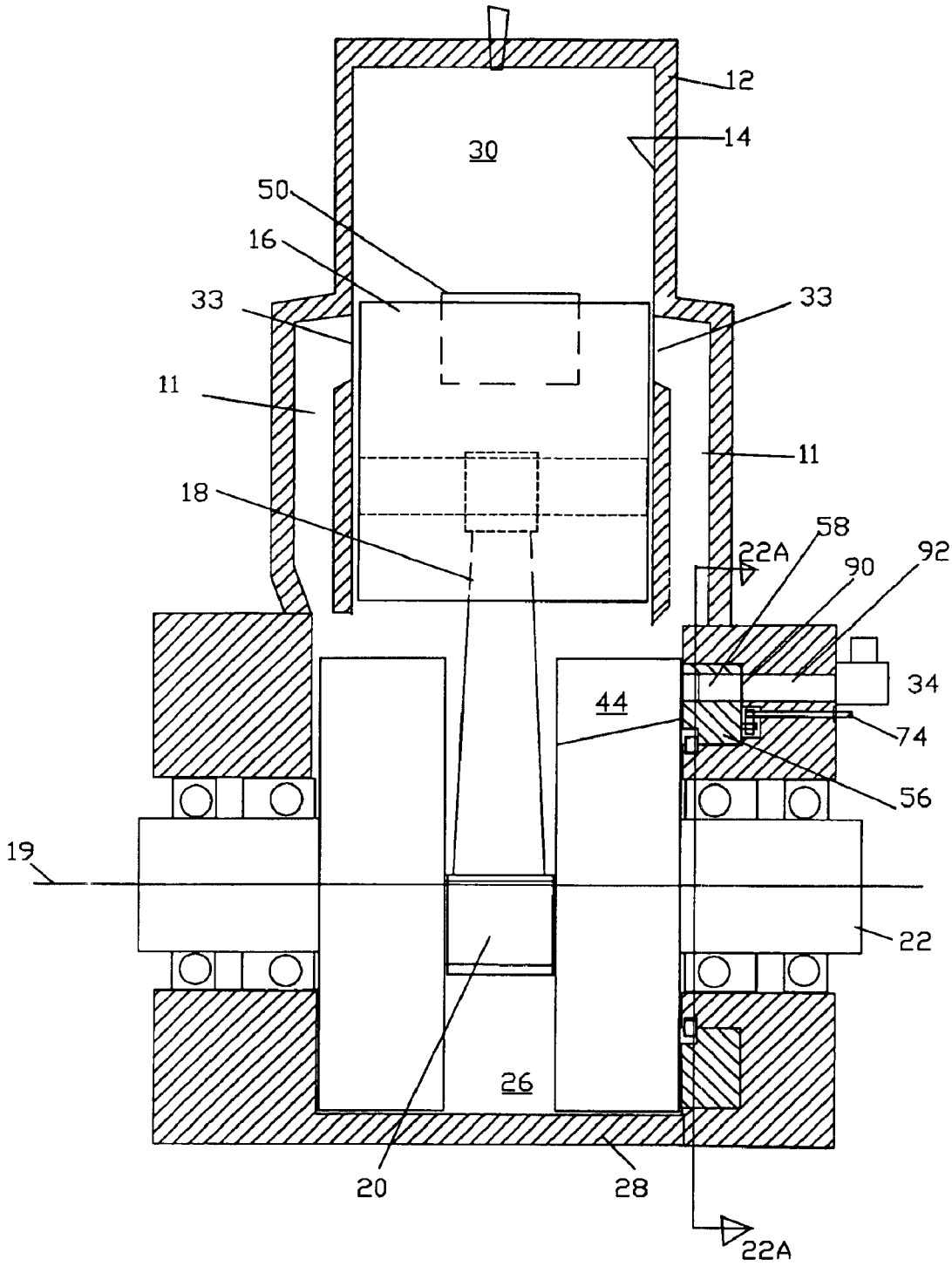
FIG. 22 is a vertical sectional view illustration of an exemplary embodiment of a two stroke engine having a variable intake timing system.
Figure 44:
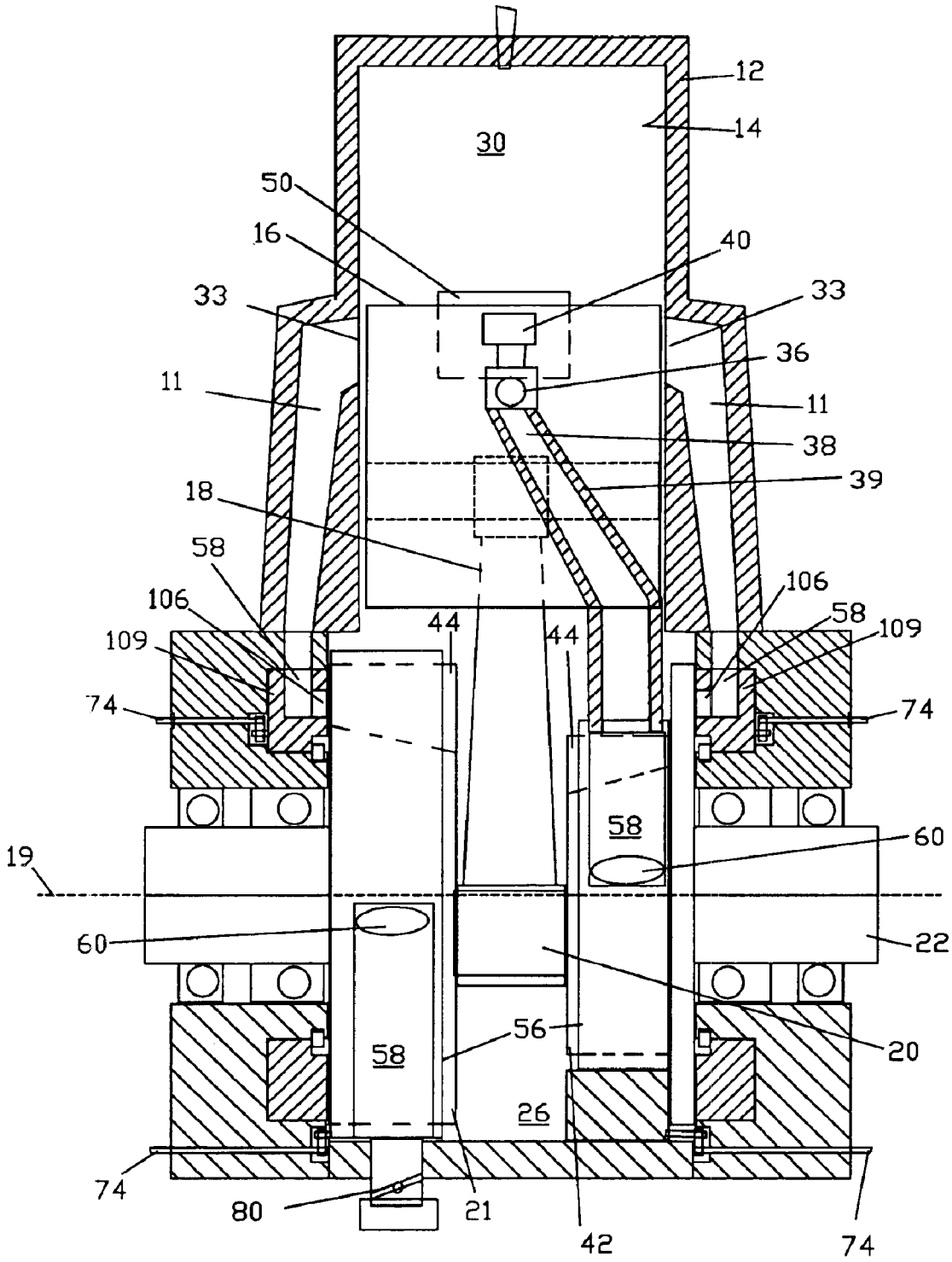
FIG. 44 is a vertical sectional view illustration of a two stroke engine with a multi-ring system for variable transfer passage volume and timing, stratified charge injection system with variable volume injection passage and timing, and variable inlet timing system, where the crank web is stepped.

After or during closing of the charge induction, the main intake system is carried out in a usual manner and is regulated by a butterfly valve 80 illustrated in FIG. 4 or a barrel valve 79 as illustrated in FIG. 1. The main intake system may be piston port controlled as illustrated in FIG. 1, reed valve controlled as illustrated in FIG. 4, or disk valve controlled as illustrated in FIGS. 22 and 44. The embodiment of the engine in FIG. 4 illustrates a reed valve type and FIGS. 1–3 illustrate a piston port type main air intake system as examples. In the case of reed valve type main inlet system, the start and end of induction of lean charge through the air control butterfly valve 80, one-way reed valve 82 and main inlet port 84 is dependent on the pressure difference across the reed valve 82 and the pressure required to open the reed valve 82. The air control butterfly valve 80 controls only air and the fuel/air mixture valve 81 controls fuel/air mixture.

Figure 5E:
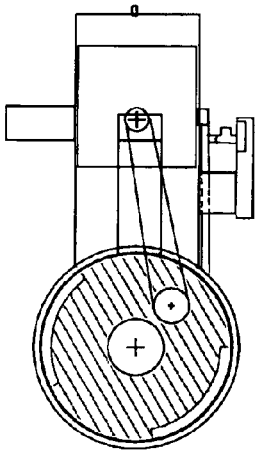
Figure 5F:
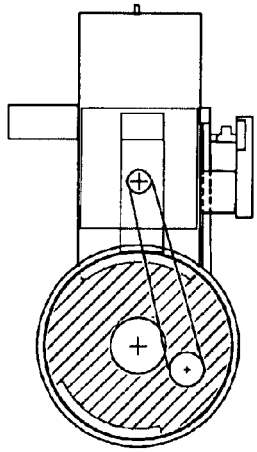
Figure 5G:
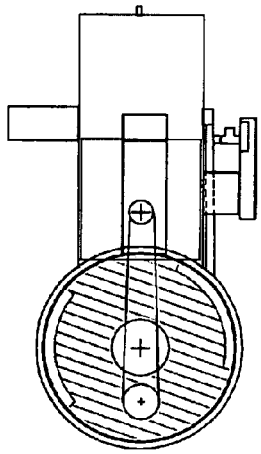
Figure 6:
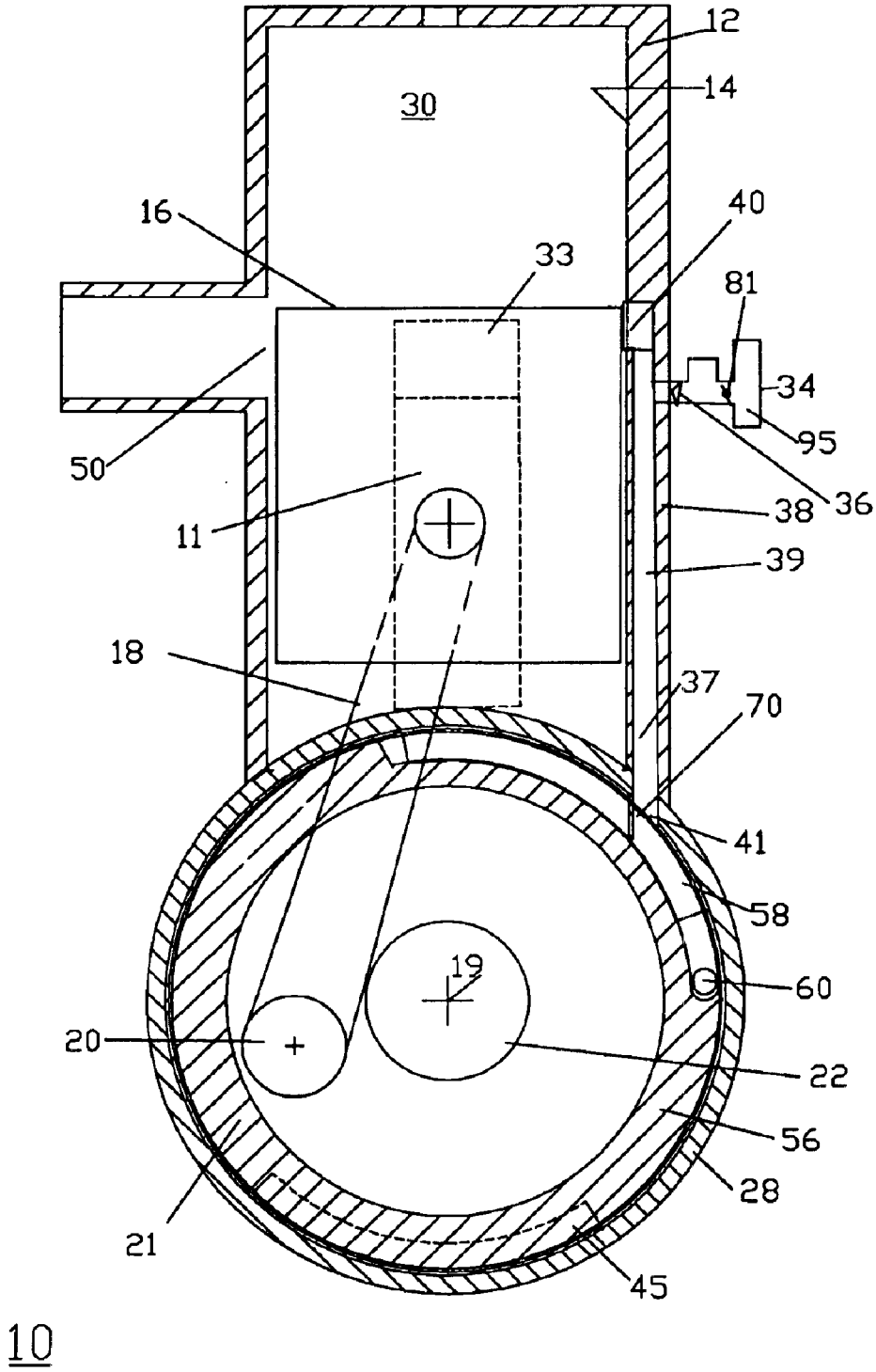
FIG. 6 is a first sectional view illustration of a disk controlled stratified scavenging system with variable volume injection and a variable timing ring system with timing ring adjacent to a disk.
Figure 7:
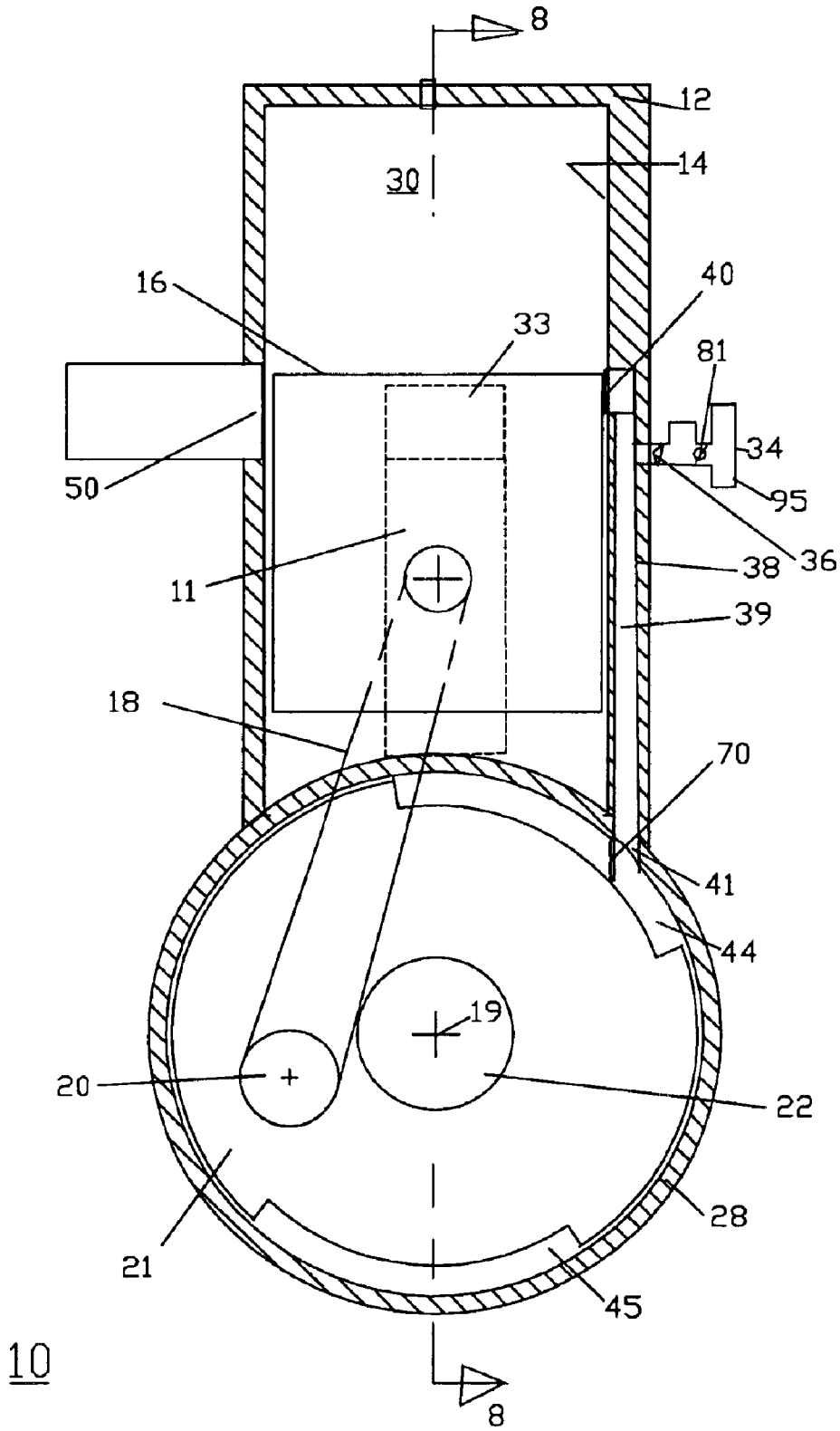
FIG. 7 is a second sectional view illustration of the stratified scavenging system illustrated in FIG. 6 with the disk more particularly illustrated.
Figure 8:
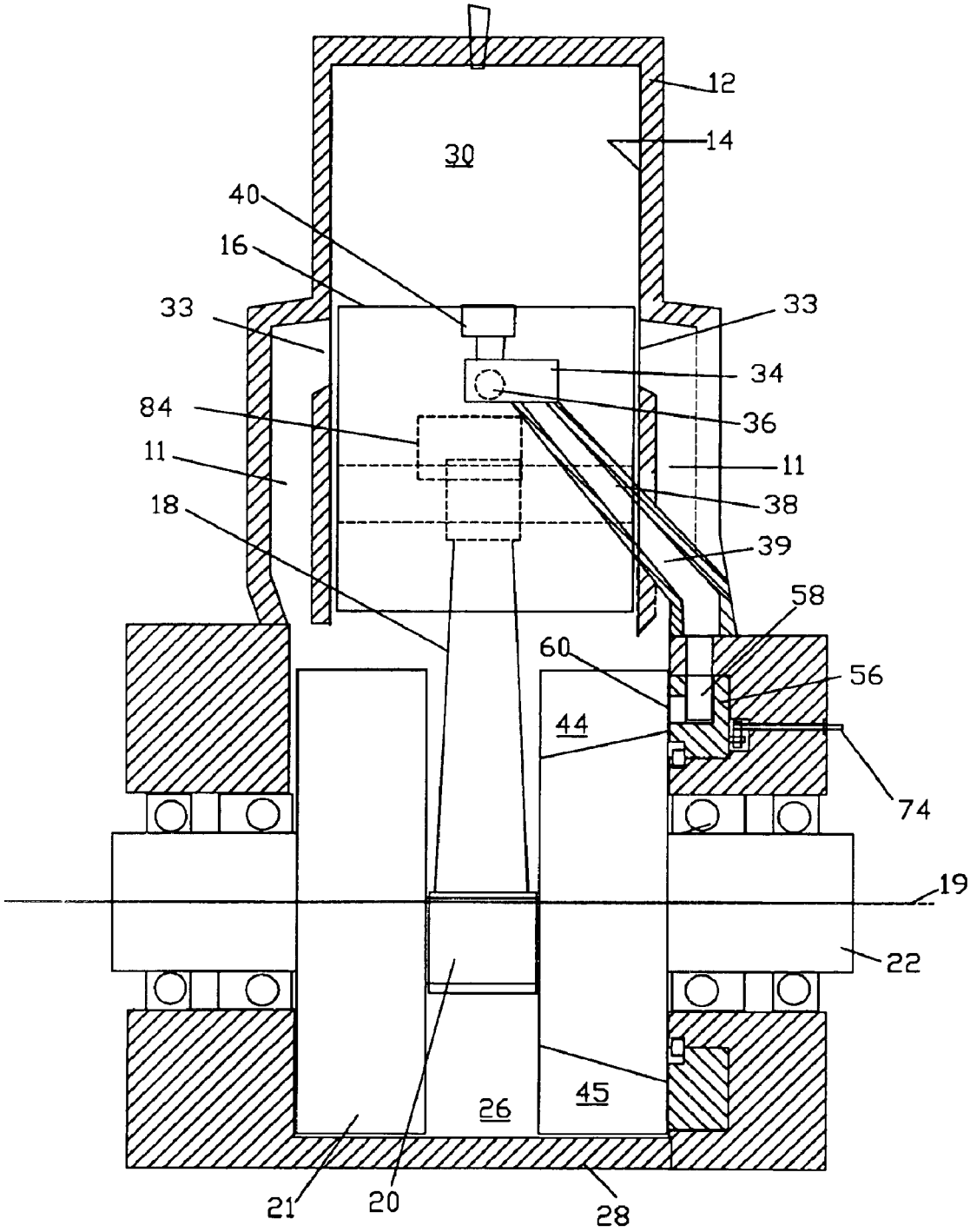
FIG. 8 is side view illustration of FIG. 7 with the ring adjacent to disk/crank web.
Figure 9:
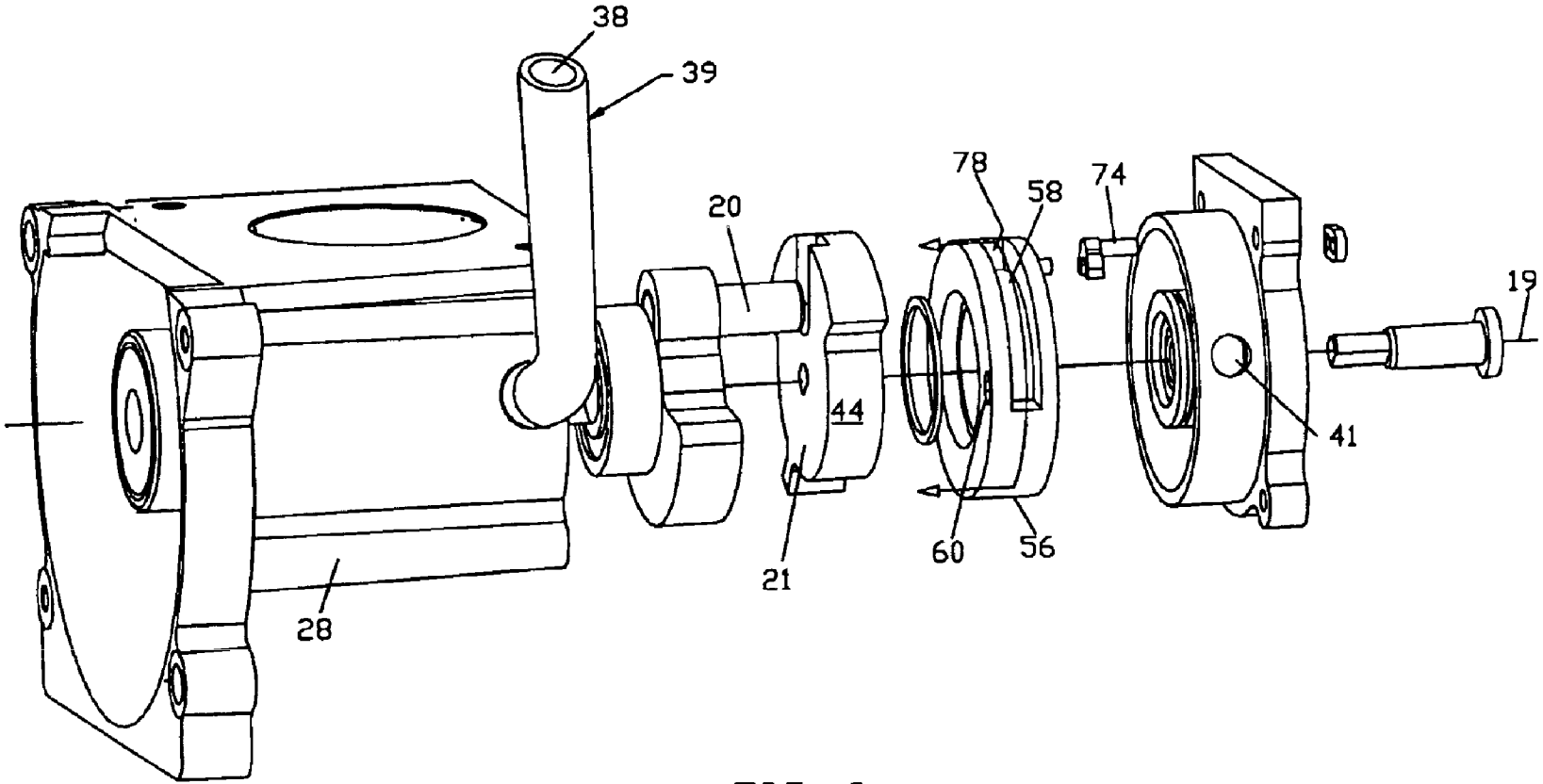
FIG. 9 is an exploded view illustration of the variable volume injection and timing ring system illustrated in FIG. 6.
Figure 10:
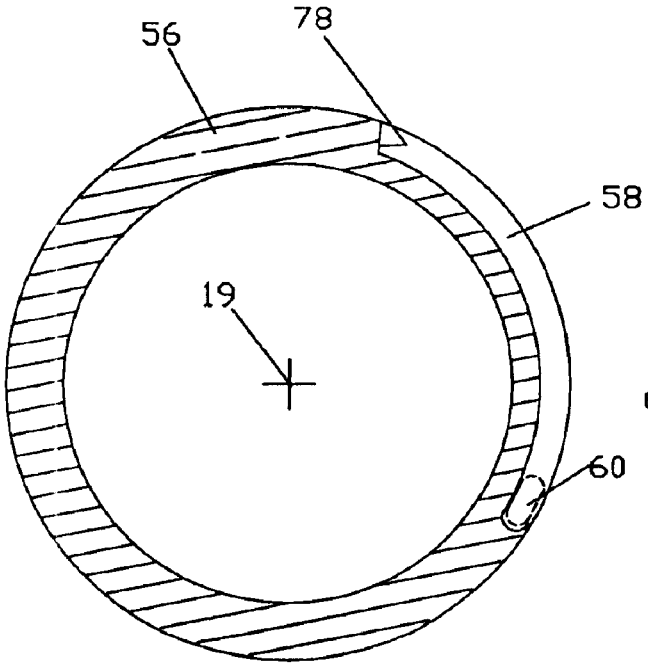
FIG. 10 is a cross-sectional view illustration of the ring with a channel on a periphery within the ring through 10—10 in FIG. 9.
Figure 11:
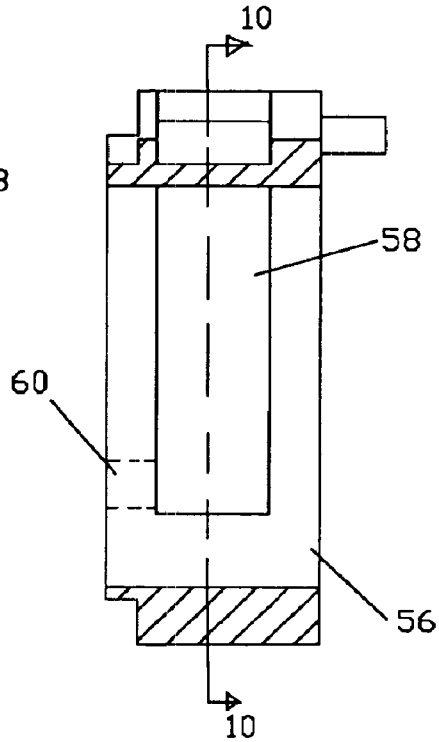
FIG. 11 is a side view illustration of the ring illustrated in FIG. 10.
Figure 12:
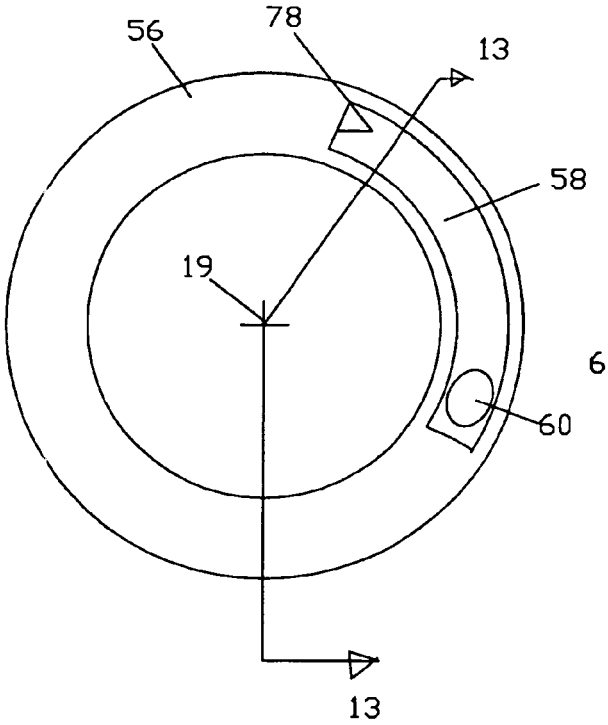
FIG. 12 is a side view illustration of an alternative ring with the channel on a side of the ring.
Figure 13:
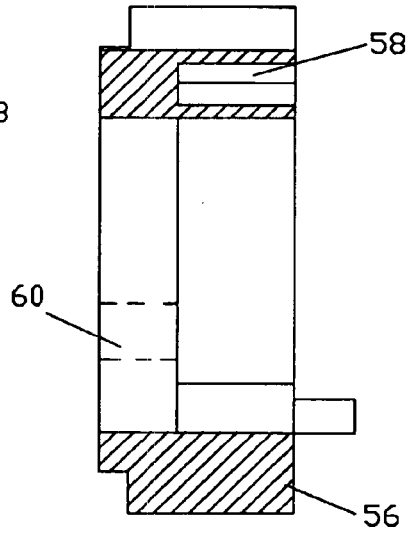
FIG. 13 is sectional view illustration of the alternative ring illustrated in FIG. 12.

Rotary intake type may also be used. As the piston moves downwardly during the expansion stroke, the crankcase pressure rises, during which time the crankcase port 41 is closed as illustrated in FIGS. 5D and 5E. The main inlet port 84 is closed by the piston when piston port is used or the reed valve when reed valve inlet system is used. If the rotary valve is used for main inlet then the crank web closes the main inlet port. Blow down and exhaust occurs as usual except that the medium that enters the cylinder first when transfer port 33 opens is either an air charge or a lean charge. The charge injection occurs later during the scavenging process. The charge injection time is controlled by the crank web. FIG. 5F illustrates the injection time beginning with the second slot 45 opening the crankcase chamber 26 to the injection passage 39 and FIG. 5G illustrates the injection time ending with the second slot 45 closing the crankcase chamber 26 to the injection passage 39.

A three-way scavenging system illustrated in FIGS. 50–54 operates in a similar way described above. However, as the piston ascends, the induction of rich charge into the injection tube 38 starts 5 to 25 degrees ABDC and ends 20 degrees BTDC to 10 degrees ATDC. There is a overlap of air induction into transfer passage 11 during the induction of rich charge into the injection passage 39. The induction of air into transfer passage 11 starts 10 to 20 degrees ABDC to 80 to 50 degrees BTDC. Induction of air into transfer passage 11 is for a smaller crank angle duration just enough to fill the transfer passage volume. The main inlet of lean charge into the crankcase chamber 26 occurs through the main inlet port 84 in a usual manner, where the main inlet port 84 is opened by the piston 60 to 40 degrees BTDC.

FIGS. 6 through 17 illustrate a variable volume charge induction and injection timing stratified scavenging system. The crank web 21 (or a disk on the crankshaft) times a fuel rich charge inducted through the carburetor 34. An angularly adjustable ring 56, concentric to and stationary with respect to the crankshaft 22, is adjacent to or housed within the crankcase 28 and is disposed between the crankcase chamber 26 and the injection passage 39. An annular channel 58 extending circumferentially partway through the ring 56 is disposed between the crankcase chamber 26 and the injection passage 39. The annular channel 58 is disposed between the periphery 43 of the circular disk or crank web 21 and the injection tube 38 and the injection passage 39.

Figure 14:
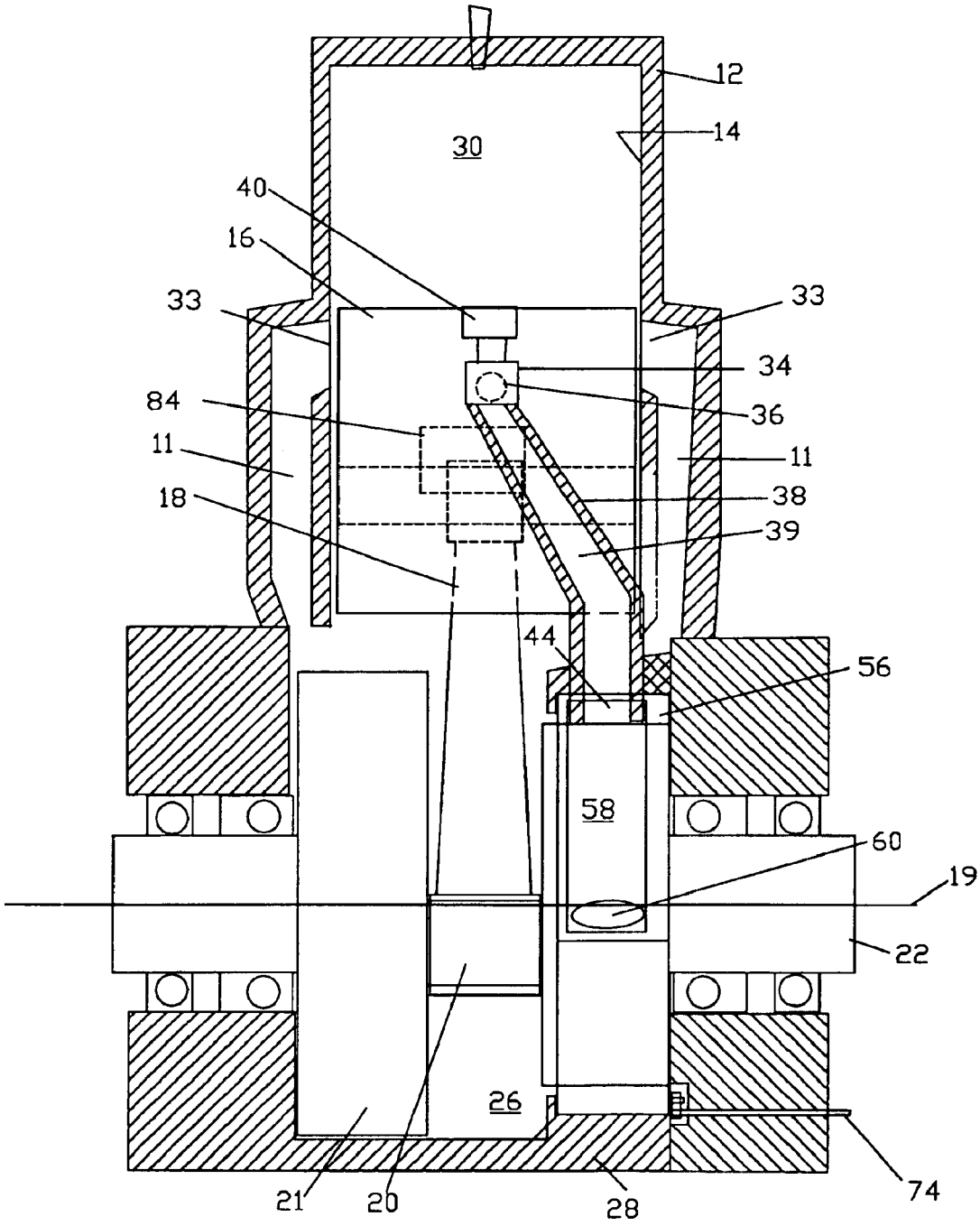
FIG. 14 is a vertical view illustration of a disk controlled stratified scavenging system with a ring on a periphery of the disk.

The annular channel 58 is in fluid communication with the injection passage 39 through a ring port 60 in the ring 56 leading to one end of the annular channel 58. The annular channel 58 is designed to hold a fraction of the total volume of charge or volume of the injection tube 38 and, thus, operates as an extension of the injection passage 39 leading from the charge injection port 40 to the crankcase port 41 in the crankcase 28. A segment of a ring may be used instead of a full ring. The ring is a stationary angularly adjustable component, meaning that it does not rotate with the crankshaft but can be angularly adjusted or rotated in order that it can be phase shifted with respect to the crankshaft. The ring can be in a fixed position to provide a fixed volume and fixed asymmetric timing. The ring can be adjacent to the crank web outside the crankcase as illustrated in FIGS. 8–13 or enclosed in the crankcase as illustrated in FIGS. 14–16.

Referring to FIGS. 6–17, the ring port 60 is opened and closed by the slots 44 and 45 in the crank web 21 and are alignable with a crankcase port 41 open to the injection passage 39 in the injection tube 38. A lower end 37 of the injection passage 39 opens in to the channel 58 in the ring 56. An upper end 35 of the injection passage 39 terminates at the charge injection port 40 into the cylinder.

Figure 15:
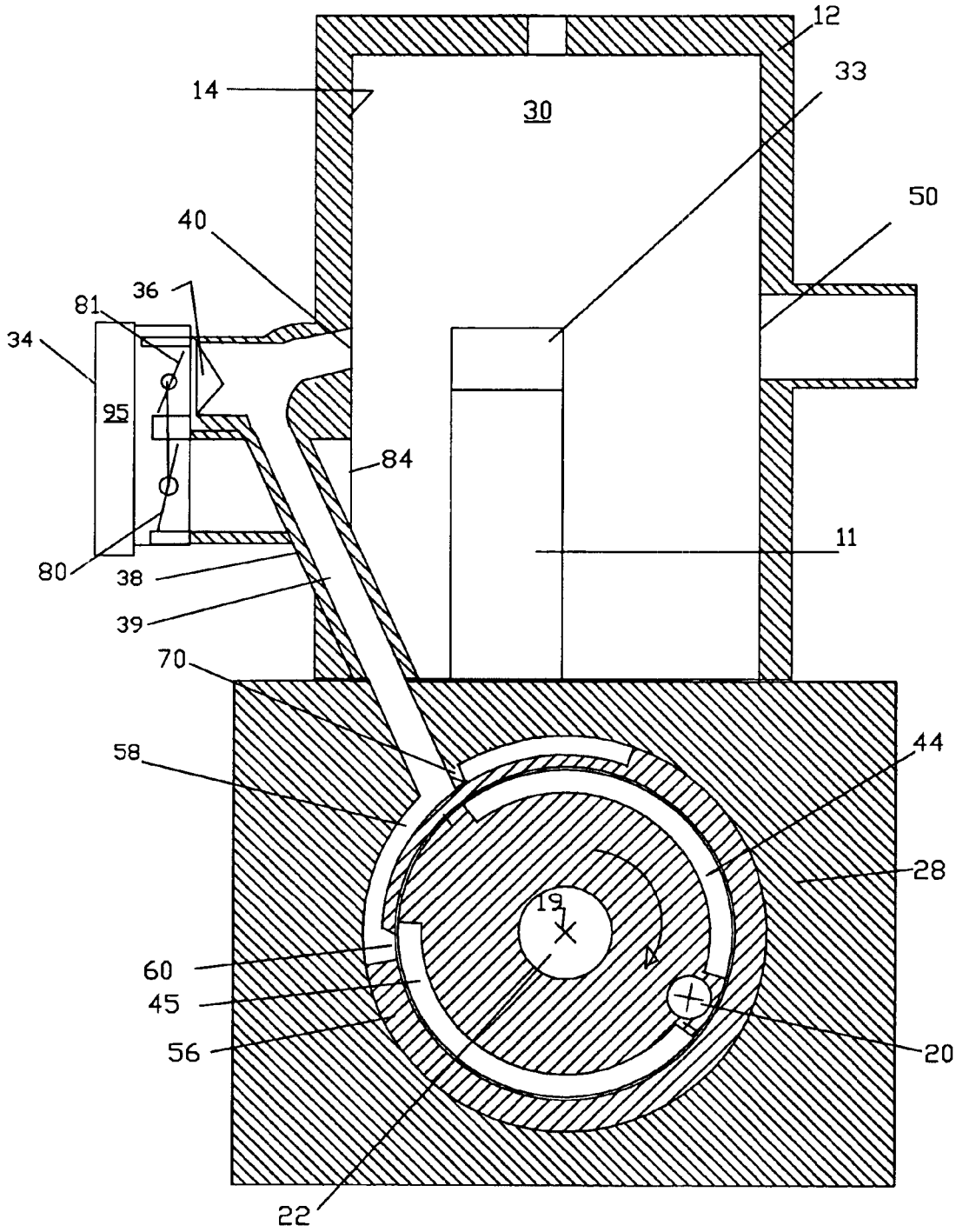
FIG. 15 is a side view illustration of the disk controlled stratified scavenging system illustrated in FIG. 14.
Figure 16:
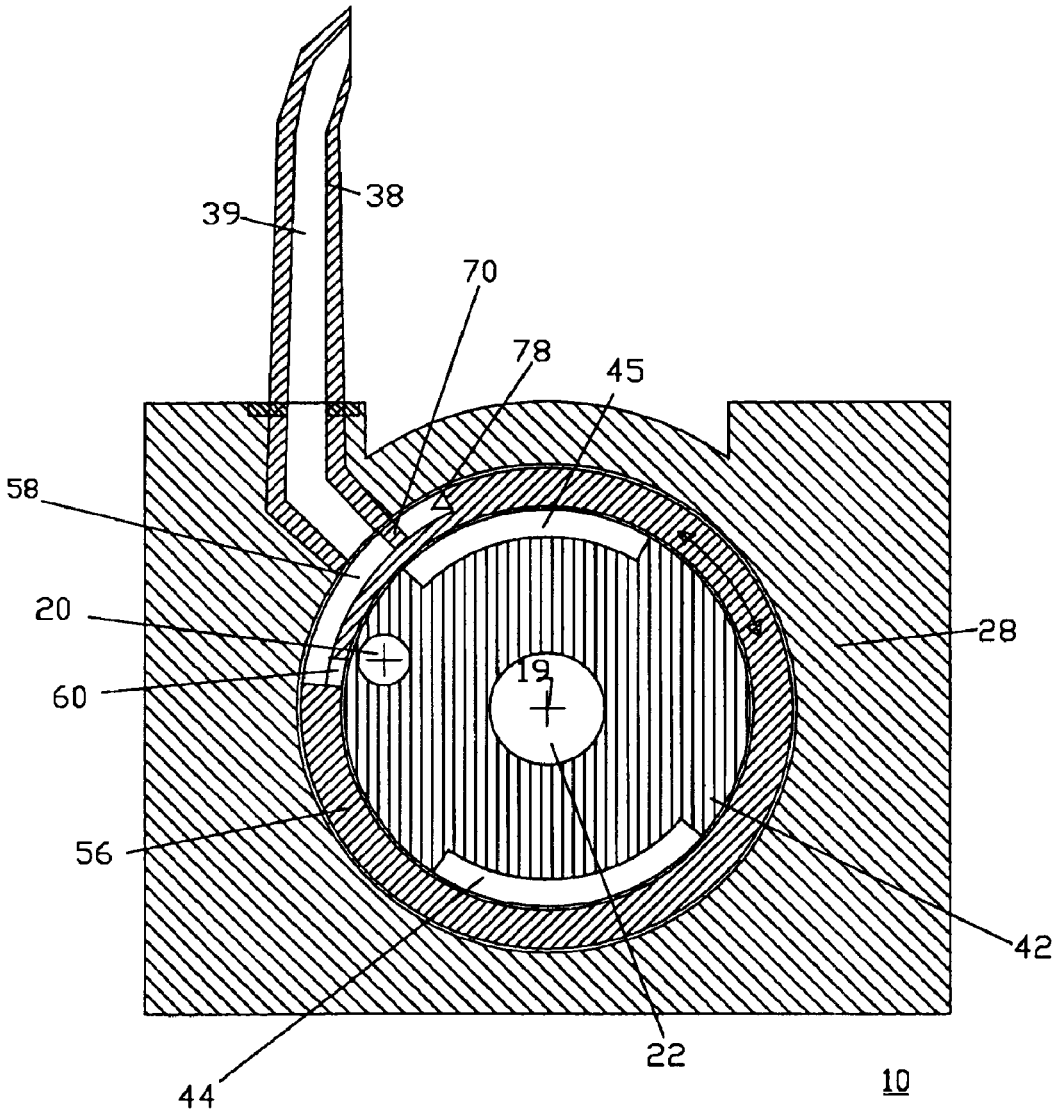
FIG. 16 is a side view illustration of an injection passage having a lip in the disk controlled stratified scavenging system illustrated in FIG. 14.
Figure 18:
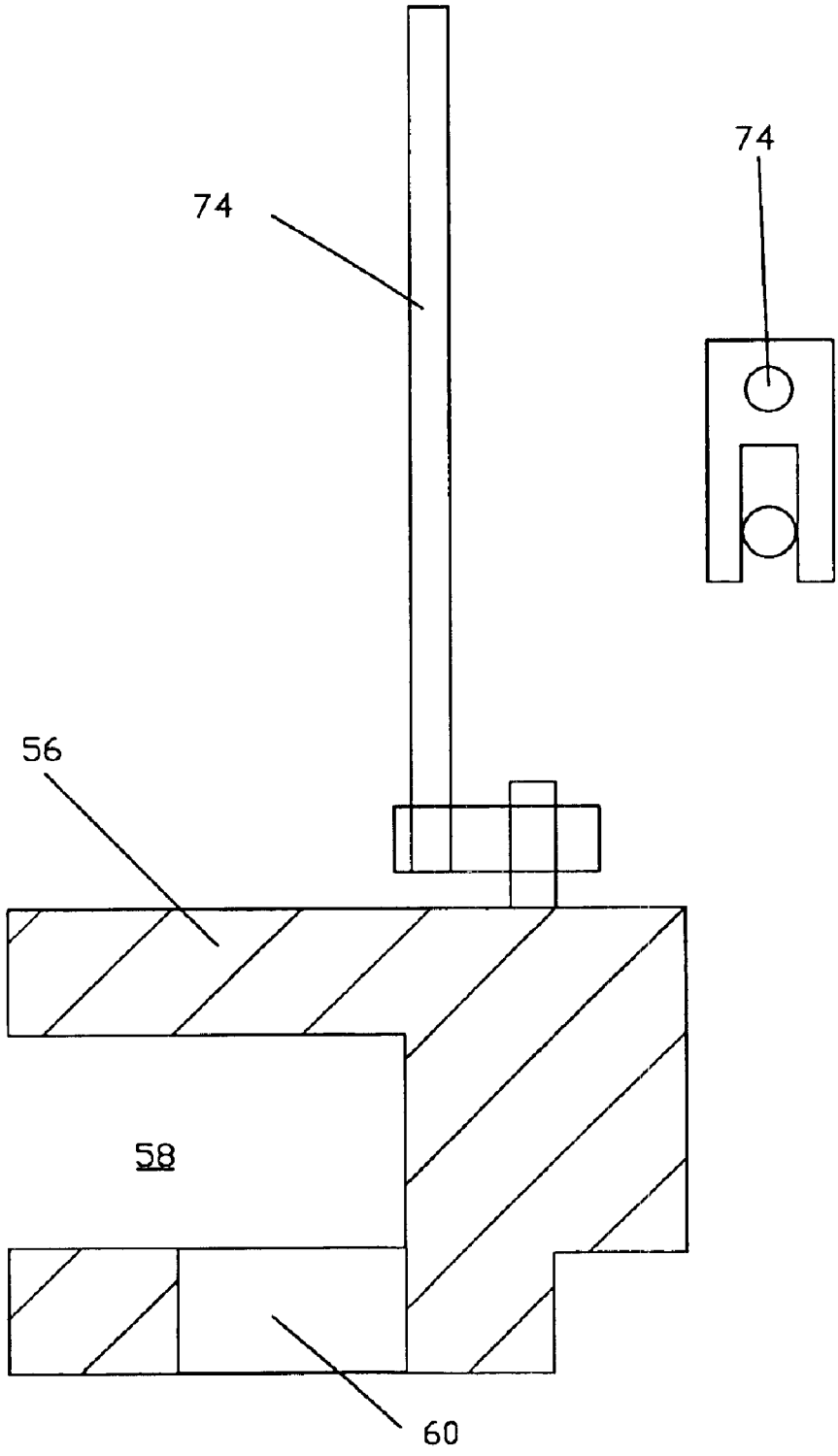
FIG. 18 is a sectional view illustration of a control lever for the ring illustrated in FIGS. 17 and 18.

FIGS. 15 and 16 illustrate a controllable variable volume channel 58 with a fixed lip 70 extending into the channel 58 at the lower end 37 of the injection passage 39. The volume of channel 58 can be varied by rotating the ring 56 and the channel 58. The volume of the channel between the lip and a closed end 78 of the channel 58 is a dead volume, which is passive. Therefore, the total volume for the charge includes the injection passage 39 and the effective volume of the channel 58 not including the dead volume between lip 70 and the closed end 78 of the channel 58. The ring 56 is rotated by means of a timing lever 74 attached to the ring illustrated in FIG. 18 or some other actuation apparatus such as gears or a cable. A pinion gear actuation apparatus is another option.

In operation, as the piston 16 moves upward, the first injection port 40 is closed by the piston (which also closes exhaust and transfer ports 50 and 33), and the pressure in the crankcase 28 drops. At an appropriate time, the ring port 60 is opened by the crank web 21 by aligning one of the slots 44 with the ring port, thus, allowing the fuel/air charge to flow into the injection passage 39 through the carburetor 34. The charge continues to fill the injection passage 39 and the channel 58 in the ring until the crank web 21 closes the ring port 60. The timing of the opening of the ring port and the total volume of the injection passage 39 are fixed for a given angular position of the ring 56. The main intake occurs in a usual manner through an air lean charge regulating butterfly valve 80 into the crankcase. A reed valve 82 type inlet with the regulating butterfly valve 80 is illustrated in FIG. 4. Alternatively, the main air/lean charge intake may occur in a usual manner through an air/lean charge butterfly type regulating valve 80 into the crankcase through a piston controlled main inlet port 84 of a piston port type inlet engine as illustrated in FIGS. 1, 2, 8, 14, and 15. The main inlet port serves as the charge inlet port.

As the piston 16 moves down during the expansion process, the crankcase pressure rises compressing the crankcase charge. Depending on the ring port 60 timing, the charge may or may not be subject to this crankcase compression. The piston 16 opens the exhaust port 50 causing blow down. The transfer ports 33 are open after a few crank degrees later, leading to scavenging process. The ring port 60 is later opened by the crank web 21 injecting the rich charge into the combustion chamber 30 through charge injection port 40. Thus, with the appropriate angle of one of the slots on the crank web 21, the start of injection can be optimized and continuously be varied by rotating the ring 56.

Figure 17:
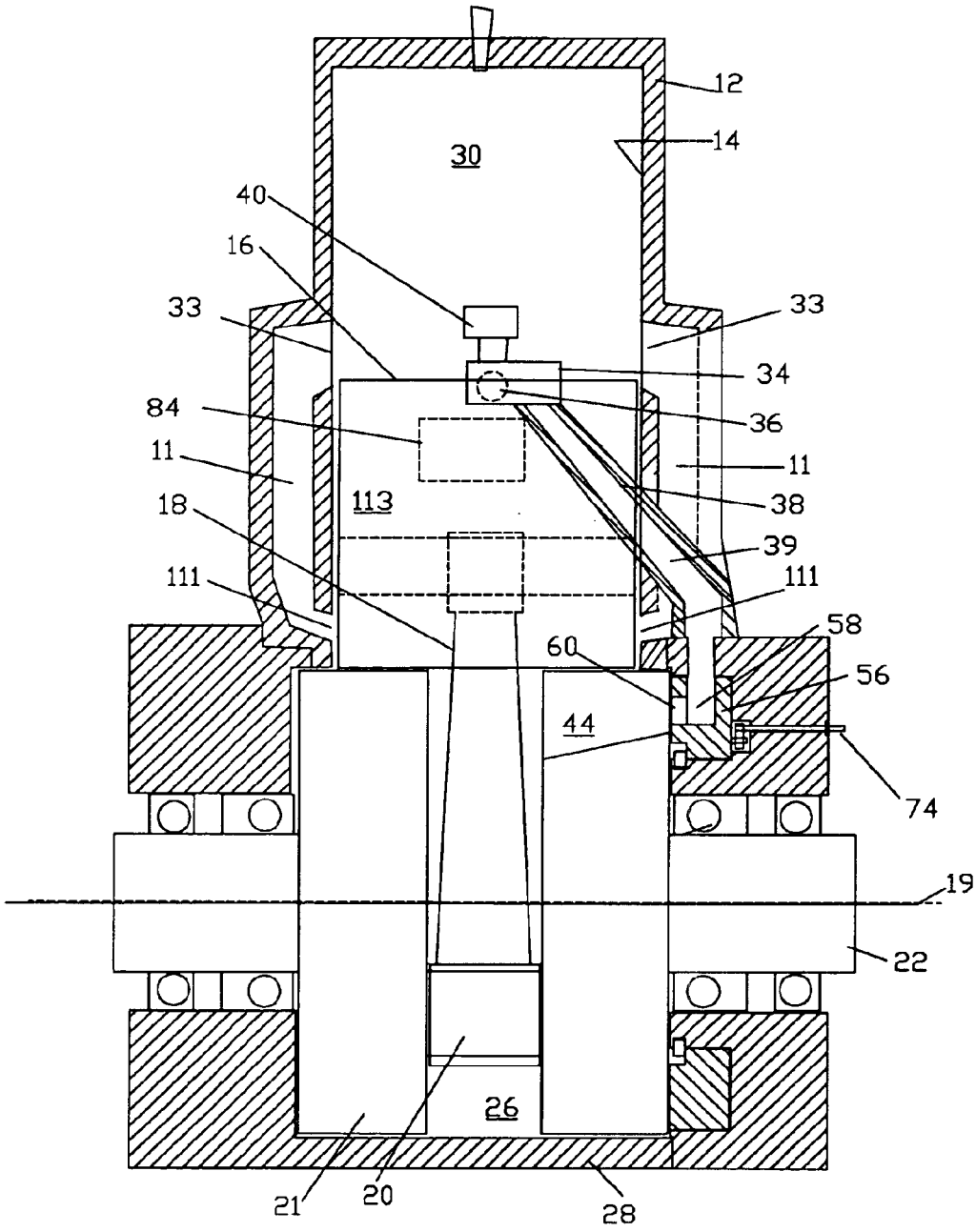
FIG. 17 is vertical view illustration of a piston controlled transfer port at the lower end of a transfer passage in the disk controlled stratified scavenging system illustrated in FIG. 14.

Referring to in FIG. 17, the transfer ports 33 are located below the combustion chamber and extend through the cylinder block 12 to the cylinder bore 14. Cylinder ports 111 are located below transfer ports 33 and extend through the cylinder block to the cylinder bore. The transfer passage 11 connect in gaseous communication the transfer and cylinder ports 33 and 111 respectively. For an effective injection, the cylinder ports 111 at lower ends 100 of the transfer passages 11 may be cut-off from the crankshaft chamber 26 forcing the crankcase gases to flow through the injection passage 39. The cylinder ports 111 extend through the cylinder block 12 to the cylinder bore 14. The cylinder ports 111 at the lower ends 100 of transfer passages 11 or elsewhere along the transfer passages are closed off from the crankcase chamber by the piston 16. More particularly the cylinder ports 111 at the lower ends 100 of transfer passages 11 are closed off from the crankcase chamber by a piston skirt 113 of the piston 16. One particular timing setting for closing off the transfer passage 11 from the crankcase chamber is at about 20 degrees BDC. Thus opening and closing of the injection passage 39 (or passages) to the crankcase chamber is controlled by the crank web 21 and the opening and closing of the transfer passages 11 to the crankcase chamber is controlled by the piston.

Figure 17A:
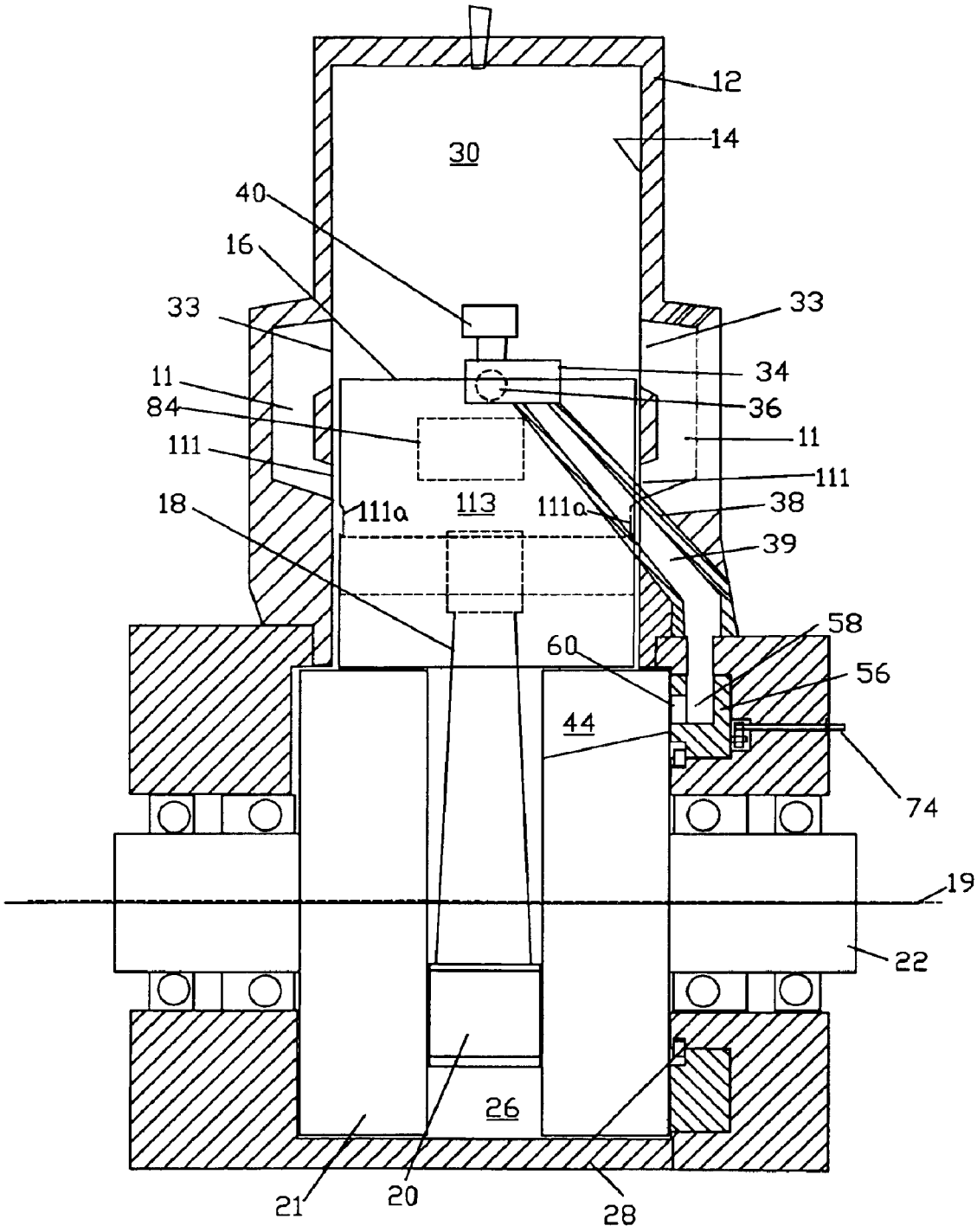
FIG. 17A is vertical view illustration of a piston having a piston skirt window for the controlled transfer port illustrated in FIG. 17.
Figure 48:
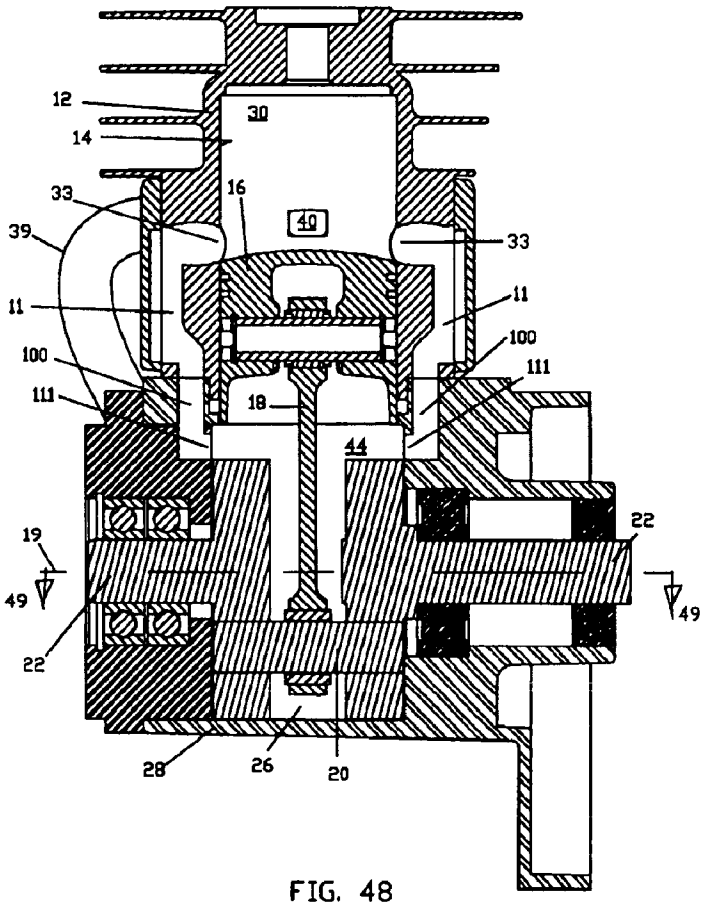
FIG. 48 is a sectional view illustration of the stratified scavenging engine through a crankshaft axis in FIG. 47.
Figure 47:
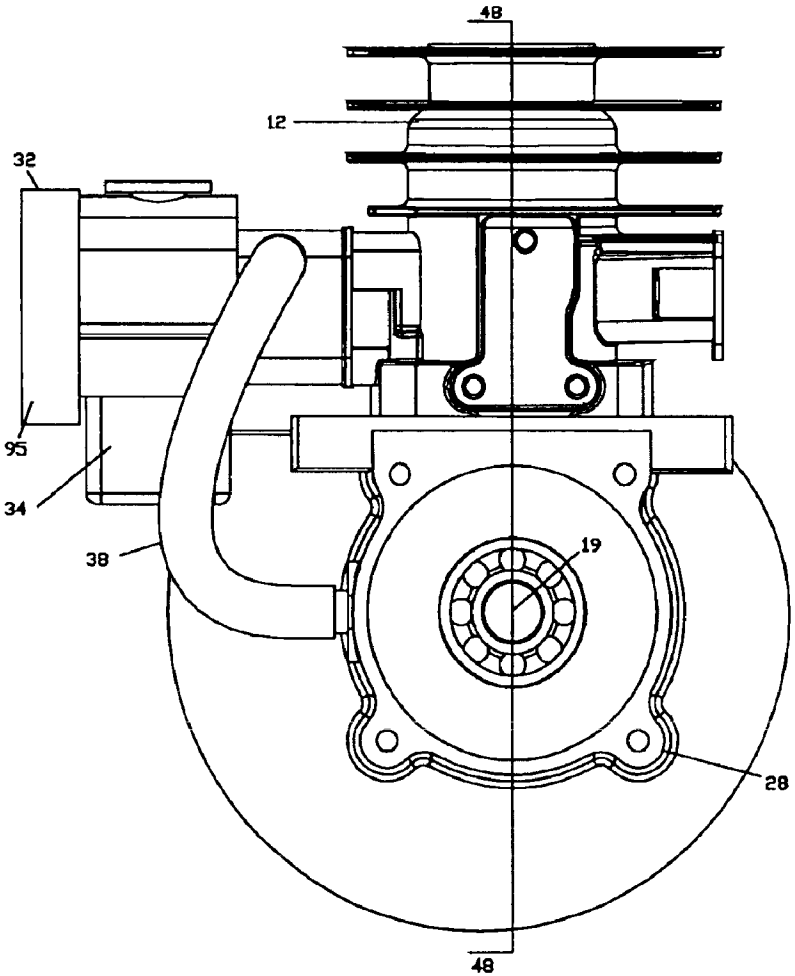
FIG. 47 is the side view illustration of an exemplary embodiment of a two stroke engine with a stratified scavenging system controlled by a rotatable disk and having a fixed timing for charge injection tube and transfer passage crankcase port timing.
Figure 49:
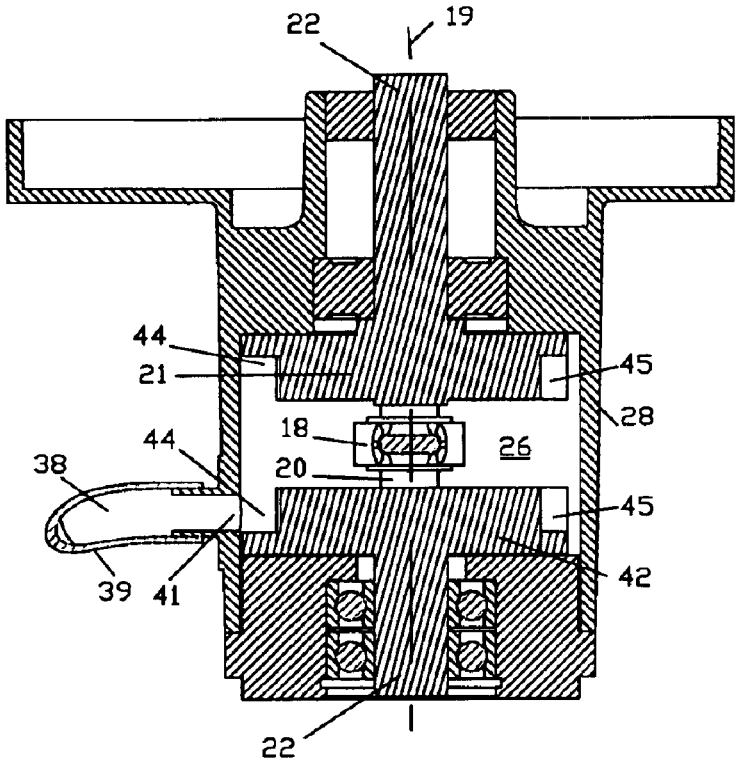
FIG. 49 is a top looking down cross-sectional view illustration of the stratified scavenging engine through 49—49 in FIG. 48.
Figure 49A:
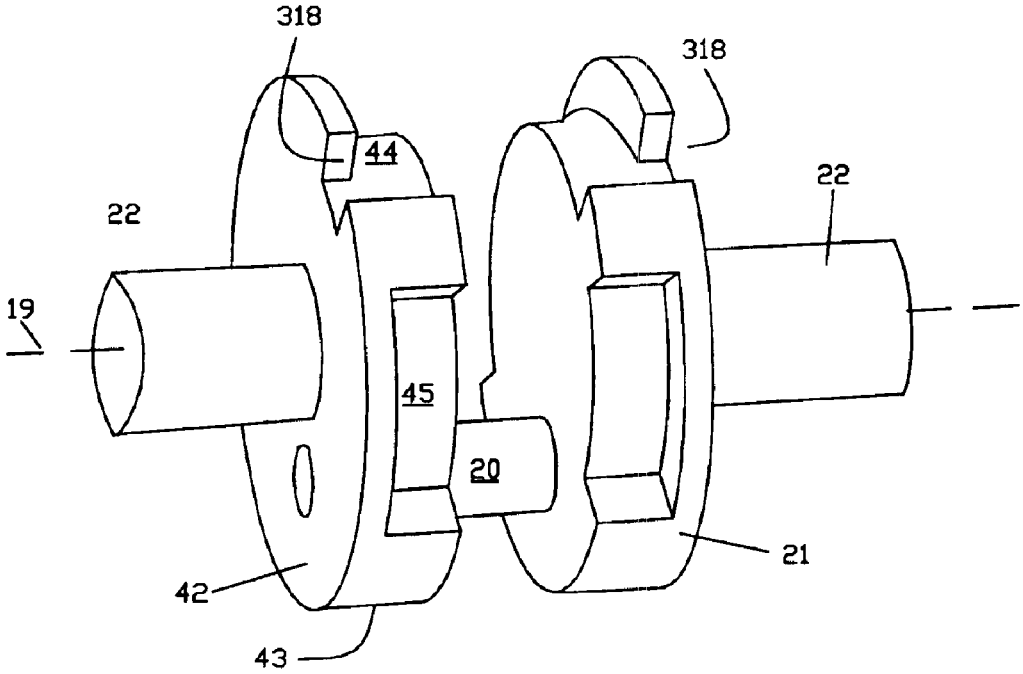
FIG. 49A is a perspective view illustration of a crank web with rotary shut-off valves in the engine illustrated in FIG. 48.
Figure 50:
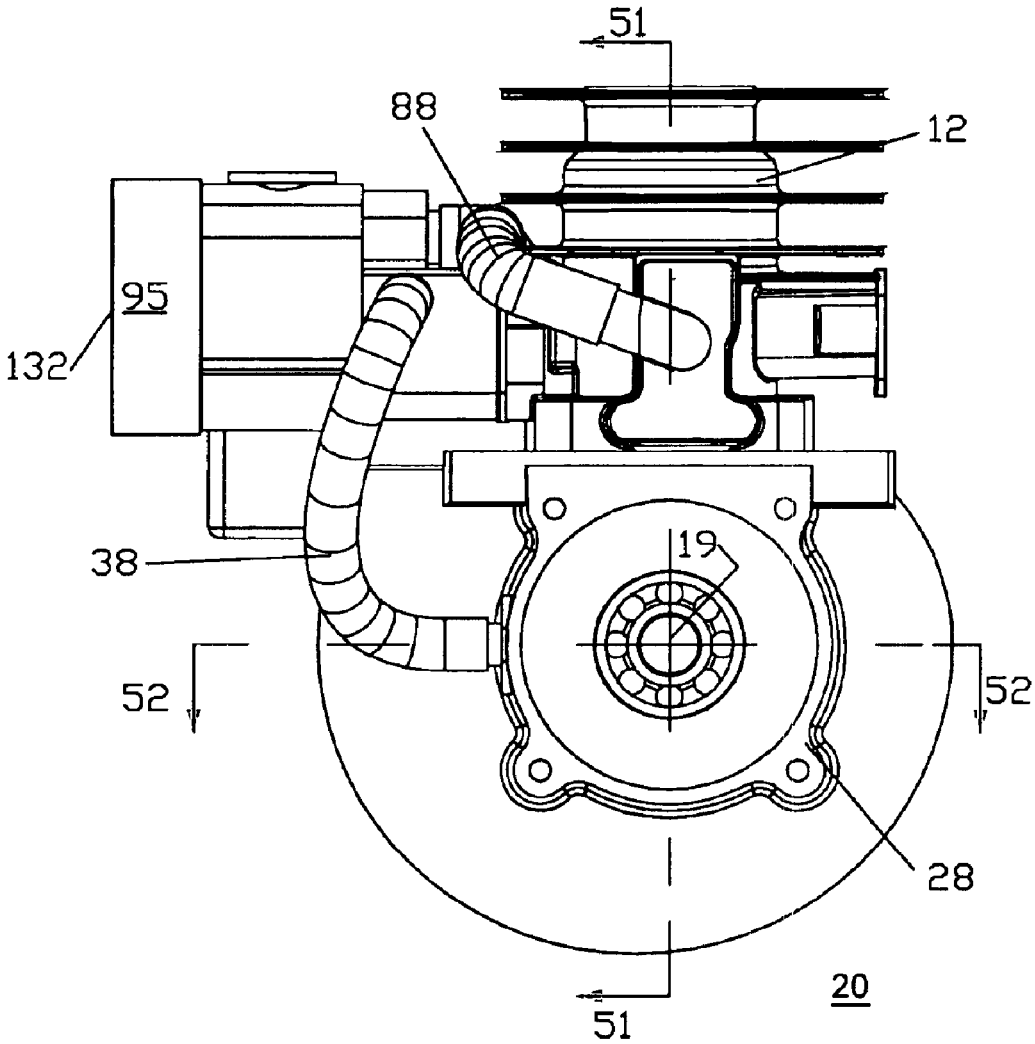
FIG. 50 is the side view illustration of a two stroke engine with a three-way scavenging system.

FIG. 17A illustrates windows 111*a* that may be incorporated into the piston skirt 113 as an alternative for closing the cylinder ports 111 with a lower edge of piston skirt. The windows 111*a* are translatably alignable with the cylinder ports 111. The windows 111*a* allow the cylinder ports 111 to be closed during compression when the piston is ascending, which lowers the effective crankcase chamber volume by cutting off the transfer passage volume. The windows 111*a* are translatably alignable with the cylinder ports 111. This should be timed to occur early during the scavenging process, between about 100 degrees ATDC and 170 degrees ATDC. The piston skirt shuts off the cylinder ports late during the scavenging process as the piston approaches BDC position, about 30 degrees BBDC to 5 degrees BBDC. The cylinder ports 111 (may also be viewed as crankcase ports) at the lower end 100 of transfer passages 11 may alternatively be closed off from the crankcase chamber by the crank web 21 as illustrated in FIG. 48 which has fixed timing and engine casing port timing illustrated in FIGS. 44–46 that have variable timing ring systems.

It is also possible with the crank web timing system to have a delayed charge injection, where the injection of charge may be started when the piston begins to move upward after BDC. This is accomplished by closing the scavenging and injection a few degrees before the piston reached BDC during the expansion cycle. Thus, a crankcase pressure may be built for later utilization for injection through the charge injection port 40. Thus, only air/lean mixture is injected into the combustion chamber 30 during early part of the scavenging process. The rich charge injected later is most likely to be trapped. Therefore, it is the air/lean charge that gets short-circuited and this lowers the HC emission and improves trapping of fuel.

By rotating the timing ring 56, the timing of the ring port 60 can be advanced or retarded. The ring port timing affects the charge induction and injection timing which also affects the charge volume. For example, at higher speeds the timing can be advanced while the charge volume is increased. The volume can be made to decrease which depends on the angular location of the ring port 60 with respect to direction of crankshaft rotation.

Figure 19:
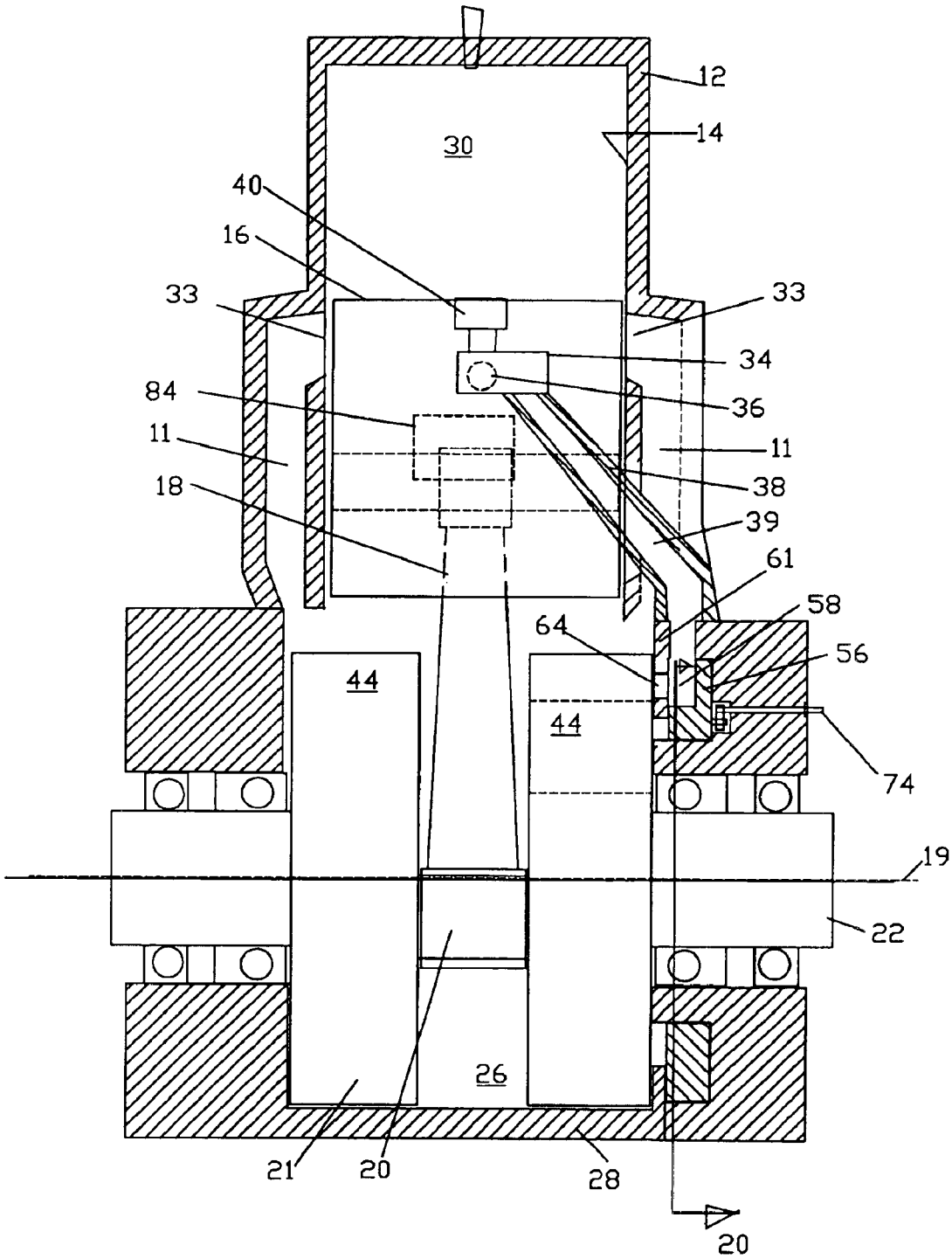
FIG. 19 is vertical side view illustration of a fixed timing variable length injection tube system for compressed wave injection system.
Figure 20:
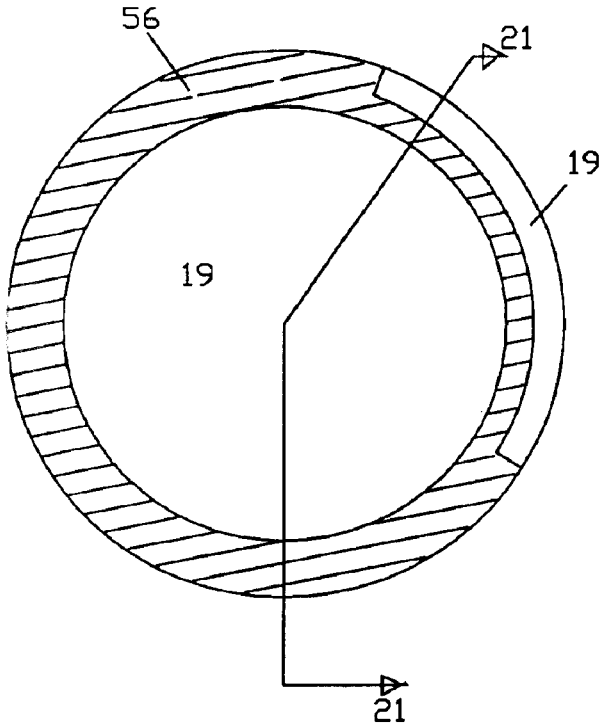
FIG. 20 is a sectional view illustration of the ring through 20—20 in FIG. 19.
Figure 21:
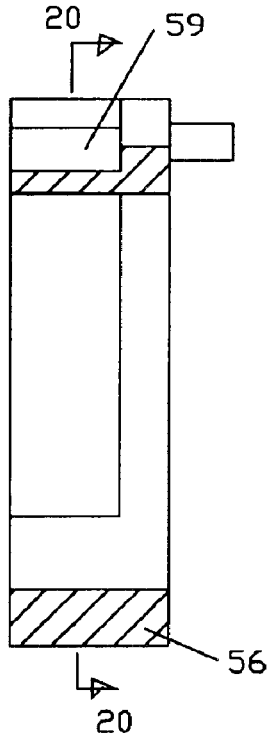
FIG. 21 is a sectional view illustration of the ring illustrated in FIG. 20.

FIGS. 19–21 illustrates a variable length compressed air assisted injection tube engine which is designed for varying the length of the injection passage 39 without varying the timing for a compressed air assisted injection system (CWI). A compressed air assisted injection system engine is disclosed in U.S. Pat. No. 6,273,037. The engine disclosed in U.S. Pat. No. 6,273,037 uses the piston to control the charge induction and, thus, the opening and closing time of induction is symmetrical about the TDC. Also, the charge depends on the wave dynamics for injection. This may lead to an optimum performance only at a certain operating range of speed and load. In a CWI, the injection of charge is accomplished by the reflection of a pressure wave and, thus, the length of the tube is important for optimum performance.

A CWI with a fixed length tube may have optimum performance in narrow ranges of speed and loads. The variable length compressed wave injection tube engine illustrated in FIG. 19 incorporates the rotatable ring 56 illustrated in FIGS. 20 and 21. The channel 58 is formed by an annular notch 59 in the periphery of the ring 56 and the crankcase housing 61. A crankcase housing port 64 replaces the ring port 60 in the ring and, thus, has a fixed timing. Both ends of the channel 58 are closed. By rotating the ring, the effective tube length LT of the injection tube 38 is varied without altering the induction timing. This embodiment of the engine allows the fixed timing to be unsymmetrical and controlled by the crank web. Thus, the effective length can be varied to optimize the performance and can be tuned to acoustic characteristics at different speeds. By rotating the ring, the effective length of the injection tube 38 is varied, while beginning and end of charge induction into the tube is fixed. Thus, the acoustic characteristics of CWI may be optimized at every operating condition of the engine, from idle to wide open throttle condition by varying the rotational position of the ring.

Figure 22A:
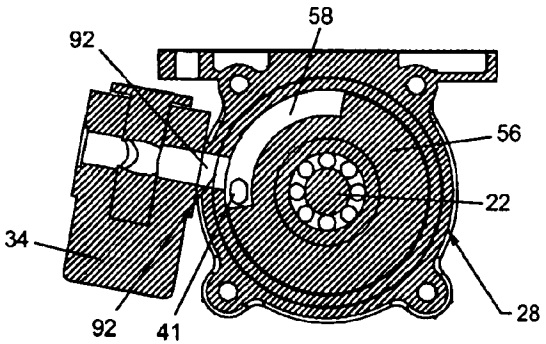
FIG. 22A is a sectional view illustration through 22A—22A in FIG. 22.
Figure 22B:
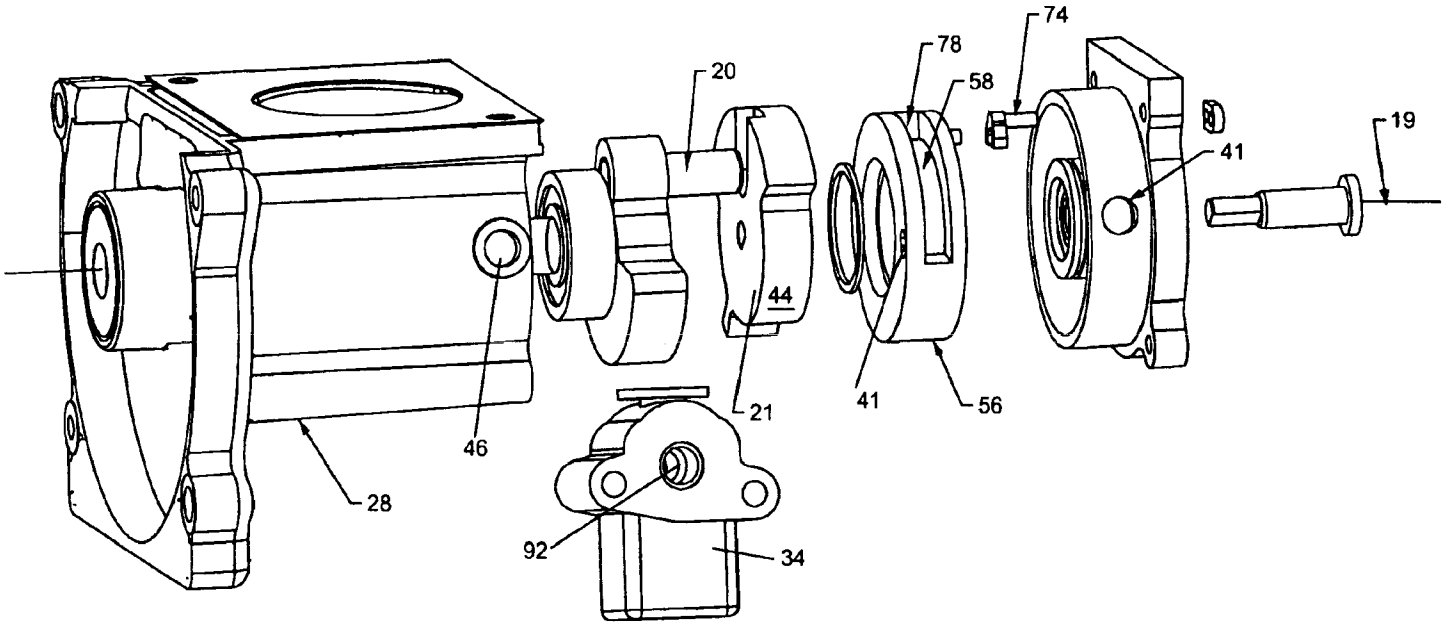
FIG. 22B is an exploded view illustration of the variable inlet timing system shown in FIG. 22A.
Figure 23:
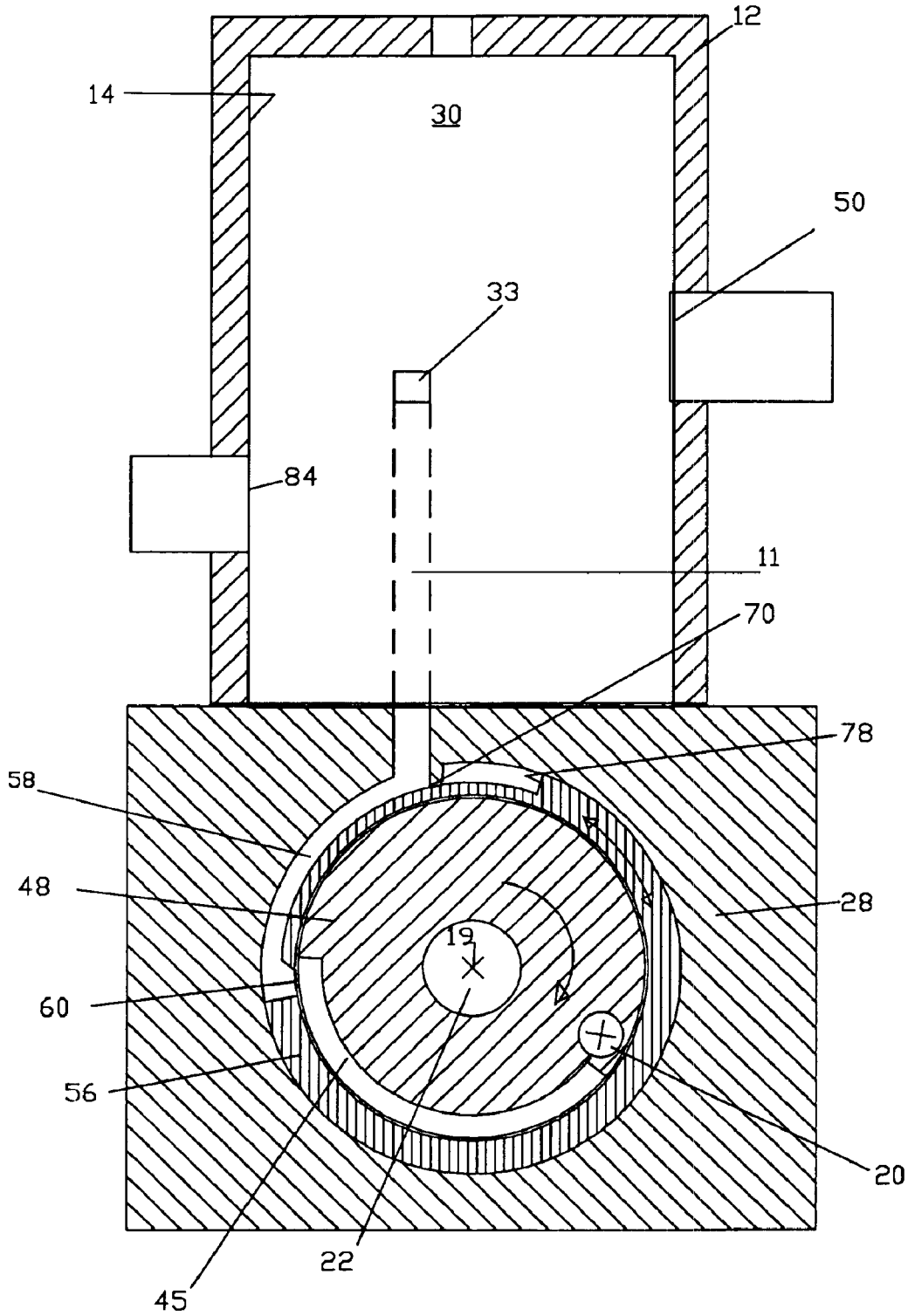
FIG. 23 is a vertical sectional view illustration of a variable transfer passage volume and timing system controlled by a rotatable disk for a two stroke engine.
Figure 24:
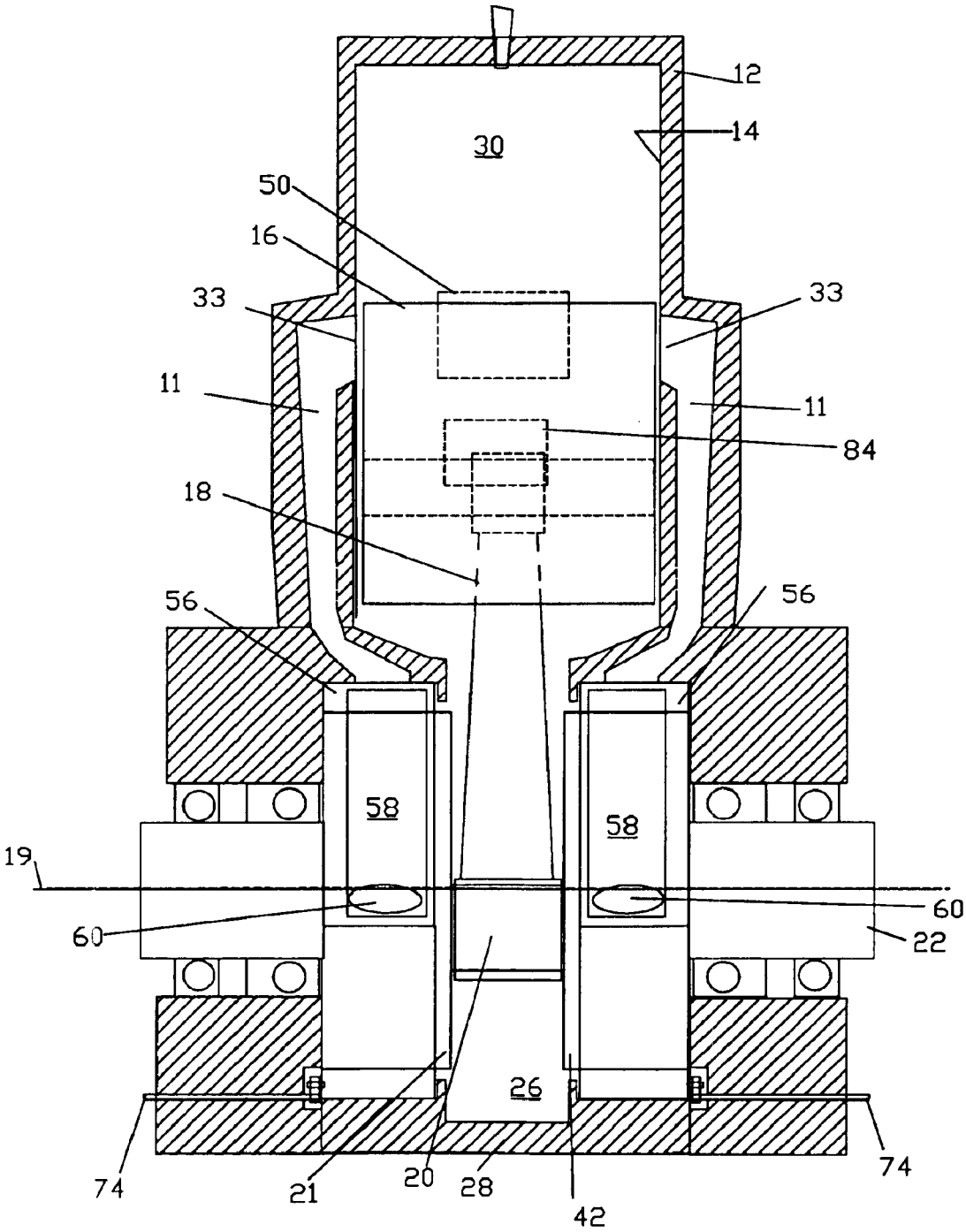
FIG. 24 is a sectional view illustration of the engine through a crankshaft axis in FIG. 23 with two rings around the crank webs.
Figure 25:
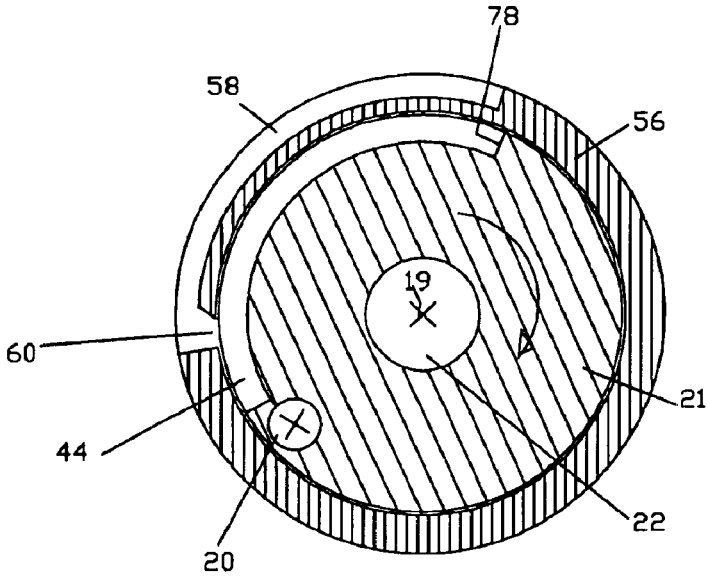
FIG. 25 is a sectional view illustration of one of the rings and the crank web for the variable volume and timing transfer passage system illustrated in FIG. 24.
Figure 26:
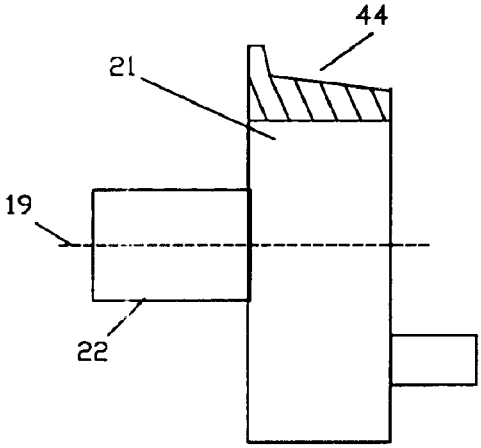
FIG. 26 is a sectional view illustration of the crank web illustrated in FIG. 25.
Figure 27:
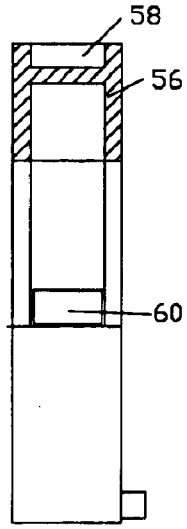
FIG. 27 is a sectional view illustration of the ring illustrated in FIG. 25.
Figure 28:
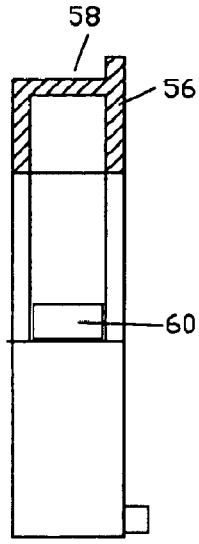
FIG. 28 is a second sectional view illustration of the ring illustrated in FIG. 25.

Illustrated in FIGS. 22, 22A, and 22B is a variable inlet port timing rotary disk valve system. An intake passage 92 from the carburetor 34 opens into the channel 58 in the ring 56 at an intake passage port 90. The channel 58 operates as a part of the intake passage 92 and has a crankcase port 41 which is open to the crankshaft chamber 26 at one end and is closed at the opposite end. The opening and closing of the ring port is controlled by the crank web 21. The ring can be rotated to control and vary the opening and closing time of the charge inlet timing. The timing can be optimized for a wide range of speeds to improve the breathing efficiency of the engine.

A two stroke engine 10 illustrated in FIGS. 23–28 is used to vary timing of the transfer port 33 to optimize the scavenging process. The lower end 100 of the transfer passage 11 opens into the channel 58 in the ring 56. A ring port 60 at one end of the ring opens into the crankcase 28. The ring port 60 is opened and closed by the crank web 21. Thus, rotating the ring 56 can vary opening and closing of the ring port 60 at the lower end 100 of the transfer passage 11 and alter the scavenging timing which can be used to provide asymmetric ring port timing. The channel 58 on the ring 56 effectively operates as an extension of the transfer passage 11 and, thus, the effective volume and length of the transfer passage 11 is varied as the ring 56 is rotated. In a conventional system, the transfer port timing is fixed and is controlled by the piston and, thus, the timing is symmetrical. The inherent problem of such conventional systems is loss of charge and transfer of blow down pressure into the crankcase at certain operating conditions during scavenging. The variable rotatable ring in the system disclosed herein may reduce or eliminate this problem.

In some conventional engine designs, each transfer duct is provided with a cut-off valve (typically a reed valve) at its junction with the crankcase, the transfer passage having a length selected for best pressure wave effect to fulfill the requirements. In the present invention, the timing may be controlled by the crank web, in which the timing is variable and the transfer passage length also can be varied to optimize the performance at wider ranges of speeds. The added advantage is that the exhaust port lead is very much reduced in comparison with that normally employed. Consequently, when exhaust port opens a high pressure plug of exhaust gas enters the transfer port. By this time, however, the crankcase port at the other end of the duct is closed and the gas in the duct is thus compressed under a positive pressure. The explosion end pressure (cylinder pressure) is dropping all the time as exhaust port opens and, concurrently with this, a reverse low pressure wave is initiated in the transfer duct, following the original positive wave. This not only evacuates the plug of exhaust gas from the transfer duct to follow the residuals out of the exhaust port but, by causing a depression at the lower end of the duct, it assists the flow from crankcase to cylinder through the crankcase port which is now open.

The variable ring 56 in the scavenging system can reduce exhaust port lead which increases effective expansion ratio of the engine. It can reduce the probability of exhaust gas entering the crankcase in any circumstances and regardless of the pressure value at any particular instant. It can improve scavenge pressure resulting from the reverse wave action in the transfer duct and the fact that because the crank port can be closed as soon as the crankcase content is discharged. The variable ring scavenging system can reduce any tendency for a reversal of flow in the transfer duct when the piston is rising after BDC. The effective length of the duct can be varied for effective pressure wave effect at all the speeds. When the piston is rising after BDC, the effective crankcase volume is lower in the variable ring scavenging system than in a conventional system because the transfer duct volume is removed from the total volume which helps breathing characteristics.

In some conventional engines disclosed in U.S. Pat. No. 6,491,006, the blow down of exhaust into the transfer duct is intentional. This is believed to delay the discharge of fresh charge into the cylinder and hence lower the scavenging loss of charge. The variable ring scavenging system provides a variable length transfer duct and adjustable ring port timing which enhance the benefits of blow down of exhaust into transfer duct. Blow down into long transfer ducts are used as a means of delaying the discharge of fresh charge into the cylinder and the exhaust blown down into the transfer duct also acts as a buffer medium. The rotatable ring provides a means for changing the duct length and, thus, the buffer medium volume. The ring port is open to crankcase and is not timed by the crank web for start of the scavenging process.

Figure 30:
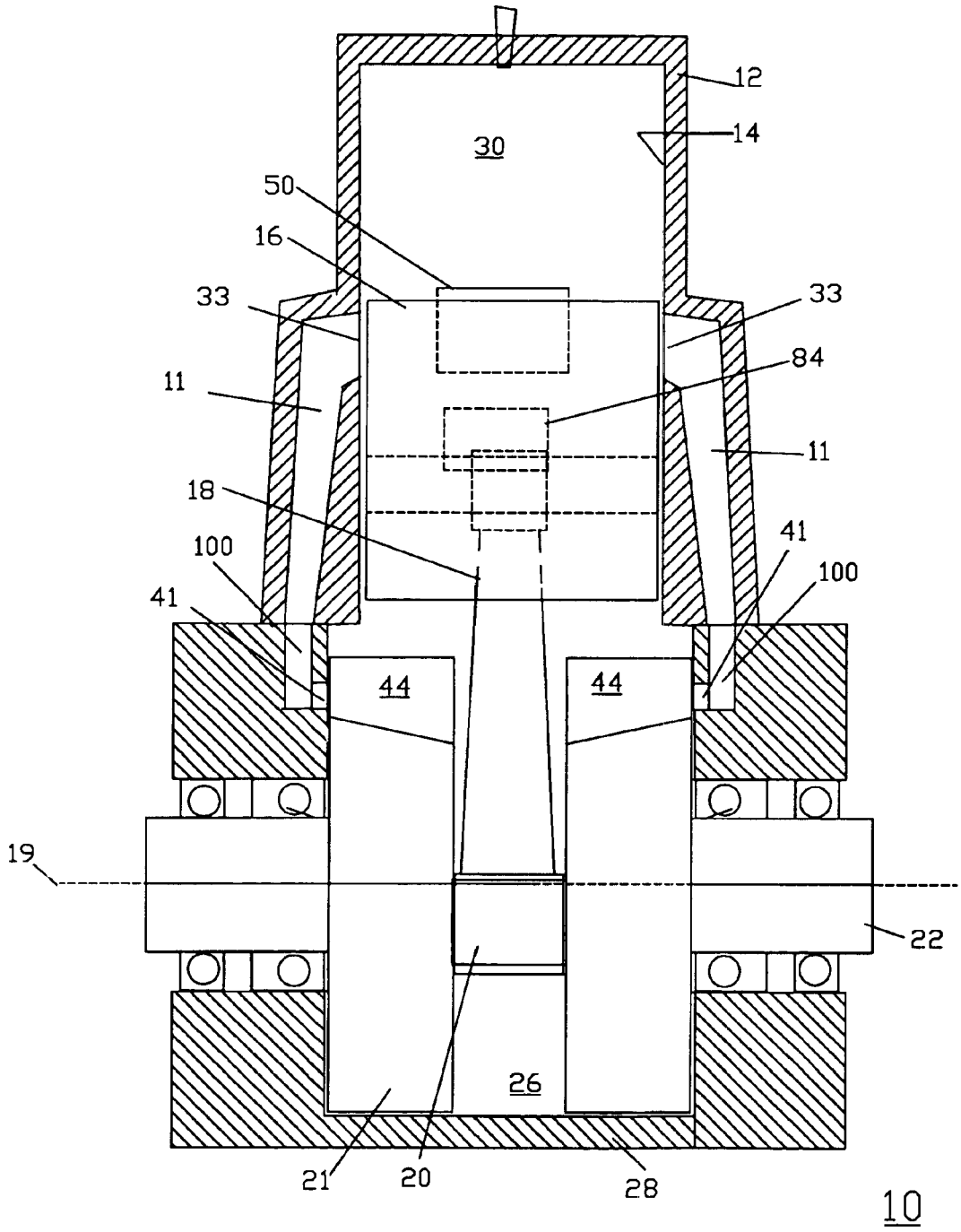
FIG. 30 is a vertical sectional view illustration of a two stroke engine with crank web controlled transfer port scavenging system with fixed timing.

The engine 10 illustrated in FIG. 30 provides fixed timing of the transfer port 33 controlled by the crank web 21. The lower end 100 of the transfer passage opens directly into the crankshaft chamber 26 through a crankcase port 41. The opening and closing of the crankcase port 41 is controlled by the crank web 21.

Figure 29:
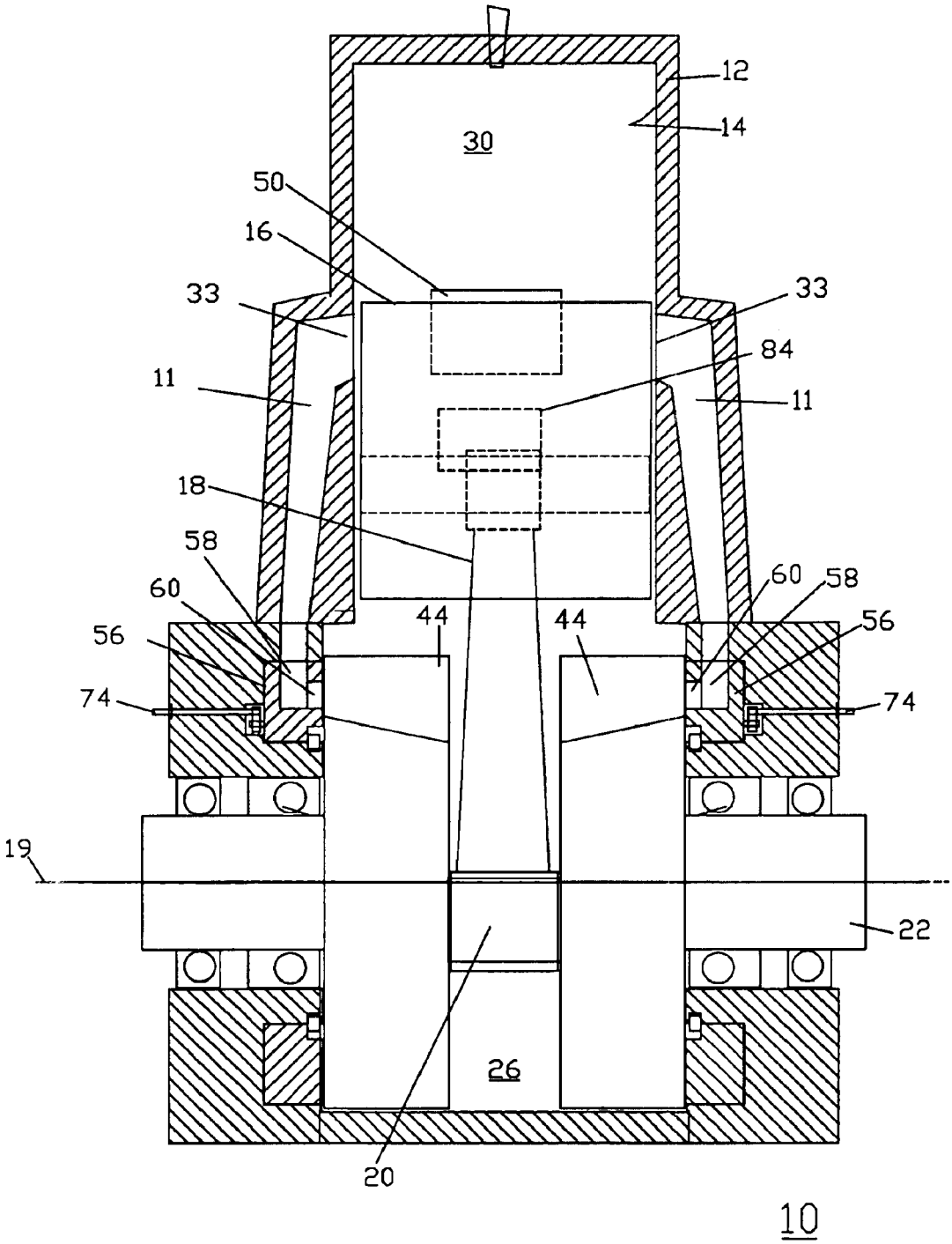
FIG. 29 is a vertical sectional view illustration of a two stroke engine with a variable transfer passage volume and timing controlled by rings adjacent to the disks.
Figure 31:
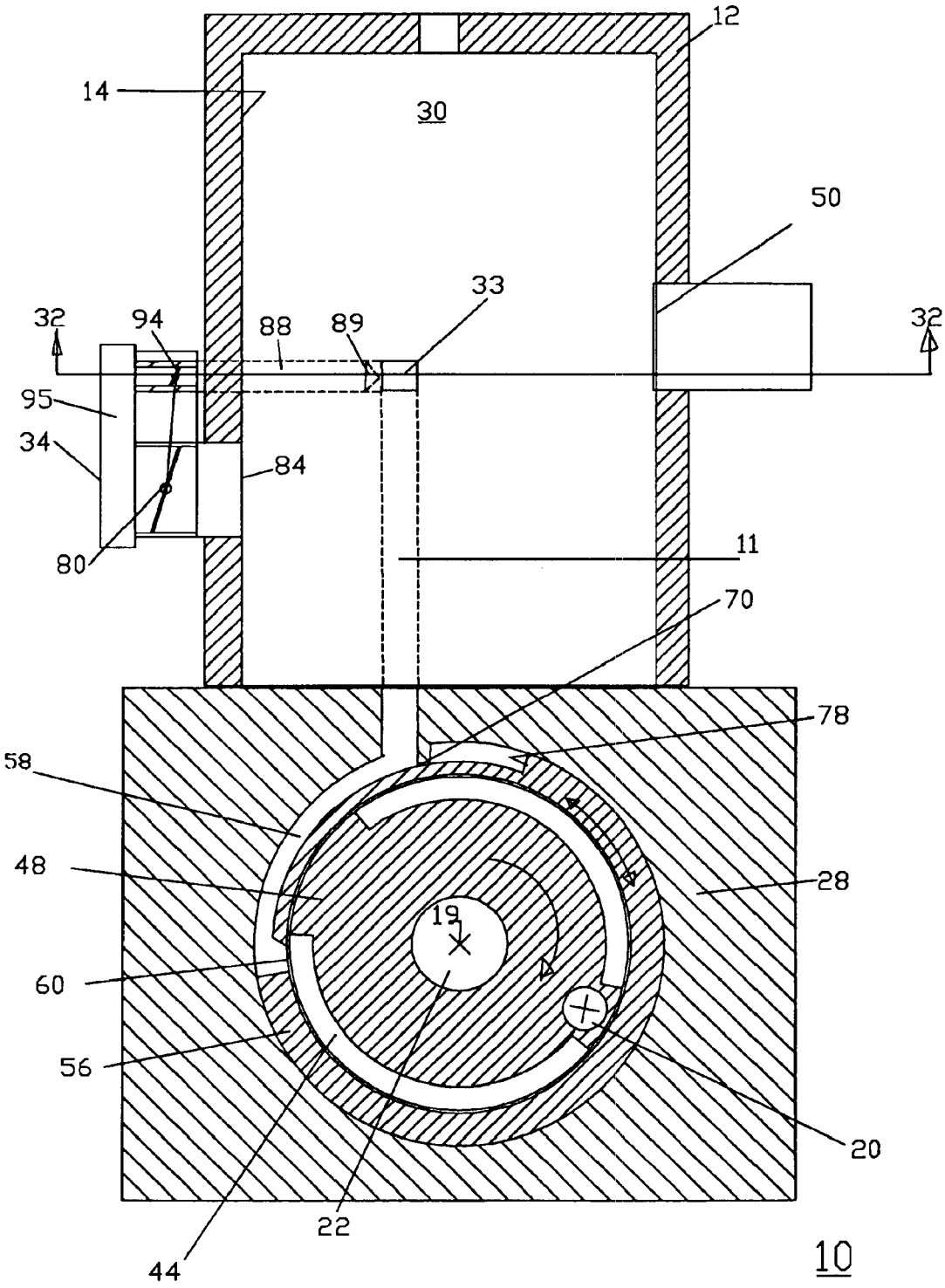
FIG. 31 is a vertical sectional view illustration of a two stroke engine with a variable transfer passage volume and timing system with an air head scavenging system.
Figure 32:
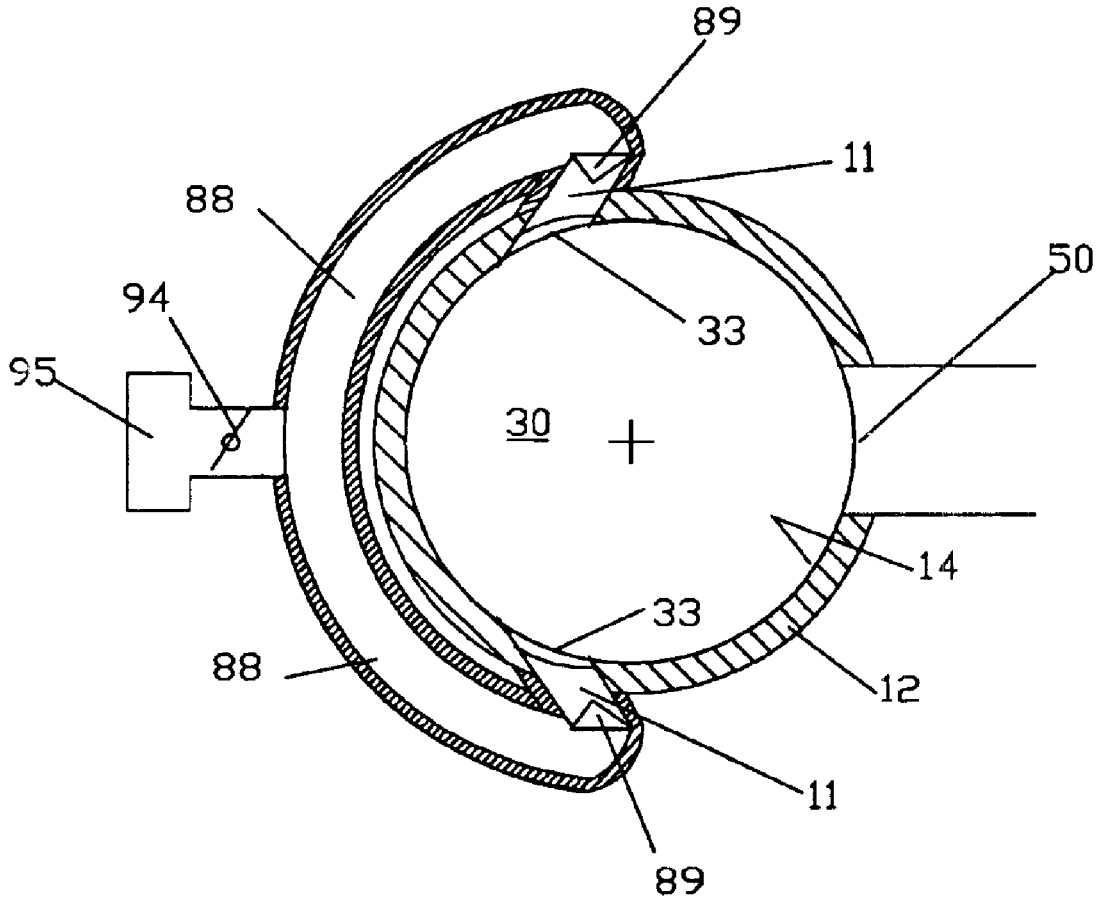
FIG. 32 is a sectional view illustration through 32—32 in FIG. 31.

FIGS. 31 and 32 illustrate a two stroke engine 10 having a air head scavenging system with the variable volume and timing transfer passage ring 56 which improves the performance of an air head scavenging system wherein the lower end 100 of transfer passage 11 is controlled by the crank web 21. After the transfer passage is filled with air, the ring port 60 at the lower end 100 of the transfer passage 11 can be closed to prevent flow of air into the crankshaft chamber 26 in the crankcase 28. This is accomplished by closing the ring port 60 using the crank web 21 and rotary shut-off valve 48 illustrated in FIG. 31. The rotatable ring 56, illustrated in FIGS. 24 and 29, may be used to provide a variable volume transfer passage for varying and optimizing the volume of air inducted into the transfer passage according to speed and load conditions. Closing the ring port 60 after the transfer passage is filled with air enhances the charge induction into the crankcase through the piston controlled, reed valve or rotary valve main intake system.

As the piston moves upward, the drop in pressure in the crankshaft chamber 26 causes the ambient air to flow into the transfer passage 11 through an air passage 88 and reed valve 89 as illustrated in FIG. 31. The quantity of air is regulated by an air control barrel valve 94. And air control valve 94 is linked to an air/fuel mixture regulating valve 80. The ring port 60 and the crank web 21 mounted rotary shut-off valve 48 control the timing of flow of air. The variable ring 56 position alters the total transfer passage volume and timing. Thus, the trapped air in the transfer passage is more controllable in this design. Using the rotatable variable ring 56 and the crank web 21 controlled scavenging system, the start of injection of air ahead of fresh charge can be varied. Thus, the air entering the cylinder bore 14 ahead of the charge acts as a buffer medium between the burnt gas and the fresh charge. It is the air that is likely to be short-circuited that minimizes the loss of fuel and hence lowers the unburned hydrocarbon emission.

Figure 33:
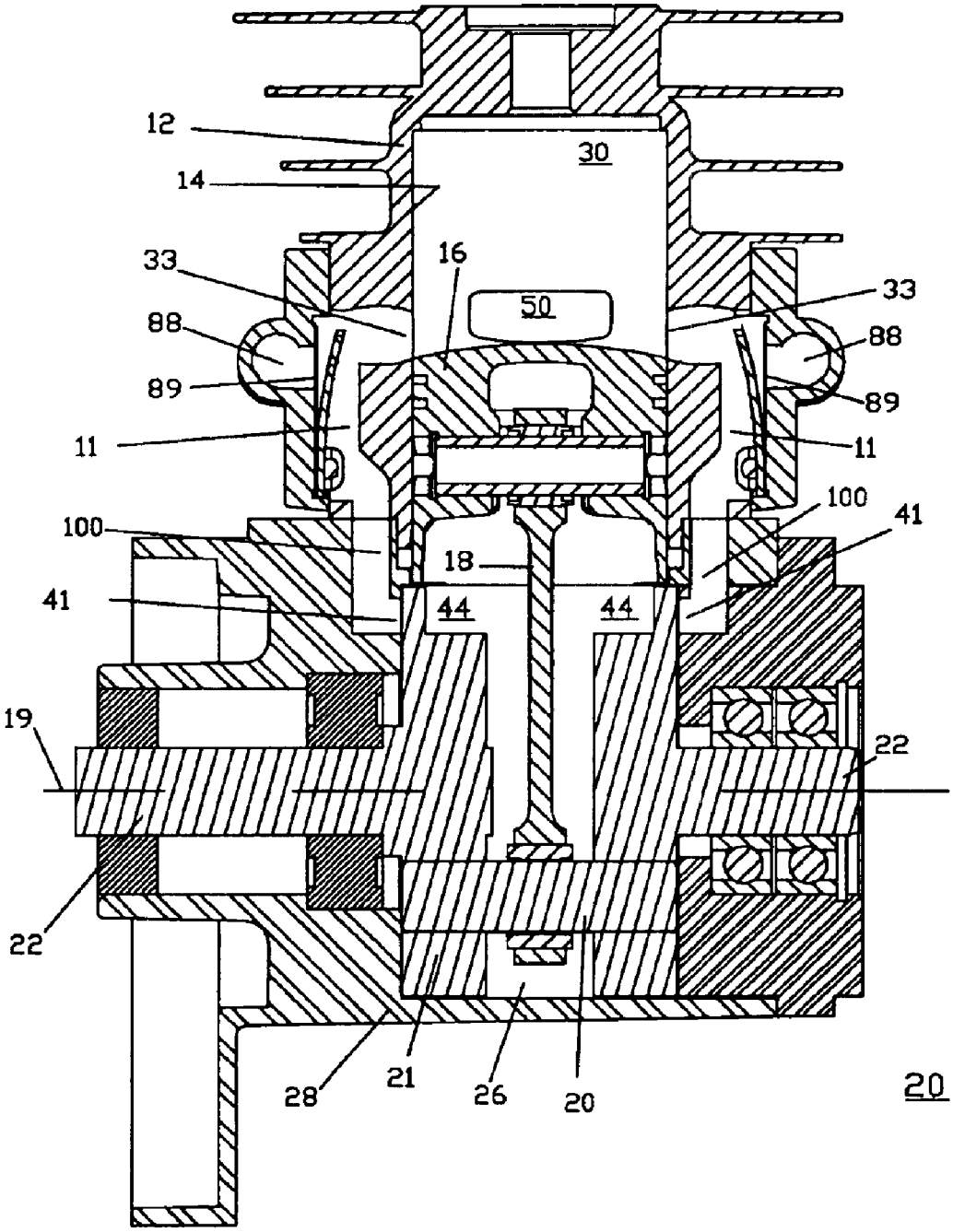
FIG. 33 is the vertical view illustration of air head scavenged engine with fixed crankcase port timing.

FIG. 33 illustrates an air head scavenging system with a fixed transfer port timing. The crankcase ports 41, which are in fluid communication with the transfer passages 11, are opened and closed by the crank web 21 to start and end induction of air into the transfer passage 11 through the one-way reed valve 89. Once the induction of air into the transfer passage 11 is shut-off by the crank web, the induction of main charge into the crankcase chamber 26 is more effective, as the crankcase chamber volume is now cut-off from the transfer passage volume.

A conventional single barrel carburetor such as a single butterfly valve type carburetor may be used to operate the air head scavenged engine. This is accomplished because the volume of air trapped in the transfer passage 11 is constant at all speeds and may be used to lower the hydrocarbon emission even at idle. Thus, only the main charge going into the crankcase chamber may be regulated for load and speed control while full air is supplied into the transfer passage without having to dilute the crankcase chamber charge with the air. The excess air is shut-off from getting into the crankcase during the idling and wide open throttle. During the scavenging process, the start of injection of air into the combustion chamber 30 may be delayed by the crank web. An air filter may be provided right at the air reed valve 89 and, thus, eliminating the need for any air pipe or passage 88. This means the air is supplied to top of transfer passage during intake process at all operating conditions, and there is no need for the regulating air control barrel valve 94 illustrated in FIGS. 31 and 32. In which case, a conventional carburetor may be used for air head scavenging where the transfer passage crankcase port 41 is open and shut-off by the crank web 21, as illustrated in FIG. 33.

There can be more than two transfer passages in the engine. In U.S. Pat. No. 6,491,004, for example, the engine has two pairs of transfer passages. One transfer passage of the first pair in on each side of the exhaust port and is used for air head scavenging as described above and the second pair is located for use as in a conventional engine. The rotary shut-off valve 48, as described above, may be used as shut-off valve either for both the pair of transfer passages or for just one pair of transfer passages that handle air. When two pairs of transfer passages are used, the disk valve may delay one pair of transfer passage opening into crankcase to delay discharge of charge into the combustion chamber 30 while providing the other pair that handle air with advanced passage opening timing for air head scavenging. For example, this embodiment would add a rotary shut-off valve to the lower end of transfer passages in the engine disclosed in U.S. Pat. Nos. 6,289,856, 6,112,708, 6,240,886, and 5,425,346.

The engines disclosed in U.S. Pat. Nos. 6,289,856, 5,425,346, and 5,379,732 are examples of engines having air head scavenging controlled by piston ports and channels in piston skirts. The lower ends of the transfer passages are constantly open into the crankcase chamber, thus, making it possible for air to flow into the crankcase chamber during wide open or full throttle running condition. At idle, the air flow into the transfer passages is either completely shut-off or partial. In such engines, as the piston travels downward the crankcase pressure builds up which may lead to reverse flow of air back into the ambient.

Figure 34:
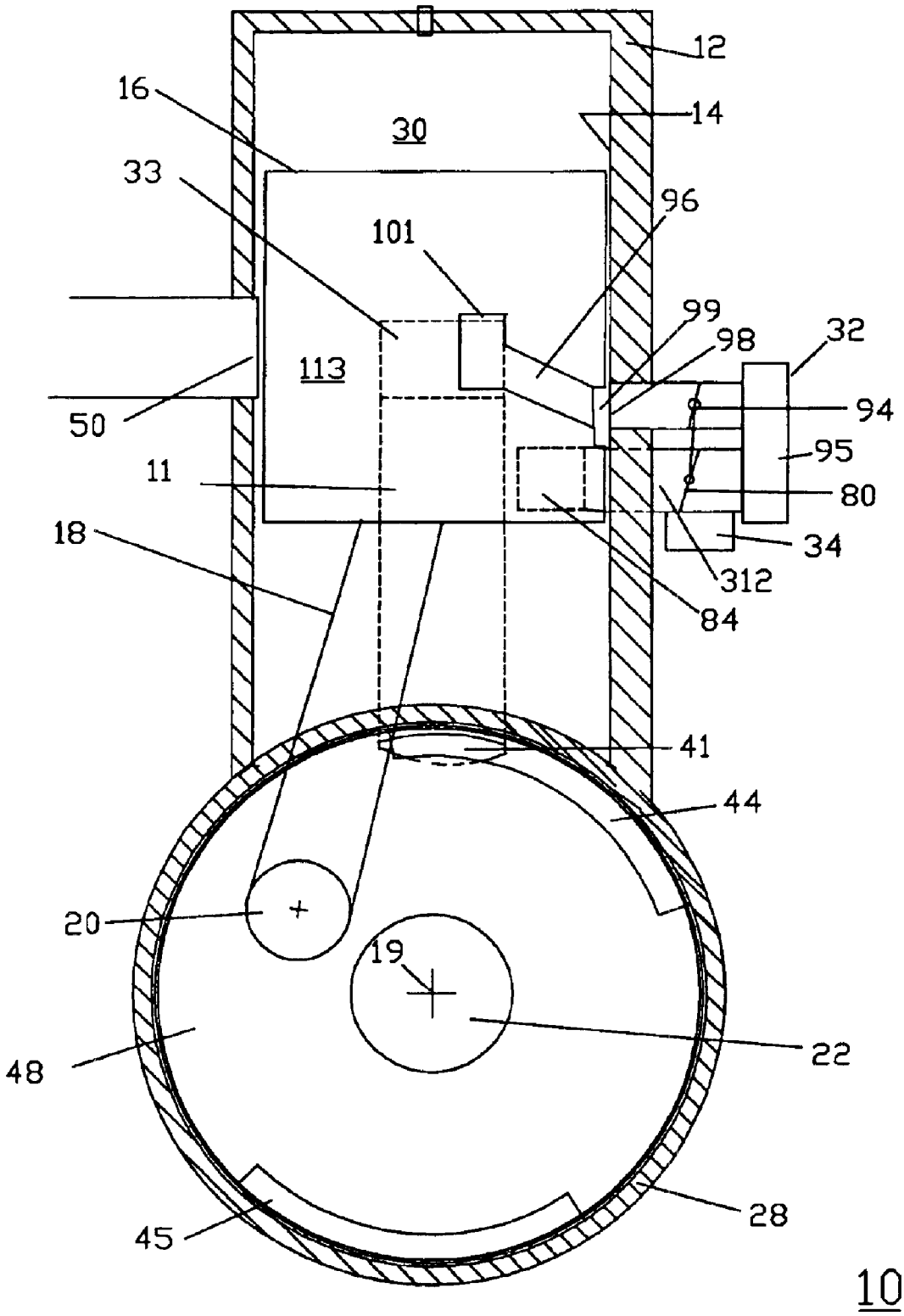
FIG. 34 is a vertical sectional view illustration of a two stroke engine with an air head scavenging system and fixed unsymmetrical transfer port timing of the air head scavenging system and open channels in the piston.
Figure 35:
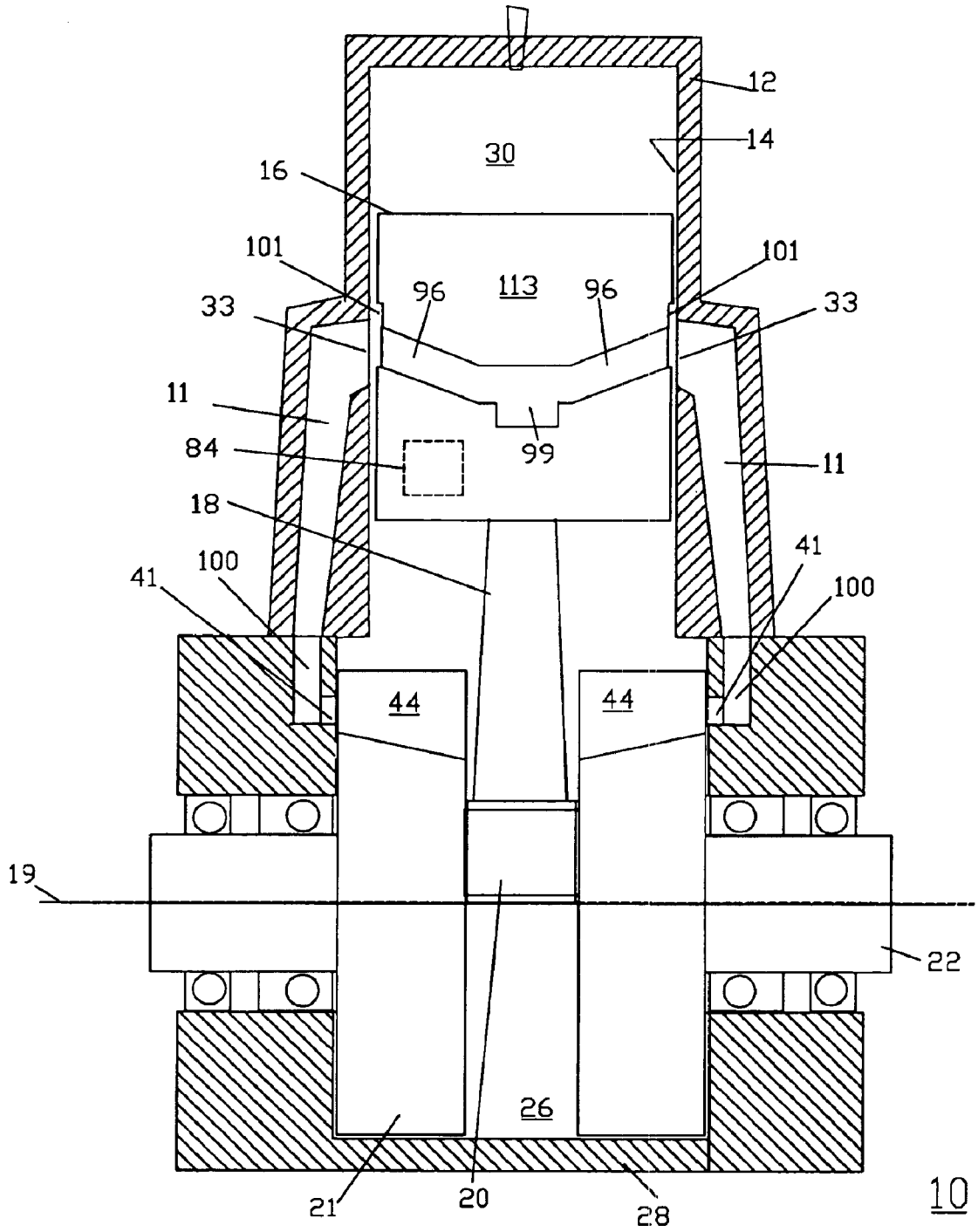
FIG. 35 is a sectional view illustration of the engine through a crankshaft axis in FIG. 34.
Figure 36:
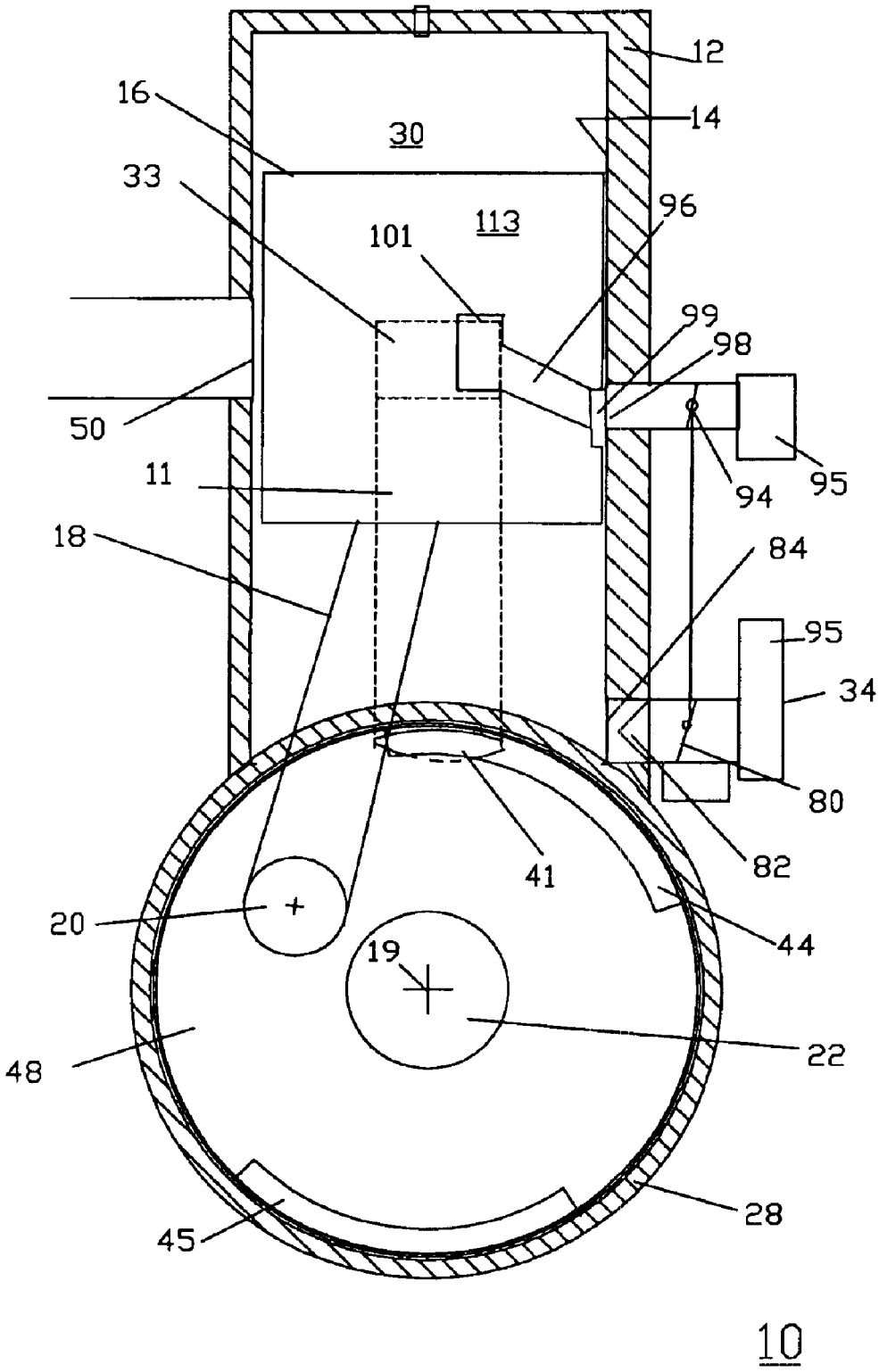
FIG. 36 is a vertical sectional view illustration of a two stroke reed valve controlled engine with an air head scavenging system with open channels in the piston.

FIGS. 34–36 illustrates an example of piston controlled air head scavenging system controlled by the rotary shut-off valve which is illustrated as the crank web 21. The engine operates like a conventional two stroke engine. First and second piston ports 99 and 101 are disposed on the skirt 113 of the piston 16 and are connected to each other in gaseous communication by an air channel 96. The transfer port 33 and exhaust port 50 are closed by the piston 16 as it ascends. During the upward stroke, pressure in the crankshaft chamber 26 drops below ambient creating a pressure difference between ambient and crankcase chamber 26. At this time, the rotation of the crank web aligns first annular slots 44 with the crankcase port 41 at the lower end 100 of the transfer passage 11. As the piston travels upward, the first piston port 99 aligns with an air inlet port 98 disposed through the cylinder block 12 and which leads to an air cleaner 95 associated with the carburetor 34 (another example of which is further illustrated in FIG. 51). At about the same time, the second piston port 101 aligns with the transfer port 33 connected to the transfer passage 11. Thus, the air channel 96 provides fluid communication between the crankcase chamber 26 and the ambient air.

The pressure difference between the crankcase chamber 26 and ambient allows the air to flow into the transfer passage 11 through air control barrel valve 94, air inlet port 98, air channel 96, and the second piston port 101, transfer port 33 on the cylinder bore 14 and into the transfer passage 11 until such time the piston closes the air inlet port 98 in the cylinder bore 14. Just about the same time, the crank web 21 closes the lower end 100 of the transfer passage 11 at the crankcase port 41. This cuts off the gaseous flow communication between the crankcase and the transfer passage.

In a piston ported induction system, as illustrated in FIG. 34, further upward movement of the piston uncovers the main inlet port 84 (for charge induction) in the cylinder block 12 through to the cylinder bore 14 for induction of air fuel charge into the crankcase chamber 26. The main inlet port 84 is angularly offset from the air inlet port 98 and allows charge to flow into the crankcase chamber 26 through a second flow passage 312 leading from the carburetor 34. A butterfly valve 80 may be used to regulate flow through the main inlet port 84. In a reed valve system, illustrated in FIG. 36, the main charge induction begins as soon as the pressure difference across the crankcase chamber 26 and the ambient opens the reed valve 82. A rotary inlet may also be used in conjunction with the piston controlled air head scavenging. As the piston 16 moves downward during the expansion stroke, the crankcase pressure rises.

At a certain position, the piston will again uncover the air inlet port. At this time, a rise in crankcase pressure may cause the charge to flow into the transfer passage and, thus, force the air and charge to flow out back through the air channel 96 into the atmosphere. However, since the crank web can have asymmetrical timing, the web keeps the lower end of transfer passage closed at the crankcase port 41. Thus, the loss of air or charge is prevented by using a web as a shut-off valve in a controlled transfer passage system, which is novel as described here. The crank web opens the transfer passage 11 for regular scavenging just before the piston 16 opens the transfer port 33. During the scavenging process, it is the air that enters the combustion chamber first and is most likely to be short-circuited into the exhaust port. Thus, air acts as a buffer medium between the burnt gas and the fresh charge, which minimizes the emission and improves fuel economy. The design of the crank web controlling the transfer passage for improved sealing between the crankcase chamber 26 and the transfer passage (and ambient), particularly as the piston descends, may be used with any of the piston channel systems described in the U.S. Pat. Nos. 6,289,856 and 5,425,346.

Figure 37:
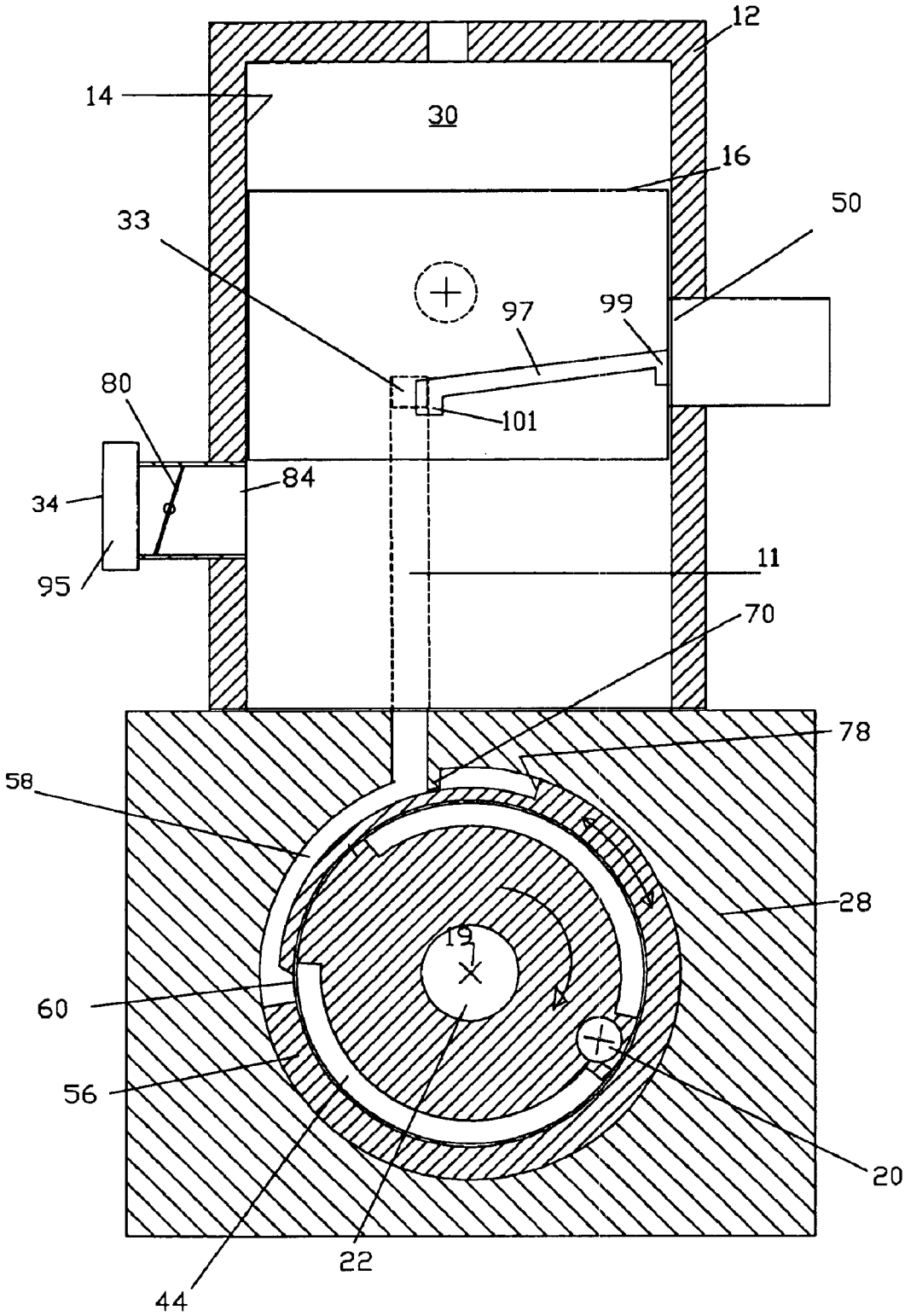
FIG. 37 is a vertical sectional view illustration of a two stroke engine with variable transfer passage volume and timing and with a selective exhaust gas recirculation system and an open channel on the piston.
Figure 38:
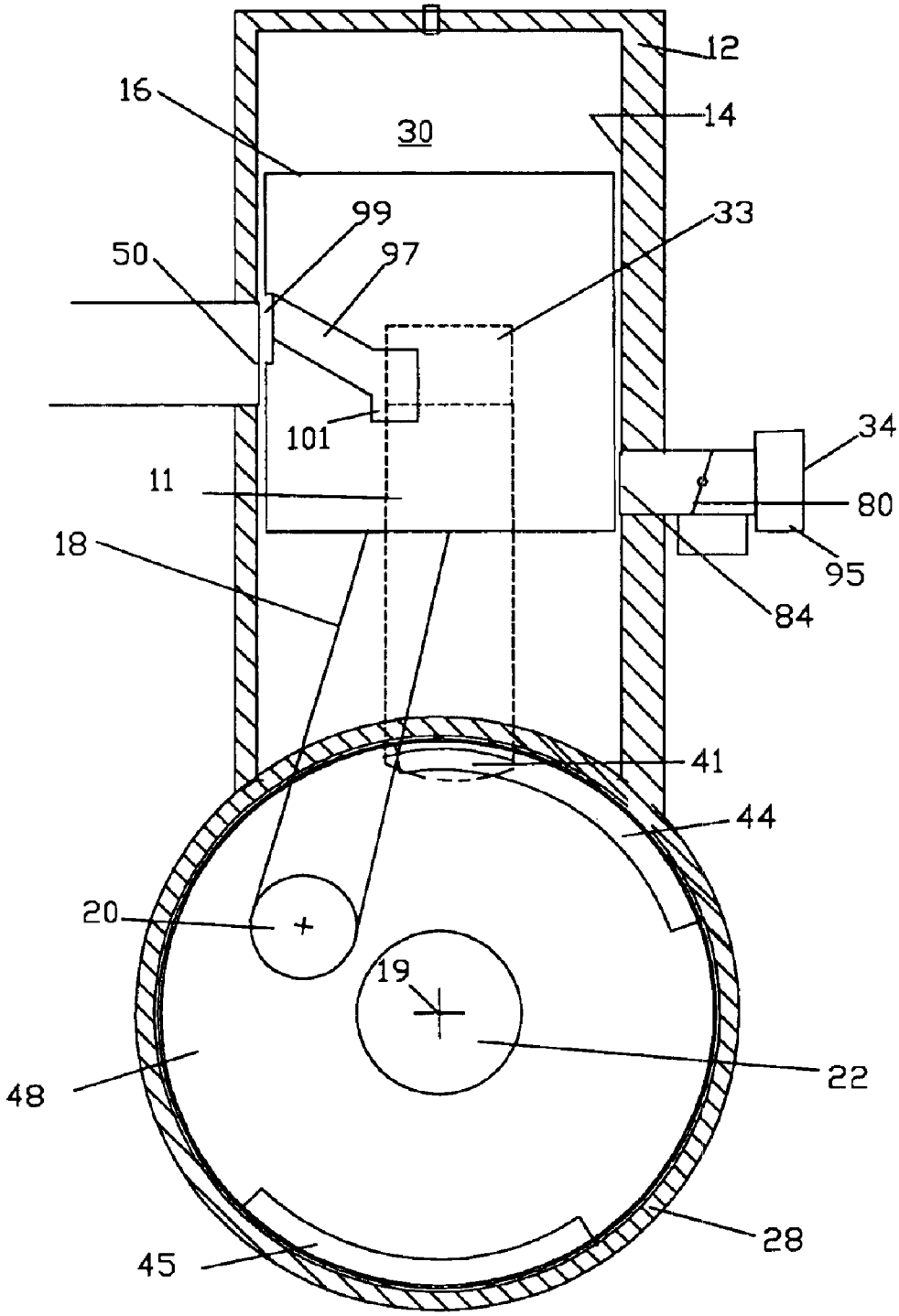
FIG. 38 is a vertical sectional view illustration of a two stroke engine with fixed transfer passage volume and timing and with a selective exhaust gas recirculation system and an open channel on the piston.
Figure 39:
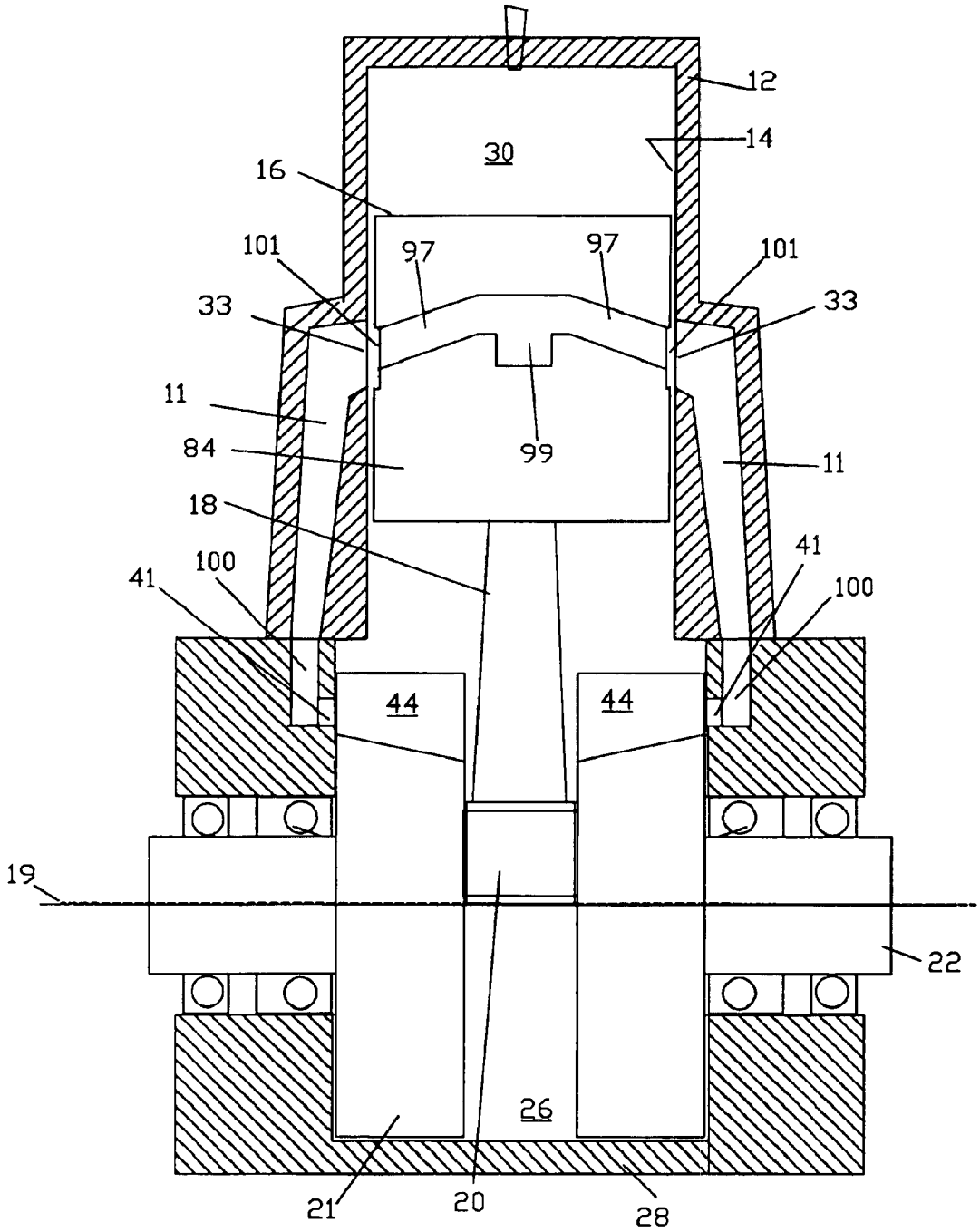
FIG. 39 is a sectional view illustration of the engine through a crankshaft axis in FIG. 38.

In a scavenging process similar to that of the air head scavenging system explained above, the exhaust gas can be used as a buffer medium during an early part of the scavenging process. The exhaust gas is brought in to the top of the transfer passage 11 through piston channels in the piston as described in U.S. Pat. No. 5,425,341. In U.S. Pat. No. 5,425,341, the piston channels are inside the piston. Piston channels 97 outside the piston 16 are illustrated in FIGS. 37–39. FIG. 37 illustrates the exhaust gas recirculation into the transfer passages 11 where the lower port is opened and closed by the crank web 21 and has a variable volume and timing ring 56. FIGS. 38 and 39 have fixed transfer passage 11 volume and fixed timing. As the piston 16 moves upward and at a particular crank angle, the piston channel 97 in the piston aligns with the exhaust port 50 and the transfer port 33 allowing the exhaust gas to flow into the transfer passage 11 due to a pressure differential. The amount of exhaust gas flowing into the transfer passage 11 can be controlled by the position of the ring port 60 and the crank web 21, which controls the timing. When the transfer ports 33 open, recirculated exhaust gas enters the combustion chamber 30 first and is likely to be short-circuited. Thus, the escape of fresh air fuel charge into the exhaust is minimized.

Figure 40:
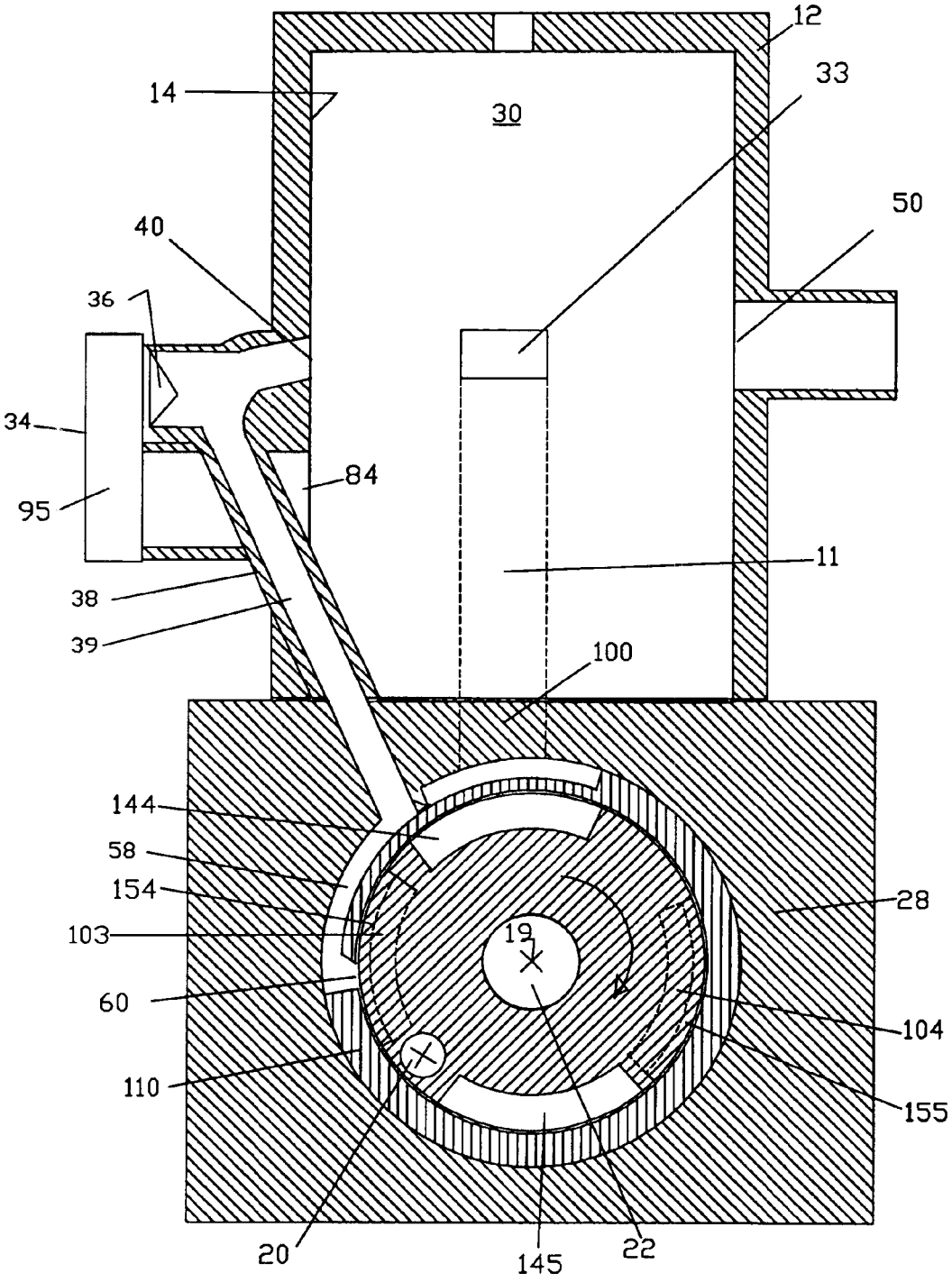
FIG. 40 a vertical sectional view illustration of a two stroke engine with dual rings to control variable transfer port and charge timing and volume.

A multiple ring scavenging system, illustrated in FIGS. 40–46, provides variable transfer port timing, variable charge injection timing, and variable inlet timing with and without air head systems in a manner as explained above. Axially adjacent first and second angularly adjustable rings 109 and 110 concentrically surround the circular disk or crank web 21. The first and second angularly adjustable rings 109 and 110 have first and second annular ring channels 180 and 182 extending circumferentially partway through the first and second angularly adjustable rings 109 and 110, respectively. The first and second annular ring channels 180 and 182 have first and second ring ports 186 and 188. The transfer passage 11 culminates at the first annular ring channel 180 in the ring 109 at the crankcase 28 of the engine illustrated in FIG. 40. The injection passage 39 of the injection tube 38 culminates at the second annular ring channel 182 of the second ring 110 in crankcase 28 of the engine illustrated in FIG. 40. The first ring 109 and its first annular ring channel 180 are behind the second ring 110 in the view so only the second ring 110 is illustrated in FIG. 40. A single lever (not shown in FIGS. 40–43) may control and rotate angularly adjustable rings in the multiple ring systems.

Figure 41:
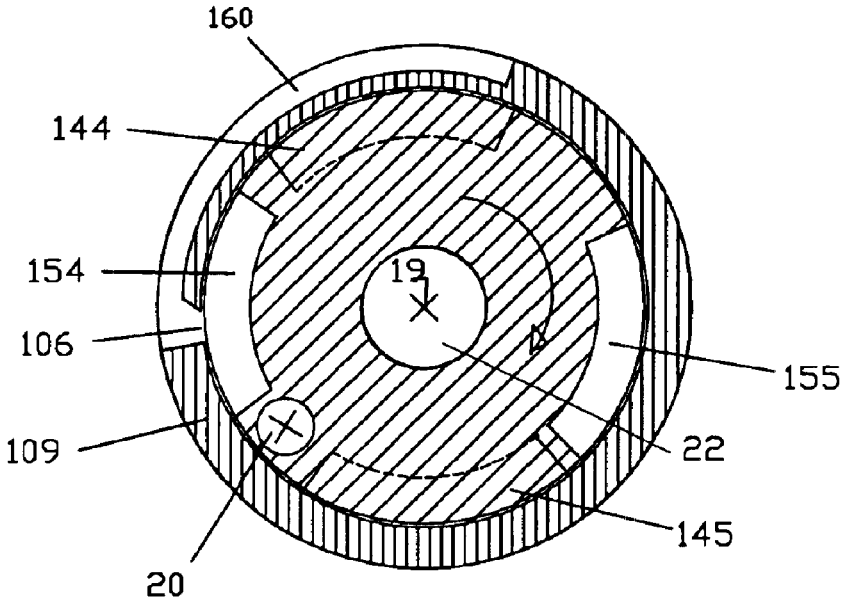
FIG. 41 is a sectional view illustration of the dual rings and crank web illustrated in FIG. 40.
Figure 42:
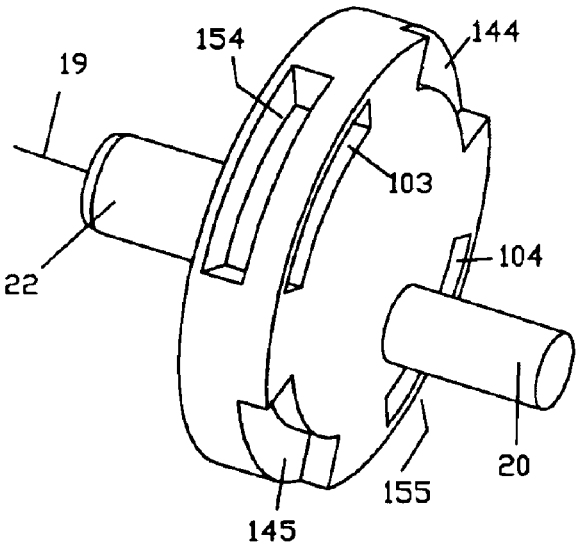
FIG. 42 is a sectional view illustration of the crank web illustrated in FIG. 41.
Figure 43:
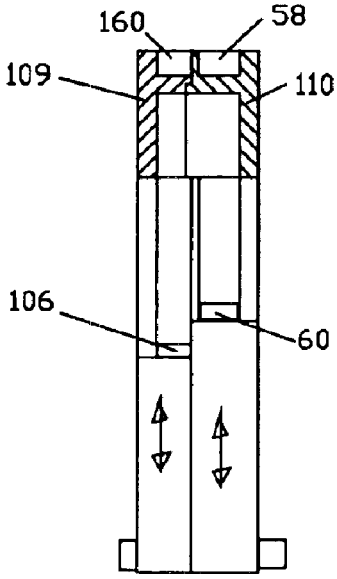
FIG. 43 is a sectional view illustration of the dual rings illustrated in FIG. 40.

FIGS. 40–43 illustrate the multiple ring scavenging system with variable volume and timing for charge and variable volume and timing for transfer passage. FIG. 42 illustrates one of the many ways possible for the crank web 21 to have multiple circumferentially extending axial gas pathways to control timings of the different ring ports. FIGS. 41 and 42 illustrate an example of multiple circumferentially extending axial gas pathways through the crank web 21. First and second axial gas pathways illustrated as first and second annular slots 144 and 145 are cut through or extend axially partially through the radially outermost section 52 bordered by the periphery 43 of the circular disk or crank web 21. Third and fourth annular L-shaped pathways 154 and 156 have third and fourth radially inwardly extending annular slots 158 and 160 that intersect third and fourth axially extending annular slots 162 and 164 respectively. The third and fourth radially inwardly extending annular slots 158 and 160 have radially outwardly facing third and fourth radial inlets 170 and 172, respectively, in the periphery 43. The third and fourth axially extending annular slots 162 and 164 have axially facing third and fourth axial outlets 174 and 176, respectively, that are located radially inwardly of the crank web's 21 periphery 43.

The first and second angularly adjustable rings 109 and 110 are disposed between the crankcase chamber 26 and the injection passages 39 and between the crankcase chamber 26 and the transfer passage 11 respectively. The first annular ring channel 180 is rotatably alignable with the lower end 37 of the charge passage 39. The second annular ring channel 182 is rotatably alignable with the lower end 100 of the transfer passage 11. The first ring port 188 in the angularly adjustable ring 109 is rotatably open to the third and fourth radially inwardly extending annular slots 158 and 160 through the radially outwardly facing third and fourth radial inlets 170 and 172 respectively in the periphery 43. The second ring port 186 in the angularly adjustable ring 110 is rotatably open to the first and second annular slots 144 and 145. The first annular ring channel 180 controls transfer passage volume and timing, while the second annular ring channel 182 controls charge induction volume and timing through the injection passage 39.

Figure 45:
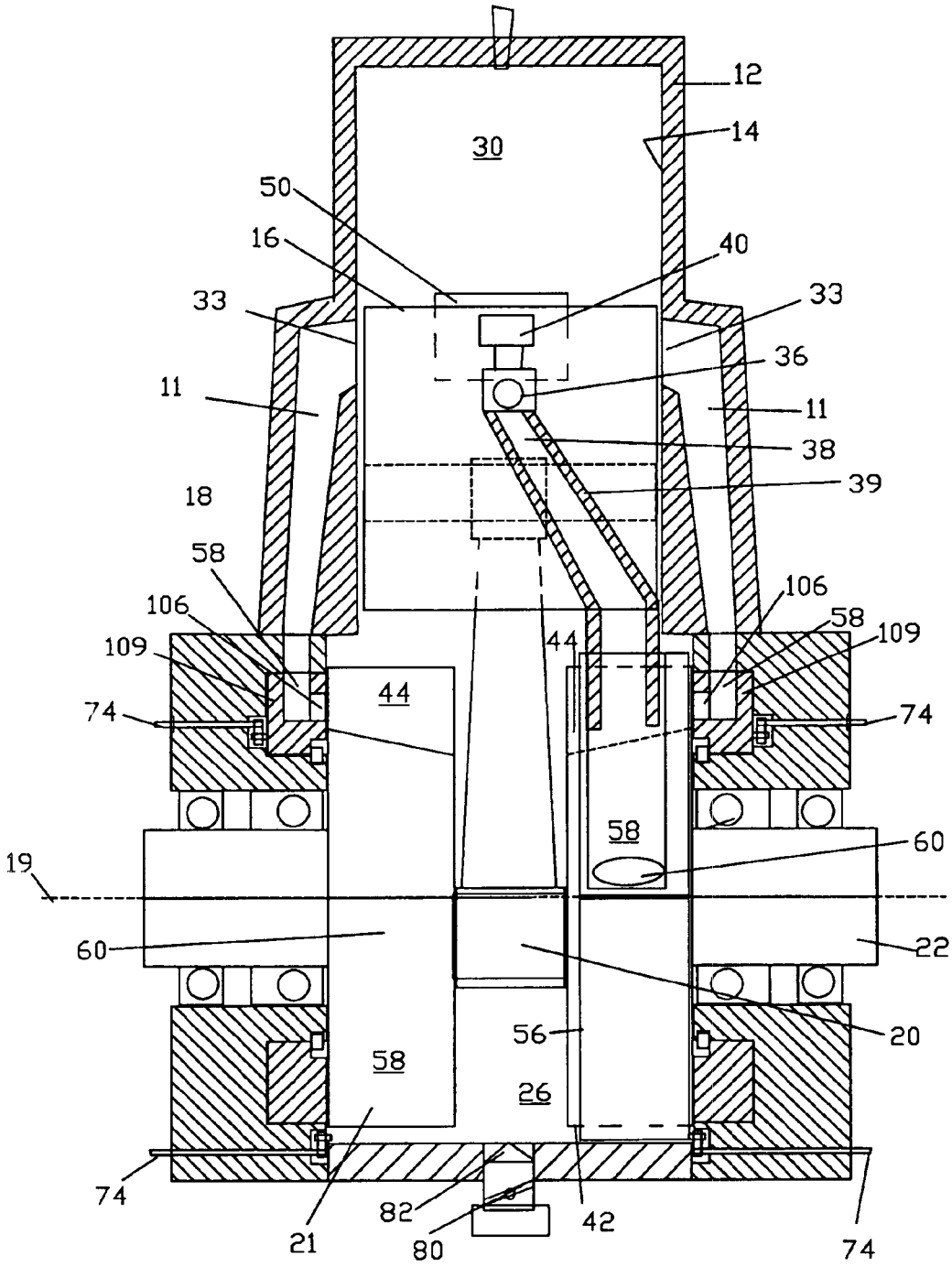
FIG. 45 a vertical sectional view illustration of a two stroke engine with a multi-ring system for variable transfer passage volume and timing, stratified charge injection system with variable volume injection passage and timing, and a reed valve inlet system.
Figure 46:
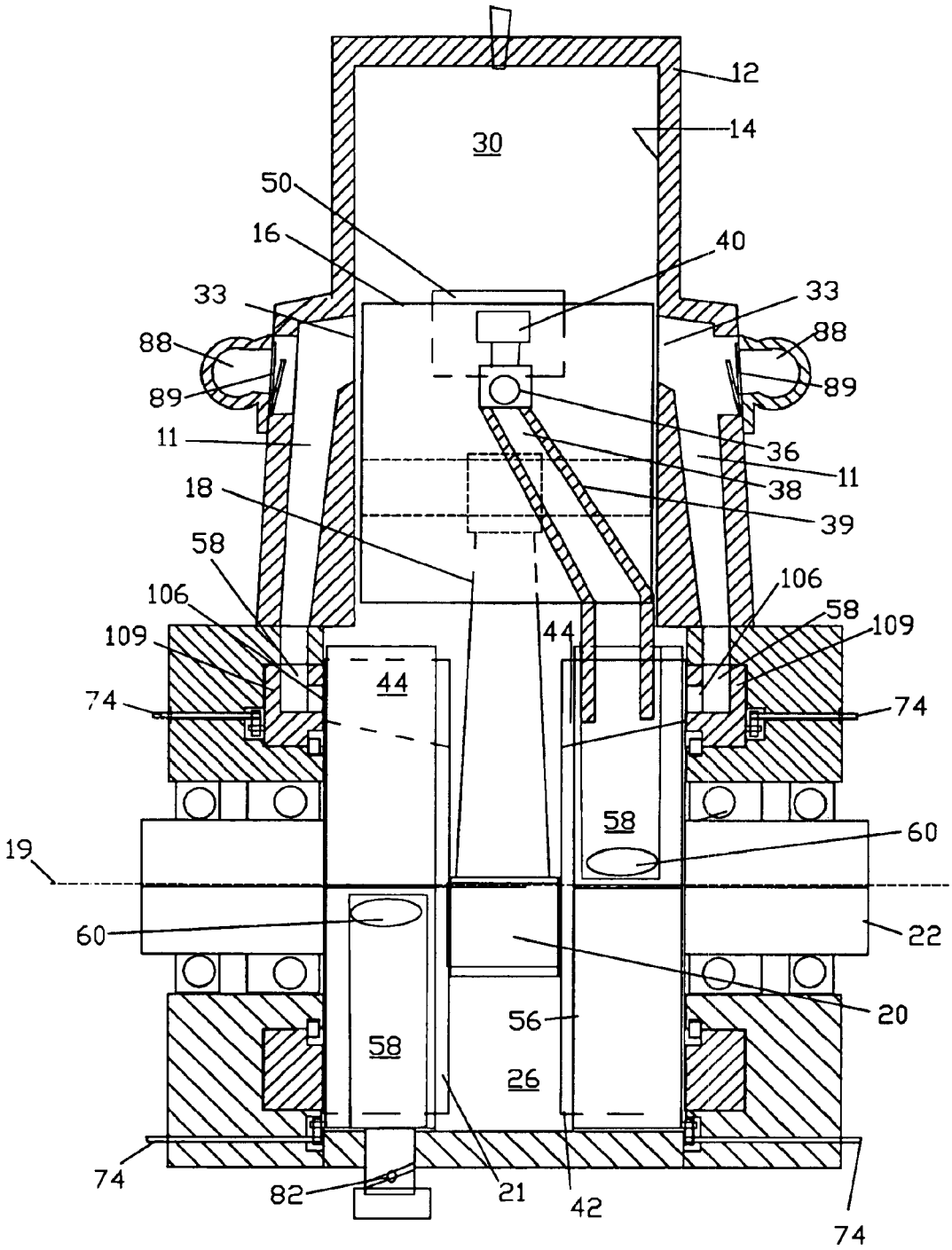
FIG. 46 is the vertical side view illustration of a multi-ring system for variable transfer passage volume and timing, stratified charge injection system with variable volume injection passage and timing and variable inlet timing with air head scavenging system.

One embodiment of the crank web 21 is a step type where a larger diameter disk section controls the transfer port timing either of fixed or variable timing type illustrated in FIG. 44. The main intake system is a rotary valve type with variable inlet timing, as illustrated in FIG. 44. Angularly adjustable rings to control intake and charge induction could be mounted concentrically to the web and adjacent to each other. The main intake system illustrated in FIG. 45 is a reed valve type with multiple ring system for charge and transfer passage volume and timing. FIG. 46 illustrates an air head scavenging system with charge injection and multiple ring system.

FIGS. 47, 48, 49 and 49A illustrate a web controlled fixed timing for transfer ports and charge system. The main inlet is a piston ported system. In this embodiment, the construction of the engine becomes easier. The functioning of the charge and main intake is identical to the two-way scavenging system illustrated in FIG. 1. However, in addition to using web as a shut-off valve for charge, the transfer passage lower port is also opened and closed to the crankcase chamber 26 by the rotary shut-off valve. Engine ports 111 at lower ends 100 of the transfer passages 11 are opened and closed by rectangular cross-sectional annular slots 318, further illustrated in FIG. 49A, to open and close the transfer passages 11 between the crankcase chamber 26 and the combustion chamber 30 to effect scavenging.

Illustrated in FIGS. 50–54 is an exemplary two stroke engine 20 having a cylinder block 12 that houses a cylinder bore 14. A piston 16 reciprocates within the cylinder bore 14 and is connected by means of a connecting rod 18 to a crank throw 20 between first and second crank webs of a crankshaft 22. The crankshaft 22 is journaled for rotation within a crankcase chamber 26 of a crankcase 28 that is affixed to the lower end of the cylinder block 12 in a suitable manner. A combustion chamber 30 is defined with a region within the cylinder bore 14 above the piston 16. Transfer passages 11 between the crankcase chamber 26 and the combustion chamber 30 are used for scavenging and allow fresh air initially followed by fresh lean fuel/air charge to be drawn from the crankcase chamber 26 through crankcase transfer ports into the combustion chamber 30 through transfer ports 33 in the cylinder block 12 at the completion of a power stroke.

A rich fuel/air mixture is inducted into the combustion chamber 30 of the cylinder bore 14 by a charge induction system which includes a three-way carburetor 132, an air filter 95, a one-way non-return valve 36, a tube 38, and a charge injection port 40 to the cylinder bore 14 in the cylinder block 12. The tube 38 provides a passage 39 for gaseous communication between the combustion chamber 30 and the crankcase chamber 26. The passage 39 leads to and is in fluid communication with a crankcase charge port 46 in the crankcase 28 which is controlled by and open to a first rotary shut-off valve 148. The timing of the induction of the rich fuel/air mixture and injection of fuel is controlled by the first rotary shut-off valve 148 mounted on a disk which, in this embodiment, is the second crank web 142 that is rotatably connected to the crankshaft 22.

The first rotary shut-off valve 148 includes circumferentially extending first and second gaseous pathways illustrated as slots 44 and 45 formed in the second crank web 142. The slots 44 and 45 are alignable with the crankcase charge port 46 open to the injection passage 39. The second crank web 142 closes off the crankcase charge port 46 and the injection passage 39 in the injection tube 38 until the crankcase charge port 46 is circumferentially aligned with the first or second slots 44 and 45, thus, allowing gaseous communication between the crankcase chamber 26 and the passage 39.

The first and second slots 44 and 45 are cut in the second crank web 142, though other types of disks attached to the crankshaft 22 may be used. The first and second slots 44 and 45 are cut-away sections of the second crank web 142. The first and second slots 44 and 45 open fluid communication between the tube 38 and the crankcase chamber 26 as the second crank web 142 rotates with the crankshaft 22. The first rotary valve 148 formed in the second crank web opens and closes off the crankcase charge port 46, thus, providing the valving function of the first rotary shut-off valve 148 as the second crank web 142 rotates with the crankshaft 22.

Opening and closing each of the first and second slots 44 and 45 between the tube 38 and the crankcase chamber 26 induces a fuel/air mixture charge into the passage 39 during fraction of one cycle of the engine, or a fraction of a first half rotation of the second crank web 142, and a discharge of the fuel/air mixture through the tube 38 into the combustion chamber 30 during the next cycle of the engine 20. Timing of the opening and closing of the slots 44 and 45 by the first rotary shut-off valve 148 is asymmetric.

In a variation to the opening of the crankcase charge port 46 by the slot 45 for injection of charge in the charge passage into combustion chamber 30, the crankcase charge port 46 may be kept closed by the first rotary valve 148 for the blow down pressure into the passage 39 to reflect off of the first rotary valve 148 to perform like a compressed air assisted wave injection engine such as the one disclosed in U.S. Pat. No. 6,273,037.

Transfer passages 11 provide fluid communication between the combustion chamber 30 at the transfer ports 33 and crankcase chamber 26 at crankcase transfer ports. The crankcase transfer ports are controlled by second rotary shut-off valves 149 on the first and second crank webs 121 and 142. Each of the second rotary shut-off valves 149 includes first and second tabs 190 and 191 on each of the first and second crank webs 121 and 142. The first and second tabs 190 and 191 are alignable with crankcase transfer ports 111.

Figure 52:
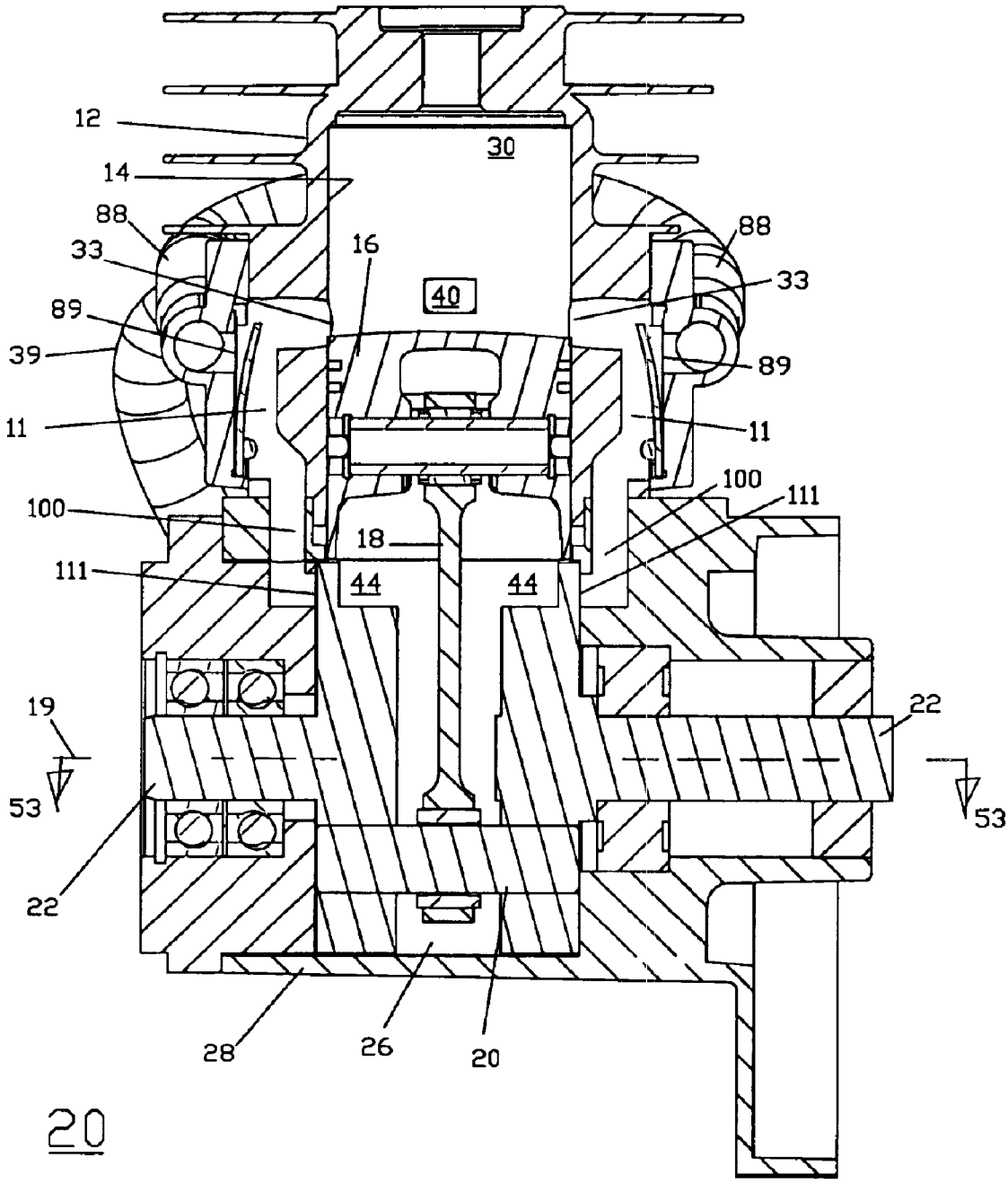
FIG. 52 is the vertical side view illustration of the engine through 52—52 in FIG. 50.
Figure 53:
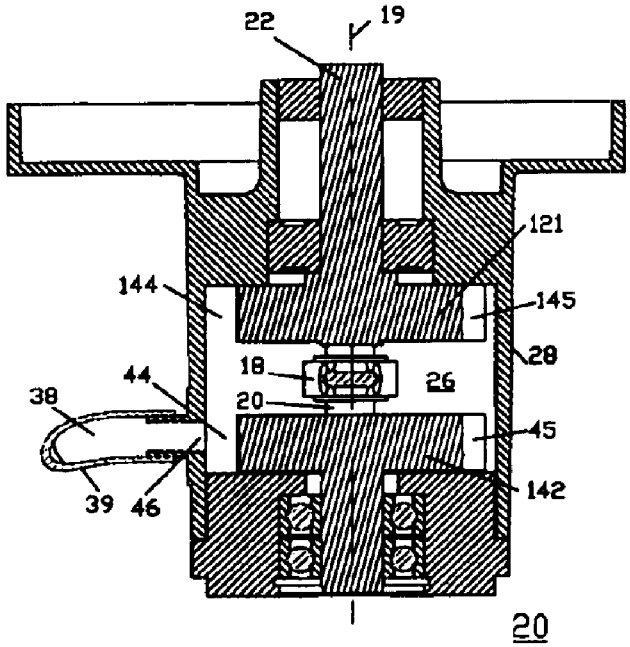
FIG. 53 is a top looking down cross-sectional view illustration of the engine through 53—53 in FIG. 52.
Figure 54:
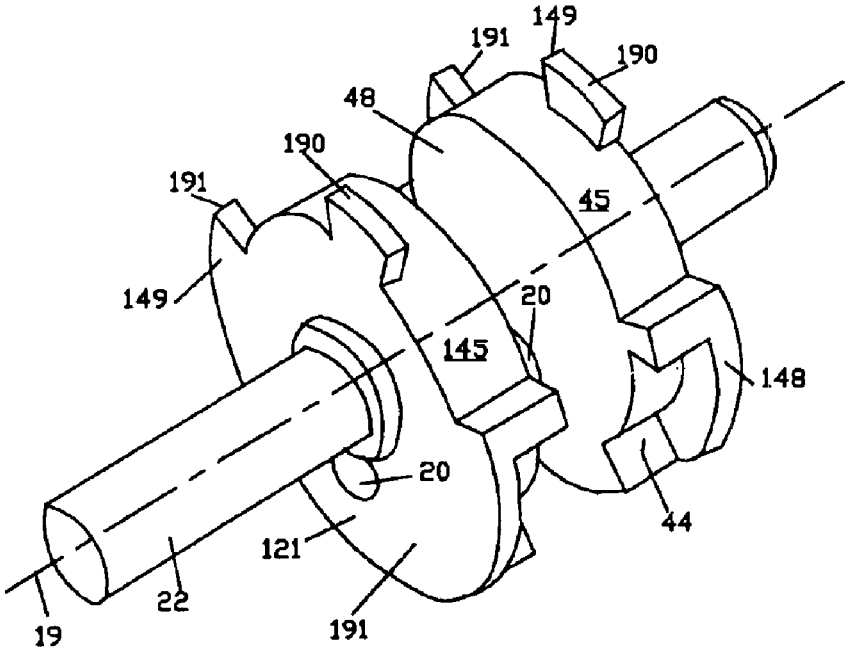
FIG. 54 is a perspective view illustration of a crank web with rotary shut-off valves in the engine illustrated in FIGS. 52–53.

During the first half rotation of the crankshaft, when the piston is ascending, the crankcase transfer ports 111 are opened by the second rotary shut-off valves 149 and the crankcase is in fluid communication with the ambient air. As the crankcase pressure is lower than the ambient, air fills the transfer passage 11. The air flow is supplied to the transfer passages 11 through one-way reed valves 89 at the end of air passages 88 as illustrated in FIG. 52. The air flow is supplied to the transfer passages 11 by an air intake system including an air control valve 94 of a three-way carburetor 132 leading to air passages 88 illustrated in FIG. 51. The air control valve 94 controls only the air, a fuel/air mixture valve 81 is used for controlling fuel/air mixture, and the two valves are linked to each other.

At an appropriate time, the engine ports 111 are closed by the first tabs 191 to prevent the flow of air into the crankcase. Closing off of the transfer passages 11 from the crankshaft chamber 26 lowers the effective crankshaft chamber volume for further induction of lean charge during ascending of the piston 16. This allows the lean charge to flow into the crankshaft chamber 26 from the carburetor 132 through the lean passage 107 and through the main inlet port 84. As the piston 16 descends, the crankshaft chamber 26 pressure is increased. While air is retained in the transfer passages 11, the rich charge is retained in the passage 39. During a fraction of the ascending stroke and during the fraction of the descending stroke, the air is trapped between the transfer ports 33 and the engine ports 111.

The transfer ports 33 are shut-off by the piston and the engine ports 111 are shut-off by the first and second tabs 190 and 191 of the second rotary shut-off valves 149. Similarly, the rich charge in the tube 38 is trapped between the injection port 40 and the crankcase port 46. The piston shuts off the injection port 40 in the cylinder and the first rotary shut-off valve 148 cuts off the crankcase port 46. Control of engine ports 111 for the transfer passages 11 and control of the crankcase port 46 allows the engine to have unsymmetrical induction and injection timing for both the charge and air to achieve stratified scavenging and charging. During the scavenging process, the engine ports 111 are opened first to allow the air to lead the lean charge into the combustion chamber 30 and allow the air to act as a buffer medium between the fresh charge and the burnt gas. Rich charge injected later through the charge injection port 40 is timed by the first rotary shut-off valve 148 for low emission.

Piston channel controlled air head system may also be used for induction of air into transfer passages as illustrated in FIGS. 34–36. When the piston channel system is used in engine 20, it eliminates the need for reed valves 80 in engine 20.

An example of port timings for a piston ported two stroke engine is illustrated in the chart below. The timings can be optimized depending on intake system, application, and engine size.

Typical port timings for a charge injected stratified charge scavenging system piston ported engine.

Charge crankcase port 41 (and where used ring port 60), open for charge induction about 20 to 10 degrees ABDC and close 20 degrees BTDC to 10 degrees ATDC.

Intake port 84, open 60 to 40 degrees BTDC and close 60 to 40 degrees ATDC.

Exhaust port 50, open 100 to 125 degrees ATDC and close 100 to 125 degrees BTDC.

Transfer port 33, open 110 to 135 degrees ATDC and close 110 to 135 degrees BTDC.

Charge injection port 40, open 105 to 120 degrees ATDC and close 105 to 120 degrees BTDC.

Charge crankcase port 41 (and when used ring port 60), open for injection 100 to 120 degrees ATDC and close 10 degrees BBDC to 10 degrees ABDC.

Transfer passage 11 and crankcase transfer port 111, open 10 to 20 degrees ABDC for air induction through air passage 88.

Transfer passage 11 and crankcase port 111, close 80 to 50 degrees BTDC for ending induction of air.

Transfer passage 11 and crankcase port 111, open 100 to 125 degrees ATDC for start of scavenging and close 25 degrees BBDC to 5 degrees ABDC to cut off port 111.

Wherein:

ATDC=After top dead center

BTDC=Before top dead center

ABDC=After bottom dead center
BBDC=Before bottom dead center.

Figure 56:
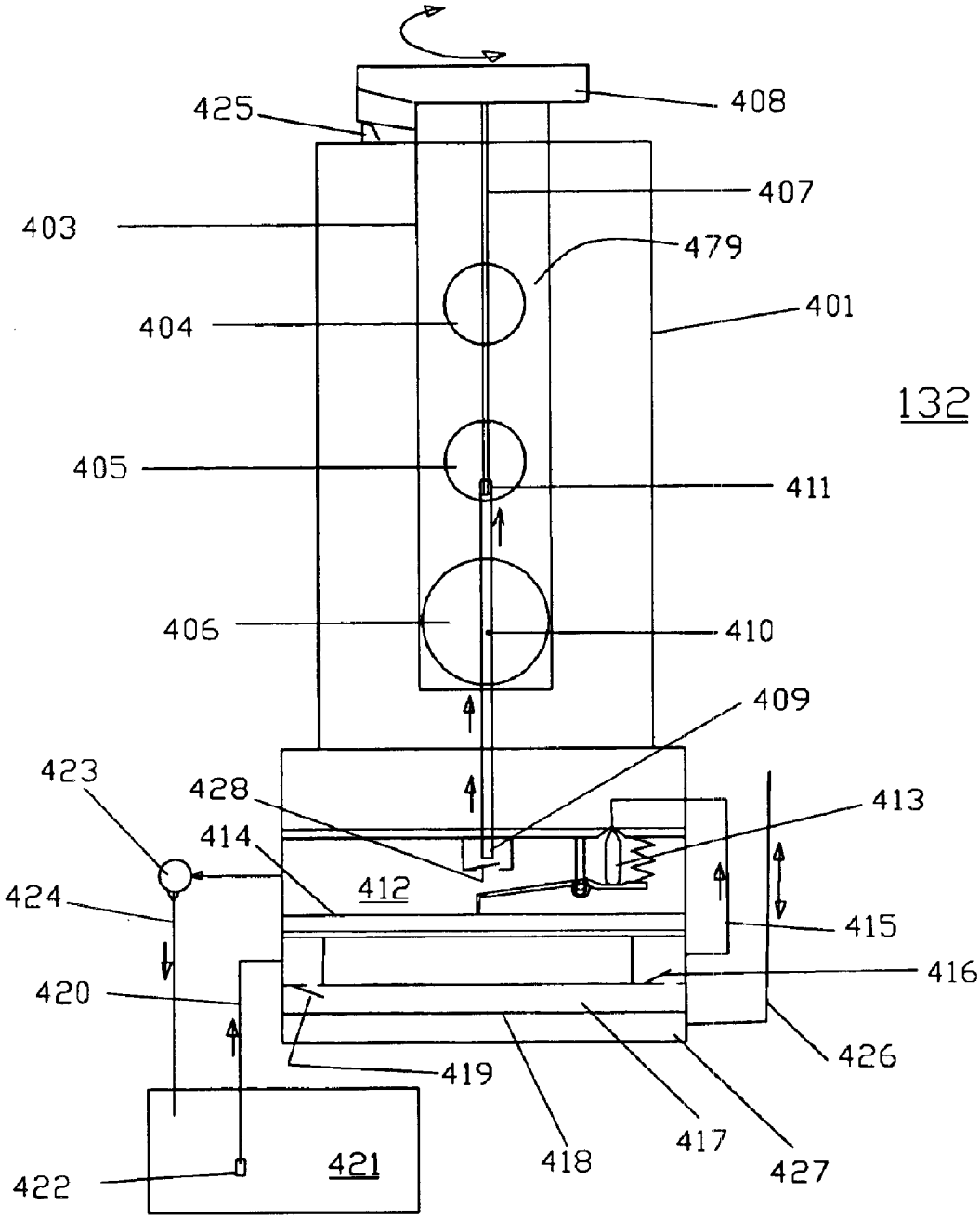
FIG. 56 is a diagrammatic illustration of a three-way carburetor illustrated in FIG. 51 and in a wide open throttle position.
Figure 57:
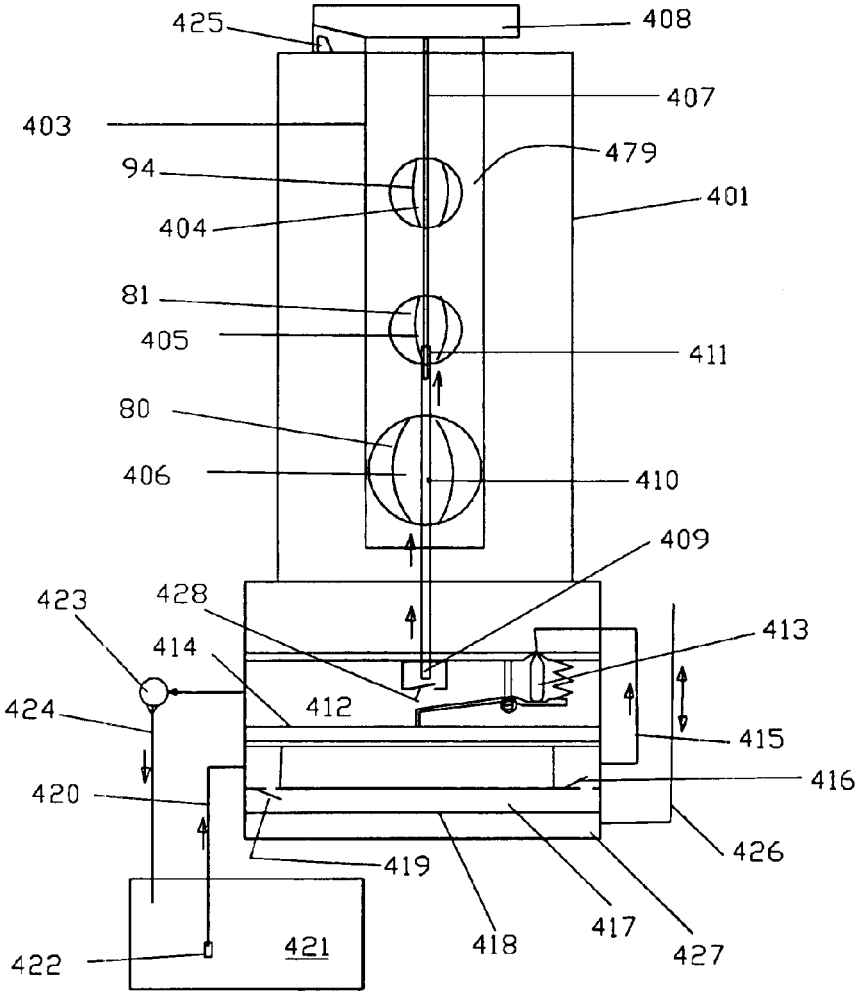
FIG. 57 is a diagrammatic illustration of a three-way carburetor illustrated in FIG. 51 and in a partially closed throttle position.
Figure 58:
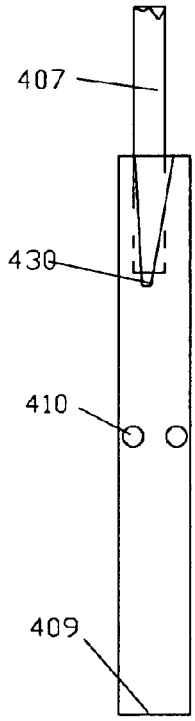
FIG. 58 is a diagrammatic illustration of a fuel jet assembly in the three-way carburetor illustrated in FIG. 56.

The three-way carburetor 132 is illustrated in more detail in FIGS. 56–58. As the piston 16 ascends in the cylinder bore 14 of the engine, the pressure in the crankcase chamber drops below ambient. The differential pressure between the crankcase chamber and the ambient (outside of the carburetor) causes air to flow into the crankcase chamber through the appropriate passages (transfer passages or charge passages). There are three flow transversely extending venturi passages in a longitudinally extending barrel 403 of a three-way carburetor. An air venturi passage 404 allows only air, which is regulated by the air control barrel valve 94, to flow into the transfer passage 11. A rich charge venturi passage 405 flows a rich charge regulated by a rich charge barrel valve 81 into the charge passage 39. A lean charge venturi passage 406 flows a lean charge regulated by a lean charge barrel valve 80 directly into the crankcase chamber 26. The air control, rich charge, and lean charge barrel valves are mounted on a rotatable barrel valve body 479.

Fuel is mixed with the air in the rich and lean charge venturi passages 405 and 406. As air passes through the rich and lean charge venturi passages 405 and 406, the pressures in the venturi passages drop. The differential pressure between a fuel metering chamber 412 and the rich and lean charge venturi passages 405 and 506 causes the fuel to be discharged into air streams in the venturi passages through respective lean and rich jets 410 and 411.

A pulse line 426 is in communication with the crankcase chamber 26 and the pulse chamber 427. Positive and negative pressures in the crankcase chamber 26 causes the pump diaphragm 418 to pulsate drawing fuel from the fuel tank 421 through the fuel supply line 420 and the second flapper valve 419 into the pump chamber 417. As crankcase chamber pressure rises, the pulse chamber 427 exerts pressure on the pump diaphragm 418 which causes the fuel in the pump chamber 417 to flow into the metering chamber 412 through the first flapper valve 416 and first fuel line 415. The diaphragm needle valve assembly 413 controls the flow of fuel into the metering chamber. The metering diaphragm 414 activates the needle valve assembly 413. As the fuel flows into the venturi passages the pressure drops in the metering chamber which causes the needle valve to allow the fuel to flow from the pump chamber.

The fuel jet assembly 409 consists of a combination of lean jet 410 and a rich jet 411. FIG. 58 shows an enlarged illustration of the jets assembly and the main needle. The lower end of the jet assembly 409 opens into the metering chamber 412 and may have more than one fuel spray hole 410 in the lean venturi passage. The upper end of the jet has a V shaped slot 430 through which the fuel flows into the rich venturi passage. The amount of fuel that flows into the rich charge venturi passage 405 is controlled by the main needle 407 which moves up and down as the barrel valve body 479 is rotated by a throttle for load and speed regulation. As the barrel valve body 479 is rotated for speed and load, it regulates the flow of charge and air into the engine.

The rotation of barrel valve body 479 causes a throttle cam 408 to ride on a cam pin 425 which causes the barrel 403 to rise. The main needle 407 attached to the barrel 403 also rises which increases the fuel flow area in the V shaped slot 430. The flow of fuel increases in proportion to the flow of air through the rich charge venturi passage 405. As the throttle is opened more and more, a larger fraction of the total fuel (fuel through lean jet 410 plus fuel through rich jet 411) flows through the rich jet 411. As a result the ratio of fuel through rich jet to the fuel through lean jet depends on the throttle position. It may therefore be fair to assume that the richness of air-fuel ratio flowing through the lean venturi passage directly into the crankcase chamber 26 decreases with increase in throttle opening. Thus a rich charge is supplied to the crankcase chamber during idle and part throttle and a very lean charge during 30% and higher speed and load conditions. This helps to lower the emissions, particularly at wide open throttle condition and helps a stable idle running and fast throttle response.

The carburetor also includes a primer bulb 423 which has one way valves built into it. It is a manual pump used to prime the metering chamber to remove the air or fuel vapor trapped in the metering chamber. As the prime bulb is depressed manually, the fuel is pumped back into the fuel tank 421 through the return line 424. As the bulb is released the fuel (or air or vapor during initial period) is drawn into the bulb from the metering chamber. During this time, the diaphragm needle valve is lowered allowing the fuel to be drawn from the fuel tank through the flapper valves and pump chamber. The third flapper valve 428 at the entrance to the main jet 409 prevents the air from venturi passage to get into the metering chamber during priming.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A two stroke internal combustion engine comprising:

at least one gaseous communication passage between a crankcase chamber and a combustion chamber of the engine, a rotatable circular disk rotatably connected to a crankshaft of the engine, at least one rotary shut-off valve located in a radially outermost section of the circular disk bordered by a periphery of the circular disk and operatively disposed between the passage and the crankcase chamber for opening and closing gaseous communication between the passage and the crankcase chamber, and at least one circumferentially extending pathway extending axially at least partially through the disk, the pathway being rotatably disposed between the passage and the crankcase chamber for opening and closing gaseous communication between the passage and the crankcase chamber.

2. The engine as claimed in claim 1 wherein the pathway extend circumferentially less than 180 degrees.

3. The engine as claimed in claim 2 wherein the pathway is a circumferentially extending annular slot and extends axially at least partially through the periphery of the circular disk.

4. The engine as claimed in claim 3 wherein the disk is a crank web of the engine.

5. The engine as claimed in claim 2 wherein the disk is disposed within the crankcase chamber.

6. The engine as claimed in claim 2 wherein the pathway is a circumferentially extending annular slot extending radially outwardly through the periphery of the disk and axially at least partially through the periphery of the circular disk.

7. The engine as claimed in claim 6 wherein the disk is disposed within the crankcase chamber.

8. The engine as claimed in claim 7 wherein the disk is a crank web of the engine.

9. The engine as claimed in claim 2 further comprising an angularly adjustable ring having an annular channel disposed between the circumferentially extending pathway and the passage and a ring port through the ring leading to the annular channel.

10. The engine as claimed in claim 9 wherein the disk is disposed within the crankcase chamber.

11. The engine as claimed in claim 9 wherein the disk is a crank web of the engine.

12. The engine as claimed in claim 9 wherein the pathway is a circumferentially extending annular slot extending radially outwardly through the periphery of the disk and axially at least partially through the periphery of the circular disk.

13. The engine as claimed in claim 12 wherein the disk is disposed within the crankcase chamber.

14. The engine as claimed in claim 13 wherein the disk is a crank web of the engine.

15. The engine as claimed in claim 9 further comprising:

the rotary shut-off valve including at least two circumferentially spaced apart and circumferentially extending pathways extending axially at least partially through the disk, the pathways extend circumferentially less than 180 degrees, and the pathways being rotatably disposed between the passage and the crankcase chamber for opening and closing gaseous communication between the passage and the crankcase chamber.

16. The engine as claimed in claim 15 wherein the pathways are circumferentially extending annular rectangular cross-sectional slots that extend axially at least partially through the periphery of the circular disk.

17. The engine as claimed in claim 9 further comprising a fixed lip extending into the annular channel.

18. The engine as claimed in claim 17 wherein the disk is disposed within the crankcase chamber.

19. The engine as claimed in claim 17 wherein the disk is a crank web of the engine.

20. The engine as claimed in claim 17 wherein the pathway is a circumferentially extending annular slot extending radially outwardly through the periphery of the disk and axially at least partially through the periphery of the circular disk.

21. The engine as claimed in claim 2 further comprising:

the pathway being an annular L-shaped pathway having a radially inwardly extending annular slot intersecting an axially extending annular slot, the radially inwardly extending annular slot including a radially outwardly facing radial inlet in the periphery, and the axially extending annular slot including an axially facing axial outlet located radially inwardly of the periphery.

22. The engine as claimed in claim 21 further comprising:

an angularly adjustable ring concentrically disposed around the periphery of the circular disk, an annular ring channel extending circumferentially partway through the angularly adjustable ring and disposed between the crankcase chamber and the passage, and a ring port in the adjustable ring rotatably open to the radially inwardly extending annular slot through the radially outwardly facing radial inlet.

23. The engine as claimed in claim 21 further comprising a circumferentially extending annular rectangular cross-sectional slot that extend axially at least partially through the periphery of the circular disk and that are axially adjacent the L-shaped pathway.

24. The engine as claimed in claim 23 further comprising;

axially adjacent first and second angularly adjustable rings concentrically surrounding the circular disk, first and second annular ring channels extending circumferentially partway through the first and second angularly adjustable rings respectively, the first annular ring channel being disposed between the crankcase chamber and the one gaseous communication passage, and the second annular ring channel being disposed between the crankcase chamber and a second gaseous communication passage.

25. The engine as claimed in claim 24 further comprising:

the first and second annular ring channels having first and second ring ports, the first ring port being rotatably open to the radially inwardly extending annular slot through the radially outwardly facing radial inlet in the periphery, and the second ring port being rotatably open to the annular rectangular cross-sectional slot.

26. A two stroke internal combustion engine comprising:

at least one gaseous communication passage between a crankcase chamber and a combustion chamber of the engine, a rotatable circular disk rotatably connected to a crankshaft of the engine, at least one rotary shut-off valve located in a radially outermost section of the circular disk bordered by a periphery of the circular disk and operatively disposed between the passage and the crankcase chamber for opening and closing gaseous communication between the passage and the crankcase chamber.

the rotary shut-off valve including at least two circumferentially spaced apart and circumferentially extending pathways extending axially at least partially through the disk, the pathways extend circumferentially less than 180 degrees, and the pathways being rotatably disposed between the passage and the crankcase chamber for opening and closing gaseous communication between the passage and the crankcase chamber.

27. The engine as claimed in claim 26 wherein the pathways are circumferentially extending annular slots and extends axially at least partially through the periphery of the circular disk.

28. The engine as claimed in claim 27 wherein the disk is disposed within the crankcase chamber.

29. The engine as claimed in claim 28 wherein the disk is a crank web of the engine.

30. The engine as claimed in claim 26 wherein the pathways are circumferentially extending annular slots extending radially outwardly through the periphery of the disk and axially at least partially through the periphery of the circular disk.

31. The engine as claimed in claim 30 wherein the disk is disposed within the crankcase chamber.

32. The engine as claimed in claim 31 wherein the disk is a crank web of the engine.

33. A two stroke internal combustion engine comprising:

a carburetor including first and second barrels in gaseous flow communication with a charge injection port and a main inlet port respectively, the charge injection port leads into a combustion chamber of a cylinder bore of the engine, the main inlet port leads into the cylinder bore below the combustion chamber, a first flow passage extending between the first barrel and the charge injection port, an injection passage extending between the first flow passage and the crankcase chamber, a one way valve disposed between the first flow passage and the injection passage for allowing a flow of charge from the first passage into the charge passage, a rotatable circular disk rotatably connected to a crankshaft of the engine, and at least one rotary shut-off valve located in a radially outermost section of the circular disk bordered by a periphery of the circular disk and operatively disposed between the injection passage and the crankcase chamber for opening and closing gaseous communication between the injection passage and the crankcase chamber.

34. The engine as claimed in claim 33 further comprising at least one transfer passage connecting in gaseous communication the crankcase chamber and the combustion chamber in the cylinder bore of the engine.

35. The engine as claimed in claim 34 wherein the rotary shut-off valve includes at least a first circumferentially extending pathway extending axially at least partially through the disk, the pathway being rotatably disposed between the injection passage and the crankcase chamber for opening and closing gaseous communication between the injection passage and the crankcase chamber.

36. The engine as claimed in claim 35 wherein the pathway extend circumferentially less than 180 degrees.

37. The engine as claimed in claim 36 further comprising a second circumferentially extending pathway extending axially at least partially through the disk wherein each of the first and second pathways extend circumferentially less than 180 degrees.

38. The engine as claimed in claim 37 wherein the pathways are circumferentially extending annular slots and extends axially at least partially through the periphery of the circular disk.

39. The engine as claimed in claim 38 wherein the disk is disposed within the crankcase chamber.

40. The engine as claimed in claim 39 wherein the disk is a crank web of the engine.

41. The engine as claimed in claim 33 further comprising an injection insert with a curved passage disposed between the injection passage and the charge injection port wherein the curved passage is aimed upward into the combustion chamber.

42. A two stroke internal combustion engine comprising:

a cylinder block housing a cylinder bore, a piston disposed within the cylinder bore connected by means of a connecting rod to a crank throw on a circular crank web of a crankshaft, the crankshaft journaled for rotation about a crankshaft axis within a crankcase chamber of a crankcase affixed to a lower end of the cylinder block, the cylinder bore open to the crankcase chamber, a combustion chamber defined within the cylinder bore above the piston, an air inlet port disposed through the cylinder block to the cylinder bore, the air inlet port in gaseous communication with an air cleaner and an air regulating valve operably disposed between the air inlet port and the cleaner, a crankcase port into the crankcase chamber connected in gaseous communication to the combustion chamber in the cylinder bore of the engine by at least one transfer passage, first and second piston ports disposed in a skirt of the piston and connected in gaseous communication by an air channel, the first piston port being translatably alignable with the air inlet port, the second piston port being translatably alignable with a transfer port leading to the transfer passage, a rotatable circular disk rotatably connected to a crankshaft of the engine, and at least one rotary shut-off valve located in a radially outermost section of the circular disk bordered by a periphery of the circular disk and operatively disposed between the transfer passage and the crankcase port for opening and closing gaseous communication between the transfer passage and the crankcase chamber.

43. The engine as claimed in claim 42 wherein the rotary shut-off valve includes at least a first circumferentially extending pathway extending axially at least partially through the disk, the pathway being rotatably disposed between the transfer passage and the crankcase chamber for opening and closing gaseous communication between the transfer passage and the crankcase chamber.

44. The engine as claimed in claim 43 wherein the pathway extend circumferentially less than 180 degrees.

45. The engine as claimed in claim 44 further comprising a second circumferentially extending pathway extending axially at least partially through the disk wherein each of the first and second pathways extend circumferentially less than 180 degrees.

46. The engine as claimed in claim 45 wherein the pathways are circumferentially extending annular slots and extends axially at least partially through the periphery of the circular disk.

47. The engine as claimed in claim 46 wherein the disk is the crank web of the engine.

48. The engine as claimed in claim 42 further comprising:

a main inlet port in the cylinder block extending through to the cylinder bore, the main inlet port longitudinally offset from the air inlet port and in flow communication with the carburetor, the piston translatably disposed between the main inlet port, and the main inlet port positioned with respect to piston such that the piston covers and uncovers the main inlet port.

49. The engine as claimed in claim 48 wherein the rotary shut-off valve includes at least a first circumferentially extending pathway extending axially at least partially through the disk, the pathway being rotatably disposed between the transfer passage and the crankcase chamber for opening and closing gaseous communication between the transfer passage and the crankcase chamber.

50. The engine as claimed in claim 49 wherein the pathway extend circumferentially less than 180 degrees.

51. The engine as claimed in claim 50 further comprising a second circumferentially extending pathway extending axially at least partially through the disk wherein each of the first and second pathways extend circumferentially less than 180 degrees.

52. The engine as claimed in claim 51 wherein the pathways are circumferentially extending annular slots and extends axially at least partially through the periphery of the circular disk.

53. The engine as claimed in claim 52 wherein the disk is the crank web of the engine.

54. The engine as claimed in claim 48 further comprising a butterfly valve operably disposed between the air inlet port and an air cleaner.

55. The engine as claimed in claim 54 wherein the rotary shut-off valve includes at least a first circumferentially extending pathway extending axially at least partially through the disk, the pathway being rotatably disposed between the transfer passage and the crankcase chamber for opening and closing gaseous communication between the transfer passage and the crankcase chamber.

56. The engine as claimed in claim 55 wherein the pathway extend circumferentially less than 180 degrees.

57. The engine as claimed in claim 55 further comprising a second circumferentially extending pathway extending axially at least partially through the disk wherein each of the first and second pathways extend circumferentially less than 180 degrees.

58. The engine as claimed in claim 57 wherein the pathways are circumferentially extending annular slots and extends axially at least partially through the periphery of the circular disk.

59. The engine as claimed in claim 58 wherein the disk is the crank web of the engine.

60. The engine as claimed in claim 42 further comprising:

a main inlet port in the cylinder block extending through to the cylinder bore and in flow communication with the carburetor, a first regulating valve operably disposed between the air inlet port and an air cleaner, and a reed valve operably disposed between the main inlet port and the carburetor.

61. The engine as claimed in claim 60 further comprising a carburetor including the air cleaner and a second regulating valve in the carburetor operably disposed between the reed valve and the air cleaner.

62. The engine as claimed in claim 61 wherein the first and second regulating valves are first and second butterfly valves.

63. The engine as claimed in claim 62 wherein the first and second butterfly valves are linked together.

64. The engine as claimed in claim 61 wherein the rotary shut-off valve includes at least a first circumferentially extending pathway extending axially at least partially through the disk, the pathway being rotatably disposed between the transfer passage and the crankcase chamber for opening and closing gaseous communication between the transfer passage and the crankcase chamber.

65. The engine as claimed in claim 64 wherein the pathway extend circumferentially less than 180 degrees.

66. The engine as claimed in claim 64 further comprising a second circumferentially extending pathway extending axially at least partially through the disk wherein each of the first and second pathways extend circumferentially less than 180 degrees.

67. The engine as claimed in claim 66 wherein the pathways are circumferentially extending annular slots and extends axially at least partially through the periphery of the circular disk.

68. The engine as claimed in claim 67 wherein the disk is the crank web of the engine.

69. A two stroke internal combustion engine comprising:

a cylinder block housing a cylinder bore, a piston disposed within the cylinder bore connected by means of a connecting rod to a crank throw on a circular crank web of a crankshaft, the crankshaft journaled for rotation about a crankshaft axis within a crankcase chamber of a crankcase affixed to a lower end of the cylinder block, the cylinder bore being open to the crankcase chamber, a combustion chamber defined within the cylinder bore above the piston, at least one transfer port extending through the cylinder block to the cylinder bore and into the combustion chamber, at least one cylinder port open to the crankcase chamber, located below transfer port, and extending through the cylinder block to the cylinder bore, at least one transfer passage connecting in gaseous communication the transfer and cylinder ports, a skirt of the piston translatably disposed between the cylinder port and the cylinder, at least one window in the skirt, the window being translatably alignable with the cylinder port in a range between 100 degrees ATDC and 170 degrees ATDC with respect to engine timing, and the piston skirt being timed for completely shutting off the cylinder port between 30 degrees BBDC and 5 degrees BBDC as the piston approaches a BDC position.

70. The engine as claimed in claim 69 further comprising a rotatable circular disk rotatably connected to a crankshaft of the engine and at least one rotary shut-off valve located in a radially outermost section of the circular disk bordered by a periphery of the circular disk and operatively disposed between a charge injection passage and the crankcase chamber for opening and closing gaseous communication between the charge injection passage and the crankcase chamber.

71. The engine as claimed in claim 70 wherein the rotary shut-off valve includes at least a first circumferentially extending pathway extending axially at least partially through the disk, the pathway being rotatably disposed between the charge injection passage and the crankcase chamber for opening and closing gaseous communication between the transfer passage and the crankcase chamber.

72. The engine as claimed in claim 71 wherein the pathway extend circumferentially less than 180 degrees.

73. The engine as claimed in claim 72 further comprising a second circumferentially extending pathway extending axially at least partially through the disk wherein each of the first and second pathways extend circumferentially less than 180 degrees.

74. The engine as claimed in claim 73 wherein the pathways are circumferentially extending annular slots and extends axially at least partially through the periphery of the circular disk.

75. The engine as claimed in claim 74 wherein the disk is the crank web of the engine.

76. A two stroke internal combustion engine comprising:

a cylinder block housing a cylinder bore, a piston disposed within the cylinder bore connected by means of a connecting rod to a crank throw on a circular crank web of a crankshaft, the crankshaft journaled for rotation about a crankshaft axis within a crankcase chamber of a crankcase affixed to a lower end of the cylinder block, a combustion chamber defined within the cylinder bore above the piston, at least one transfer passage connecting in gaseous communication a crankcase port of the transfer passage that is open to the crankcase chamber and the combustion chamber in the cylinder bore of the engine, an air passage leading to the transfer passage a one-way valve operably dispose between the air passage and the transfer passage, a rotatable circular disk rotatably connected to a crankshaft of the engine and at least one rotary shut-off valve located in a radially outermost section of the circular disk bordered by a periphery of the circular disk and operatively disposed between the transfer passage and the crankcase chamber for opening and closing gaseous communication between the transfer passage and the crankcase chamber, and at least a first circumferentially extending pathway extending axially at least partially through the disk, the pathway being rotatably disposed between the transfer passage and the crankcase chamber for opening and closing gaseous communication between the transfer passage and the crankcase chamber.

77. The engine as claimed in claim 76 wherein the pathway extend circumferentially less than 180 degrees.

78. The engine as claimed in claim 77 further comprising a second circumferentially extending pathway extending axially at least partially through the disk wherein each of the first and second pathways extend circumferentially less than 180 degrees.

79. The engine as claimed in claim 78 wherein the pathways are circumferentially extending annular slots and extends axially at least partially through the periphery of the circular disk.

80. The engine as claimed in claim 79 wherein the disk is the crank web of the engine.

81. A two stroke internal combustion engine comprising:

a cylinder block housing a cylinder bore, a piston disposed within the cylinder bore connected by means of a connecting rod to a crank throw on a circular crank web of a crankshaft, the crankshaft journaled for rotation about a crankshaft axis within a crankcase chamber of a crankcase affixed to a lower end of the cylinder block, the cylinder bore open to the crankcase chamber, a combustion chamber defined within the cylinder bore above the piston, an air inlet port disposed through the cylinder block to the cylinder bore, the air inlet port in gaseous communication with an air cleaner and an air regulating valve operably disposed between the air inlet port and the cleaner, first and second crankcase ports into the crankcase chamber connected in gaseous communication to the combustion chamber in the cylinder bore of the engine by at least first and second transfer passages respectively, a first piston port disposed in a skirt of the piston, second and third piston ports disposed in the skirt 180 degrees apart from each other and 90 degrees apart from the first piston port in the skirt of the piston, the first, second and third piston ports connected in gaseous communication by an air channel, the first piston port being translatably alignable with the air inlet port, the second and third piston ports being translatably alignable with first and transfer ports leading to the first and second transfer passages respectively, first and second rotatable circular disks rotatably connected to a crankshaft of the engine, and at least one rotary shut-off valve located in a radially outermost section of each of the circular disks bordered by a periphery of each of the circular disks and operatively disposed between the first and second transfer passages and the crankcase ports for opening and closing gaseous communication between the transfer passages and the crankcase chamber.

82. The engine as claimed in claim 81 wherein each of the rotary shut-off valves includes at least a first circumferentially extending pathway extending axially at least partially through the disk, the pathway being rotatably disposed between the transfer passage and the crankcase chamber for opening and closing gaseous communication between the transfer passages and the crankcase chamber.

* * * * *